US007990345B2

(12) United States Patent
Itakura et al.

(10) Patent No.: US 7,990,345 B2
(45) Date of Patent: Aug. 2, 2011

(54) PLASMA DISPLAY PANEL AND DRIVE METHOD THEREFOR

(75) Inventors: Shunsuke Itakura, Chuo (JP); Atsushi Hirota, Chuo (JP); Hai Lin, Chuo (JP); Tsutomu Tokunaga, Chuo (JP)

(73) Assignee: Panasonic Corporation, Osaka (JP)

( * ) Notice: Subject to any disclaimer, the term of this patent is extended or adjusted under 35 U.S.C. 154(b) by 992 days.

(21) Appl. No.: 11/852,377

(22) Filed: Sep. 10, 2007

(65) Prior Publication Data

US 2008/0068304 A1 Mar. 20, 2008

(30) Foreign Application Priority Data

Sep. 8, 2006 (JP) ..... 2006-243912
Sep. 12, 2006 (JP) ..... 2006-246686
Sep. 12, 2006 (JP) ..... 2006-246687

(51) Int. Cl.
*G09G 3/28* (2006.01)

(52) U.S. Cl. ..... 345/65; 345/60

(58) Field of Classification Search ..... 345/60–77, 345/204–215; 315/169.1–169.4
See application file for complete search history.

(56) References Cited

U.S. PATENT DOCUMENTS

| | | | | |
|---|---|---|---|---|
| 6,409,562 | B1 | 6/2002 | Asano et al. | |
| 7,463,220 | B2 * | 12/2008 | Sakata et al. | 345/60 |
| 7,522,128 | B2 * | 4/2009 | Tokunaga et al. | 345/60 |
| 7,633,465 | B2 * | 12/2009 | Sakata et al. | 345/60 |
| 2008/0061692 | A1 | 3/2008 | Miura et al. | |

FOREIGN PATENT DOCUMENTS

| | | | |
|---|---|---|---|
| EP | 1132938 | A2 | 9/2001 |
| EP | 1418564 | A2 | 5/2004 |
| EP | 1550999 | A2 | 7/2005 |
| EP | 1580786 | A2 | 9/2005 |
| EP | 1 622 114 | A | 2/2006 |
| EP | 1696409 | A2 | 8/2006 |
| JP | 2002-014652 | A | 1/2002 |
| JP | 2003-092086 | A | 3/2003 |
| JP | 2003-297250 | A | 10/2003 |
| JP | 2005-183206 | A | 7/2005 |
| JP | 2006-003397 | A | 1/2006 |
| JP | 2006-54160 | A | 2/2006 |

(Continued)

OTHER PUBLICATIONS

Japanese Office Action dated Dec. 14, 2007 issued in Japanese Patent Application No. 2006-243912.

(Continued)

*Primary Examiner* — Vijay Shankar
(74) *Attorney, Agent, or Firm* — Sughrue Mion, PLLC

(57) ABSTRACT

A plasma display panel and a drive method therefor, which can enhance a representation capability when displaying a dark image. The plasma display panel includes fluorophor layers containing magnesium oxide. The drive method includes a reset step to initialize all the pixel cells into states of one of a light-up mode and a light-off mode, and an address step in which the pixel cells are caused to perform address discharges selectively in accordance with pixel data, which are successively executed in each of a head subfield and a second subfield within a one-field display period. In reset step, a voltage that sets row electrodes on one side, in the row electrode pairs as an anode and sets the column electrodes set as a cathode is applied between the row electrodes on the one side and the column electrodes.

6 Claims, 30 Drawing Sheets

FOREIGN PATENT DOCUMENTS

| | | | |
|---|---|---|---|
| JP | 2006-59779 | A | 3/2006 |
| JP | 2006-59786 | A | 3/2006 |
| JP | 2006-184486 | A | 7/2006 |
| KR | 2001-283740 | A | 10/2001 |
| KR | 2006-0056869 | A | 5/2006 |
| WO | 2006/038654 | | 4/2006 |

OTHER PUBLICATIONS

Explanation of Circumstances Concerning Accelerated Examination dated Nov. 15, 2007 issued in Japanese Application No. 2006-243912.

European Extended Search Report dated Apr. 3, 2009.

Korean Office Action dated Jul. 24, 2008 issued in corresponding Korean Patent Application No. 10-2007-0091242.

XP-002503919; Database Inspec (Online) The Institution of Electrical Engineers, Stevenage, GB; Aug. 1, 1958 Gandy H: "Cathodoluminescence of strontium oxide, barium-strontium oxide and magnesium oxide" Database accession No. 1959A02223 *abstract* & Physical Review USA, vol. 111, No. 3, Aug. 1, 1958, pp. 764-771, *p. 768; figure 5 *.

European Search Report.

* cited by examiner

SECTION III – III

SECTION IV – IV

SINGLE CRYSTALS OF CUBIC
SINGLE - CRYSTAL STRUCTURE

SINGLE - CRYSTAL MgO CUBIC MULTIPLE CRYSTAL STRUCTURE

DISCHARGE PROBABILITY (REST TIME : 1000 $\mu$sec$^{-1}$)

| | ACTUAL MEASUREMENT VALUE | NORMALIZATION 1 | NORMALIZATION 2 |
|---|---|---|---|
| MULTIPLE CRYSTAL STRUCTURE MgO | 89.8 | 826.4 | 39.09 |
| EVAPORATED MgO | 2.3 | 21.1 | 1.00 |
| NONEXISTENCE OF MgO | 0.1 | 1.0 | 0.05 |

DISCHARGE DELAY T

DISCHARGE DELAY (REST TIME : 1000 μsec)

| | ACTUAL MEASUREMENT VALUE | NORMALIZATION 1 | NORMALIZATION 2 |
|---|---|---|---|
| MULTIPLE CRYSTAL STRUCTURE MgO | 0.5 | 0.01 | 0.12 |
| EVAPORATED MgO | 4.0 | 0.06 | 1.00 |
| NONEXISTENCE OF MgO | 65.0 | 1.00 | 16.25 |

DISCHARGE STRENGTH OF RESET DISCHARGE (PRIOR ART)

DISCHARGE DELAY OF CATHODE COLUMN ELECTRODE DISCHARGE

FIG. 26

| GRADATION DRIVE | DATA CONVERSION TABLE | | | | | | | | | | | | | | | LIGHT EMISSION PATTERN | | | | | | | | | | | | | | | DISPLAY INTENSITY |
|---|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 | 0 | 0 | 0 | 0 | 0 | 0 | 0 | 0 | 0 | 0 | 0 | 0 | 0 | | | | | | | | | | | | | | | 0 |
| 2ND | 0001 | 1 | 0 | 0 | 0 | 0 | 0 | 0 | 0 | 0 | 0 | 0 | 0 | 0 | 0 | □ | | | | | | | | | | | | | | α |
| 3RD | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4TH | 0011 | 1 | 1 | 1 | 0 | 0 | 0 | 0 | 0 | 0 | 0 | 0 | 0 | 0 | 0 | □ | ◎ | ● | | | | | | | | | | | | 1+α |
| 5TH | 0100 | 1 | 1 | 0 | 1 | 0 | 0 | 0 | 0 | 0 | 0 | 0 | 0 | 0 | 0 | □ | ◎ | ○ | ● | | | | | | | | | | | 3+α |
| 6TH | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | 9+α |
| 7TH | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | 17+α |
| 8TH | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | 27+α |
| 9TH | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | 39+α |
| 10TH | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | 55+α |
| 11TH | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | 77+α |
| 12TH | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | 103+α |
| 13TH | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | 133+α |
| 14TH | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | 169+α |
| 15TH | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | 209+α |
| 16TH | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | 255+α |

□ : WRITE ADDRESS DISCHARGE + MINUTE LIGHT EMISSION DISCHARGE

○ : SUSTAIN DISCHARGE LIGHT EMISSION

◎ : WRITE ADDRESS DISCHARGE + SUSTAIN DISCHARGE LIGHT EMISSION

● : ERASE ADDRESS DISCHARGE $\alpha < 1$

FIG. 36

GRADATION DRIVE

DISPLAY INTENSITY

| | DATA CONVERSION TABLE | | | | | | | | | | | | | | | LIGHT EMISSION PATTERN | | | | | | | | | | | | | | |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 | 0 | 0 | 0 | 0 | 0 | 0 | 0 | 0 | 0 | 0 | 0 | 0 | 0 | | | | | | | | | | | | | | | 0 |
| 2ND | 0001 | 1 | 1 | 0 | 0 | 0 | 0 | 0 | 0 | 0 | 0 | 0 | 0 | 0 | 0 | ◎ | ● | | | | | | | | | | | | | 1 |
| 3RD | 0010 | 1 | 0 | 1 | 0 | 0 | 0 | 0 | 0 | 0 | 0 | 0 | 0 | 0 | 0 | ◎ | ○ | ● | | | | | | | | | | | | 3 |
| 4TH | 0011 | 1 | 0 | 0 | 1 | 0 | 0 | 0 | 0 | 0 | 0 | 0 | 0 | 0 | 0 | ◎ | ○ | ○ | ● | | | | | | | | | | | 9 |
| 5TH | 0100 | 1 | 0 | 0 | 0 | 1 | 0 | 0 | 0 | 0 | 0 | 0 | 0 | 0 | 0 | ◎ | ○ | ○ | ○ | ● | | | | | | | | | | 17 |
| 6TH | 0101 | 1 | 0 | 0 | 0 | 0 | 1 | 0 | 0 | 0 | 0 | 0 | 0 | 0 | 0 | ◎ | ○ | ○ | ○ | ○ | ● | | | | | | | | | 27 |
| 7TH | 0110 | 1 | 0 | 0 | 0 | 0 | 0 | 1 | 0 | 0 | 0 | 0 | 0 | 0 | 0 | ◎ | ○ | ○ | ○ | ○ | ○ | ● | | | | | | | | 39 |
| 8TH | 0111 | 1 | 0 | 0 | 0 | 0 | 0 | 0 | 1 | 0 | 0 | 0 | 0 | 0 | 0 | ◎ | ○ | ○ | ○ | ○ | ○ | ○ | ● | | | | | | | 55 |
| 9TH | 1000 | 1 | 0 | 0 | 0 | 0 | 0 | 0 | 0 | 1 | 0 | 0 | 0 | 0 | 0 | ◎ | ○ | ○ | ○ | ○ | ○ | ○ | ○ | ● | | | | | | 73 |
| 10TH | 1001 | 1 | 0 | 0 | 0 | 0 | 0 | 0 | 0 | 0 | 1 | 0 | 0 | 0 | 0 | ◎ | ○ | ○ | ○ | ○ | ○ | ○ | ○ | ○ | ● | | | | | 95 |
| 11TH | 1010 | 1 | 0 | 0 | 0 | 0 | 0 | 0 | 0 | 0 | 0 | 1 | 0 | 0 | 0 | ◎ | ○ | ○ | ○ | ○ | ○ | ○ | ○ | ○ | ○ | ● | | | | 119 |
| 12TH | 1011 | 1 | 0 | 0 | 0 | 0 | 0 | 0 | 0 | 0 | 0 | 0 | 1 | 0 | 0 | ◎ | ○ | ○ | ○ | ○ | ○ | ○ | ○ | ○ | ○ | ○ | ● | | | 147 |
| 13TH | 1100 | 1 | 0 | 0 | 0 | 0 | 0 | 0 | 0 | 0 | 0 | 0 | 0 | 1 | 0 | ◎ | ○ | ○ | ○ | ○ | ○ | ○ | ○ | ○ | ○ | ○ | ○ | ● | | 179 |
| 14TH | 1101 | 1 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 215 |
| 15TH | 1110 | 1 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : WRITE ADDRESS DISCHARGE + SUSTAIN DISCHARGE LIGHT EMISSION

○ : SUSTAIN DISCHARGE LIGHT EMISSION

● : ERASE ADDRESS DISCHARGE

PLASMA DISPLAY PANEL AND DRIVE METHOD THEREFOR

BACKGROUND OF THE INVENTION

1. Field of the Invention

This invention relates to the configuration of a plasma display panel and a drive method for a plasma display panel.

2. Description of the Related Art

Nowadays, as thin-screen display devices, plasma display panels (hereinbelow, abbreviated to the "PDPs") of AC type (AC discharge type) have been put into commercial production. In the PDP, two substrates, namely, a front transparent substrate and a rear substrate, are arranged in opposition through a predetermined spacing. A plurality of row electrode pairs in which row electrodes forming the respective pairs extend in the lateral direction of a screen are formed on that inner surface of the front transparent substrate (a surface opposing to the rear substrate) which is a display surface. Further, a dielectric layer which covers the respective row electrode pairs are formed on such an inner surface of the front transparent substrate. On the other hand, a plurality of column electrodes which extend in the vertical direction of the screen so as to intersect the row electrode pairs are formed on the rear substrate. In a case where the PDP is viewed from the side of the display surface, pixel cells corresponding to pixels are formed at the intersection parts between the row electrode pairs and the column electrodes.

In a prior-art AC type plasma display panel ("PDP") of surface discharge scheme, a magnesium oxide layer which contains magnesium oxide crystals that have the characteristic of presenting cathode-luminescence emission (hereinbelow, termed the "CL emission") having a peak within a wavelength region of 200-300 nm, by excitation based on an electron beam, is formed as a protective layer on the surface of a dielectric layer covering row electrodes as confront discharge cells, whereby discharge characteristics such as the discharge delay time of a discharge generated within the discharge cell are improved by the characteristic of the magnesium oxide crystals contained in the magnesium oxide layer. For example, Japanese Patent Kokai No. 2006-59779 (Patent Document 1) discloses the above-described PDP.

Besides, in a prior-art PDP, a magnesium oxide layer which contains magnesium oxide crystals that present photoluminescence emission (hereinbelow, termed the "PL emission") radiating ultraviolet radiation with a peak wavelength at 230-250 nm, when excited by ultraviolet radiation radiated from a discharge gas, is formed at, at least, a part confronting each discharge cell, between a front substrate and a rear substrate, and a fluorophor layer fluoresces when excited by the ultraviolet radiation which is radiated by the PL emission of the magnesium oxide crystals contained in the magnesium oxide layer, and the ultraviolet radiation which is radiated from the discharge gas, whereby an intensity can be enhanced. For example, Japanese Patent Kokai No. 2006-59786 (Patent Document 2) discloses the PDP mentioned above.

Further betterments in the discharge characteristics and further enhancement in the intensity are required of such prior-art PDPs. It is also required to prevent the lowering of a dark contrast attributed to reset discharges (discharges for initializing all the discharge cells) which are performed within the discharge cells during the drive of the PDP.

Such a PDP is subjected to a gradation drive employing a subfield method, in order to obtain a display intensity of halftone corresponding to an input video signal.

In the gradation drive based on the subfield method, a display drive for the video signal for one field is performed in a plurality of subfields to which the numbers of times (or periods) for performing light emissions are respectively allotted. In each subfield, an address step and a sustain step are successively executed. In the address step, selective discharges are caused between the row electrodes and the column electrodes within the respective pixel cells in accordance with the input video signal, thereby to form (or erase) predetermined quantities of wall charges. In the sustain step, only the pixel cells formed with the predetermined quantities of wall charges are repeatedly discharged, thereby to sustain light emission states induced by the discharges. Further, in at least the head subfield, a reset step is executed in advance of the address step. In such a reset step, the reset discharges are caused between the paired row electrodes within all the pixel cells, thereby to initialize the quantities of the wall charges remaining within all the pixel cells.

Here, the reset discharges are comparatively strong discharges and are not pertinent to the contents of an image to-be-displayed at all. Therefore, the PDPs have had the problem that the light emissions induced by the discharges lower the contrast of the image.

In this regard, there have been proposed a PDP and a drive method therefor wherein magnesium oxide crystals which present cathode-luminescence emission having a wavelength peak within 200-300 nm, when excited by electron beam irradiation, are stuck on the surface of a dielectric layer covering row electrode pairs, thereby to shorten a discharge delay time. For example, Japanese Patent Kokai No. 2006-54160 (Patent Document 3) discloses this PDP. According to such a PDP, a priming effect after a discharge continues for a comparatively long time, and hence, a weak discharge can be caused stably. Therefore, a reset pulse in a pulse waveform whose voltage value arrives at a peak voltage value gradually with the lapse of time is impressed on the row electrodes of the PDP as stated above, whereby a weak reset discharge is caused between the row electrodes adjacent to each other. Owing to the weak reset discharge, a light emission intensity attendant upon the discharge becomes low, so that the contrast of the image can be heightened.

Even with such a drive method, however, the so-called "dark contrast" in the case of displaying a dark image cannot be satisfactorily heightened, and this has posed the problem that the dark image cannot be offered in a state of high quality.

SUMMARY OF THE INVENTION

This invention has for one of its objects to meet the requirements for the prior-art PDPs as stated above.

A PDP according to a first aspect of this invention for accomplishing the object consists in a plasma display panel including a pair of substrates which oppose to each other through a discharge space, a plurality of row electrode pairs which are disposed on one of the pair of substrates, a plurality of column electrodes which are disposed on the other substrate so as to extend in a direction intersecting the row electrode pairs and which form unit light emission regions in the discharge space at their respective parts intersecting the row electrode pairs, and fluorophor layers which are disposed at positions confronting the unit light emission regions between the column electrodes and the row electrode pairs, wherein a discharge gas is enclosed in the discharge space. In the plasma display panel, a secondary electron emission material is contained in the fluorophor layers; and the secondary electron emission material is magnesium oxide which contains magnesium oxide crystals that have a characteristic of presenting a cathode luminescence light emission having a peak within a wavelength region of 200-300 nm, when excited by an electron beam.

A drive method for a PDP according to a second aspect for accomplishing the object consists in a drive method for a plasma display panel including a pair of substrates which oppose to each other through a discharge space, a plurality of row electrode pairs which are disposed on one of the pair of substrates, a plurality of column electrodes which are disposed on the other substrate so as to extend in a direction intersecting the row electrode pairs and which form unit light emission regions in the discharge space at their respective parts intersecting the row electrode pairs, and fluorophor layers which are disposed at positions confronting the unit light emission regions between the column electrodes and the row electrode pairs and which contain a secondary electron emission material, wherein a discharge gas is enclosed in the discharge space. The drive method has, in the drive step, a step of impressing a voltage pulse on row electrodes on one side, which constitute the row electrode pairs, and setting a potential of the column electrodes on a cathode side relatively to the row electrodes on one side, which have been impressed with the voltage pulse, whereby opposed discharges are generated between the column electrodes and the row electrodes on one side, through the fluorophor layers.

The PDP according to this invention includes the pair of substrates which oppose to each other through the discharge space, the plurality of row electrode pairs which are disposed on the side of one of the pair of substrates, the plurality of column electrodes which are disposed on the side of the other substrate so as to extend in the direction intersecting the row electrode pairs and which form the unit light emission regions in the discharge space at their respective parts intersecting the row electrode pairs, and the fluorophor layers which are disposed at the positions confronting the unit light emission regions between the column electrodes and the row electrode pairs, wherein the discharge gas is enclosed in the discharge space, the secondary electron emission material is contained in the fluorophor layers, and the secondary electron emission material is the magnesium oxide which contains the magnesium oxide crystals that have the characteristic of presenting the cathode luminescence light emission having the peak within the wavelength region of 200-300 nm, when excited by the electron beam.

In addition, the drive method for the above PDP according to this invention includes as the drive step, the step of impressing the voltage pulse on the row electrodes on one side, which constitute the row electrode pairs, and setting the potential of the column electrodes on the cathode side relatively to the row electrodes on one side, which have been impressed with the voltage pulse, whereby the opposed discharges are generated between the column electrodes and the row electrodes on one side, through the fluorophor layers.

In the PDP which is driven by the drive method, the fluorophor layers which are formed at the positions confronting the unit light emission regions contain the secondary electron emission material, and the opposed discharges are generated between the row electrodes on one side, in the row electrode pairs, and the column electrodes as are located with the fluorophor layers interposed therebetween, whereby at the generations of the discharges, cations produced from the discharge gas within the unit light emission regions collide against the secondary electron emission material contained in the fluorophor layers, and secondary electrons are emitted from the secondary electron emission material into the unit light emission regions.

Thus, discharges which proceed subsequently to the opposed discharges between the row electrodes on one side and the column electrodes become liable to be generated, by the secondary electrons existing within the unit light emission regions, and the discharge initiation voltage of the subsequent discharges is lowered.

Besides, in a case where the opposed discharges between the row electrodes on one side and the column electrodes are reset discharges for initializing all the unit light emission regions at the drive of the PDP, these opposed discharges are performed at substantially the central parts of the unit light emission regions spaced from that substrate of the pair of substrates which forms the panel face of the PDP. Therefore, light emissions based on the reset discharges as are recognized at the panel face become less than in a case where the reset discharges are performed by the surface discharges between the row electrodes at positions near the panel face. Accordingly, a dark contrast is prevented from lowering due to the light emissions which are based on the reset discharges and which have no relation to the gradation display of an image, and enhancement in the dark contrast of the PDP can be attained.

In addition, according to the drive method for the PDP described above, the opposed discharges between the row electrodes on one side and the column electrodes are generated in such a way that the voltage pulse is impressed on the row electrodes on one side, and that the potential of the column electrodes is set on the negative electrode side relatively to the row electrodes on one side, impressed with the voltage pulse. Thus, the cations produced from the discharge gas by the opposed discharges advance toward the column electrodes serving as the negative electrode side and collide against the secondary electron emission material contained in the fluorophor layers. Therefore, the secondary electrons are efficiently emitted from the secondary electron emission material into the unit light emission regions.

In the PDP and the drive method therefor, the secondary electron emission material should preferably be located at those parts in the fluorophor layers which confront the unit light emission regions.

Thus, the secondary electron emission material contained in the fluorophor layers collides against the cations efficiently, and the secondary electrons can be emitted into the unit light emission regions more efficiently.

In the PDP and the drive method therefor, aspects in which the secondary electron material is contained in the fluorophor layers include an aspect in which the secondary electron material is mixed with fluorescent materials constituting the fluorophor layers, an aspect in which the secondary electron material forms layers and are stacked on layers formed of the fluorescent materials constituting the fluorophor layers, and so forth.

In the PDP and the drive method therefor, magnesium oxide should preferably be used as the secondary electron emission material. Thus, the secondary electrons can be efficiently emitted from the fluorophor layers into the unit light emission regions.

Further, in the PDP and the drive method therefor, as the secondary electron material, it is favorable to use magnesium oxide which contains magnesium oxide crystals that have the characteristic of presenting a cathode luminescence light emission having a peak within a wavelength region of 200-300 nm, further within 230 nm-250 nm, when excited by an electron beam, especially magnesium oxide single crystals that have been produced by vapor phase oxidation.

Thus, the discharge strength and discharge delay of the opposed discharges between the row electrodes on one side and the column electrodes can be decreased, and the intensity of the PDP can be enhanced.

In the drive method for the PDP, the opposed discharges between the row electrodes on one side and the column electrodes should preferably be employed for the reset discharges for initializing the unit light emission regions.

Thus, the reset discharges are performed at substantially the central parts of the unit light emission regions spaced from that substrate of the pair of substrates which forms the panel face of the PDP.

Therefore, light emissions based on the reset discharges as are recognized at the panel face become less than in a case where the reset discharges are performed by the surface discharges between the row electrodes at positions near the panel face. Accordingly, a dark contrast is prevented from lowering due to the light emissions which are based on the reset discharges and which have no relation to the gradation display of an image, and enhancement in the dark contrast of the PDP can be attained. In the drive method for the PDP, it is favorable to impress a voltage pulse of positive polarity on the row electrodes on one side, and to impress a voltage pulse of negative polarity on the column electrodes or to hold the column electrodes at a ground potential.

Thus, so-called "cathode column electrode discharges" in which cations produced from the discharge gas by the discharges advance toward the column electrodes serving as the negative electrodes are generated between the row electrodes on one side and the column electrodes.

Besides, in the drive method for the PDP, it is favorable that simultaneously with the impression of the voltage pulse on the row electrodes on one side, a voltage pulse which is identical in polarity to the voltage pulse that is impressed on the row electrodes on one side and whose potential does not generate any potential that induces discharges between the row electrodes on one side and the row electrodes on the other side, constituting the row electrode pairs, is impressed on the row electrodes on the other side.

Thus, the discharges are prevented from being generated between the row electrodes of the row electrode pairs, and the opposed discharges can be reliably generated between the row electrodes on one side and the column electrodes.

Further, in the drive method for the PDP, the voltage pulse should preferably be impressed on the row electrodes on one side, in an aspect in which a voltage enlarges at a required increase rate since start of the impression.

Thus, the opposed discharges are generated in a state where the voltage at the rise of the voltage pulse is not considerably large, so that the discharge strength of the opposed discharges can be lowered.

This invention has for another object to provide a drive method for a plasma display panel as can heighten the representation capability of an intensity gradation in the case of displaying a dark image.

A drive method for a plasma display panel according to a third aspect of this invention consists in a drive method for a plasma display panel wherein a first substrate and a second substrate are arranged in opposition through a discharge space in which a discharge gas is enclosed, and pixel cells which contain fluorophor materials and a secondary electron emission material are formed at respective intersection parts between a plurality of row electrode pairs formed on the first substrate and a plurality of column electrodes formed on the second substrate, the plasma display panel being driven in accordance with pixel data of respective pixels based on a video signal. The method comprises a reset step of subjecting the pixel cells to reset discharges, thereby to initialize the pixel cells into states of one of a light-up mode and a light-off mode, and an address step of subjecting the pixel cells to address discharges selectively in accordance with the pixel data, thereby to shift the pixel cells into states of the other of the light-up mode and the light-off mode, the reset step and the address step being successively executed in each of at least a head subfield and a second subfield immediately after the head subfield in a case where a one-field display period in the video signal is divided into a plurality of subfields; wherein in the reset step, a voltage with row electrodes on one side, in the row electrode pairs set as an anode side and the column electrodes set as a cathode side is applied between the row electrodes on one side and the column electrodes, thereby to induce the reset discharges between the row electrodes on one side and the column electrodes.

Besides, a drive method for a plasma display panel according to a fourth aspect of this invention consists in a drive method for a plasma display panel wherein a first substrate and a second substrate are arranged in opposition through a discharge space in which a discharge gas is enclosed, and pixel cells are formed at respective intersection parts between a plurality of row electrode pairs formed on the first substrate and a plurality of column electrodes formed on the second substrate, the plasma display panel being driven in accordance with pixel data of respective pixels based on a video signal. The drive method comprises a first reset step of subjecting the pixel cells to reset discharges, thereby to initialize the pixel cells into states of a light-off mode, a first address step of subjecting the pixel cells to address discharges selectively in accordance with the pixel data, thereby to shift the pixel cells into states of a light-up mode, and a minute light emission step of subjecting the pixel cells being in the states of the light-up mode, to minute light emission discharges, the first reset step, the first address step and the minute light emission step being successively executed in a head subfield in a case where a one-field display period in the video signal is divided into a plurality of subfields; wherein in the first reset step, a voltage with row electrodes on one side, in the row electrode pairs set as an anode side and the column electrodes set as a cathode side is applied between the row electrodes on one side and the column electrodes, thereby to induce the reset discharges between the row electrodes on one side and the column electrodes; and in the minute light emission step, a voltage with the row electrodes on one side, in the row electrode pairs set as an anode side and the column electrodes set as a cathode side is applied between the row electrodes on one side and the column electrodes, thereby to induce the minute light emission discharges between the column electrodes and the row electrodes on one side, within the pixel cells being in the states of the light-up mode.

Besides, a drive method for a plasma display panel according to a fifth aspect of this invention consists in a drive method for a plasma display panel wherein a first substrate and a second substrate are arranged in opposition through a discharge space in which a discharge gas is enclosed, and pixel cells are formed at respective intersection parts between a plurality of row electrode pairs formed on the first substrate and a plurality of column electrodes formed on the second substrate, the plasma display panel being driven in accordance with pixel data of respective pixels based on a video signal. The drive method comprises a reset step of subjecting the pixel cells to reset discharges, thereby to initialize the pixel cells into states of a light-off mode, and an address step of subjecting the pixel cells to address discharges selectively in accordance with the pixel data, thereby to shift the pixel cells into states of a light-up mode, the reset step and the address step being successively executed in each of at least a head subfield and a second subfield immediately after the head subfield, in a case where a one-field display period in the video signal is divided into a plurality of subfields; wherein in the reset step, a voltage with row electrodes on one side, in the row electrode pairs set as an anode side and the column electrodes set as a cathode side is applied between the row electrodes on one side and the column electrodes, thereby to induce the reset discharges between the row electrodes on one side and the column electrodes; and a potential which is applied to the row electrodes on one side in order to induce the reset discharges, in the reset step of the head subfield, is lower than a potential which is applied to the row electrodes on one side in order to induce the reset discharges, in the reset step of the second subfield.

Besides, a drive method for a plasma display panel according to a sixth aspect of this invention consists in a drive method for a plasma display panel wherein a first substrate and a second substrate are arranged in opposition through a discharge space in which a discharge gas is enclosed, and pixel cells are formed at respective intersection parts between a plurality of row electrode pairs formed on the first substrate and a plurality of column electrodes formed on the second substrate, the plasma display panel being driven in accordance with pixel data of respective pixels based on a video signal. The drive method comprises a reset step of subjecting the pixel cells to reset discharges, thereby to initialize the pixel cells into states of a light-off mode, and an address step of subjecting the pixel cells to address discharges selectively in accordance with the pixel data, thereby to shift the pixel cells into states of a light-up mode, the reset step and the address step being successively executed in each of at least a head subfield and a second subfield immediately after the head subfield, in a case where a one-field display period in the video signal is divided into a plurality of subfields; wherein in the reset step, a voltage with row electrodes on one side, in the row electrode pairs set as an anode side and the column electrodes set as a cathode side is applied between the row electrodes on one side and the column electrodes, thereby to induce the reset discharges between the row electrodes on one side and the column electrodes; and a potential which is applied to the row electrodes on the other side in the row electrode pairs, in the address step of the head subfield, is lower than a potential which is applied to the row electrodes on the other side, in the address step of the second subfield.

A plasma display panel in which pixel cells that contain fluorophor materials and a secondary electron emission material are formed at respective intersection parts between a plurality of column electrodes and a plurality of row electrode pairs, is driven as follows: A reset step in which all the pixel cells are caused to perform reset discharges, thereby to initialize the individual pixel cells into states of one of a light-up mode and a light-off mode, and an address step in which the pixel cells are caused to perform address discharges selectively in accordance with pixel data, thereby to shift the individual pixel cells into states of the other of the light-up mode and the light-off mode, are successively executed in each of a head subfield and a second subfield within a one-field display period. In each reset step, a voltage with row electrodes on one side, in the row electrode pairs set as an anode side and the column electrodes set as a cathode side is applied between the row electrodes on one side and the column electrode, whereby the reset discharges are induced between both the electrodes.

According to such a drive, at the reset discharges, cations within the discharge gas collide against the secondary electron emission material in advancing toward the side of the column electrodes, and they emit secondary electrons into the discharge space. The discharge initiation voltage of the pixel cells becomes low owing to a priming action based on such secondary electrons, and hence, comparatively weak reset discharges can be induced. Consequently, owing to the weak reset discharges, a light emission intensity involved in the discharges lowers, so that a display in which a dark contrast is enhanced can be presented. Further, the reset discharges are induced between the row electrodes on one side, formed on the side of the front transparent substrate and the column electrodes formed on the side of the rear substrate.

Therefore, discharge light which is externally emitted from the side of the front transparent substrate becomes less than in a case where the reset discharges are induced between the row electrodes both of which are formed on the side of the front transparent substrate, so that further enhancement in the dark contrast can be attained. Besides, immediately after the address step of the head subfield as stated above, a voltage with the row electrodes on one side, in the row electrode pairs set as an anode side and the column electrodes set as a cathode side is applied between both the electrodes, thereby to induce minute light emission discharges between the column electrodes and the row electrodes on one side within the pixel cells being in the states of the light-up mode. Since the minute light emission discharges are generated between the row electrodes on one side, in the row electrode pairs formed on the side of the front transparent substrate and the column electrodes formed on the side of the rear substrate, a light emission intensity involved in the discharges is lower than in sustain discharges which are generated between the row electrodes formed on the side of the front transparent substrate. In other words, it is permitted to represent an intensity level which is lower than an intensity level that is visually recognized in a case where the sustain discharges are induced only once. Therefore, the intensity difference between gradations representing low intensities becomes smaller, so that a gradation representation capability in the case of representing a dark image is heightened.

A drive method for a plasma display panel according to a seventh aspect of this invention consists in a drive method for a plasma display panel wherein a first substrate and a second substrate are arranged in opposition through a discharge space in which a discharge gas is enclosed, and pixel cells which contain fluorophor materials and a secondary electron emission material are formed at respective intersection parts between a plurality of row electrode pairs formed on the first substrate and a plurality of column electrodes formed on the second substrate, the plasma display panel being driven in accordance with pixel data of respective pixels based on a video signal. The drive method comprises a reset step of subjecting the pixel cells to reset discharges, thereby to initialize the pixel cells into a light-off mode, and an address step of subjecting the pixel cells to address discharges selectively in accordance with the pixel data, thereby to set the pixel cells into a light-up mode, the reset step and the address step being executed in a head subfield in a case where a one-field display period in the video signal is divided into a plurality of subfields; wherein in the reset step, a voltage with row electrodes on one side, in the row electrode pairs set as an anode side and the column electrodes set as a cathode side is applied between the row electrodes on one side and the column electrodes, thereby to induce the reset discharges between the row electrodes on one side and the column electrodes.

A plasma display panel in which pixel cells that contain fluorophor materials and a secondary electron emission material are formed at respective intersection parts between a plurality of column electrodes and a plurality of row electrode pairs, is driven as follows: In a head subfield within a one-field display period, a voltage with row electrodes on one side, in the row electrode pairs set as an anode side and the column electrodes set as a cathode side is applied between the row electrodes on one side and the column electrodes, whereby reset discharges for initializing all the pixel cells into a light-off mode are induced between the column electrodes and the row electrodes within all the pixel cells.

According to such a drive, at the reset discharges, cations within the discharge gas collide against the secondary electron emission material in advancing toward the side of the column electrodes, and they emit secondary electrons into the discharge space. The discharge initiation voltage of the pixel cells becomes low owing to a priming action based on such secondary electrons, and comparatively weak reset discharges can be induced. Consequently, owing to the weak reset discharges, a light emission intensity involved in the discharges lowers, so that a display in which a dark contrast is enhanced can be presented. Further, the reset discharges are induced between the row electrodes on one side, formed on the side of the front transparent substrate and the column electrodes formed on the side of the rear substrate. Therefore, discharge light which is externally emitted from the side of the front transparent substrate becomes less than in a case where the reset discharges are induced between the row electrodes both of which are formed on the side of the front transparent substrate. Accordingly, further enhancement in the dark contrast can be attained.

BRIEF DESCRIPTION OF THE DRAWINGS

FIG. 26 is a diagram showing light emission patterns of respective gradations;

FIG. 36 is a diagram showing light emission patterns of respective gradations in another embodiment;

DETAILED DESCRIPTION OF THE INVENTION

Figure 1:
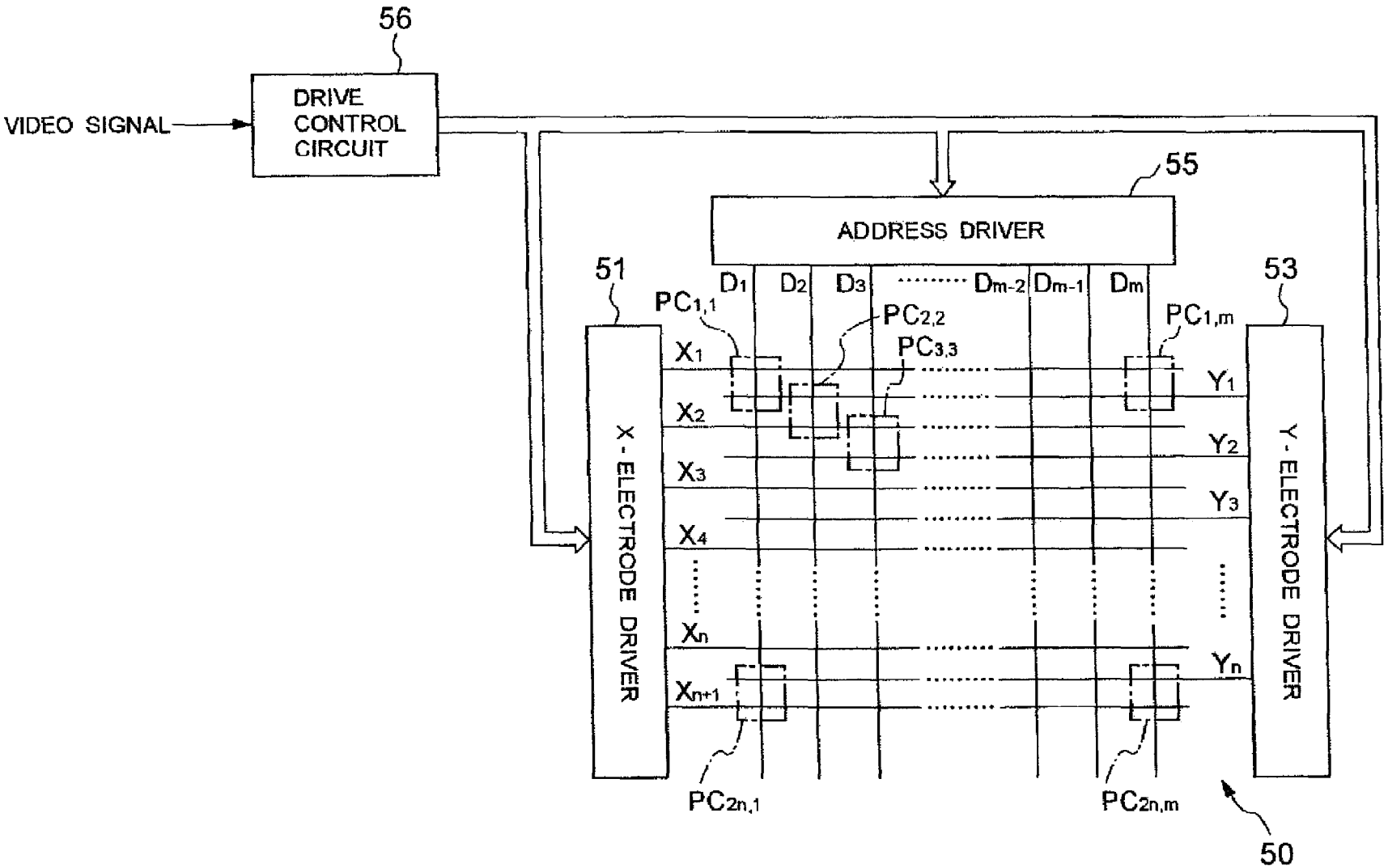
FIG. 1 is a diagram showing the schematic configuration of a plasma display device according to this invention.

FIG. 1 is a diagram showing the schematic configuration of a plasma display device which drives a plasma display panel in accordance with a drive method according to this invention.

As shown in FIG. 1, such a plasma display device includes the plasma display panel (PDP) 50, an X-electrode driver 51, a Y-electrode driver 53, an address driver 55, and a drive control circuit 56.

The PDP 50 is formed with column electrodes $D_1$-$D_m$ which are respectively extended and arrayed in the vertical direction of a two-dimensional display screen, and row electrodes $X_1$-$X_n$ and row electrodes $Y_1$-$Y_n$ which are respectively extended and arrayed in the lateral direction (horizontal direction). In this case, row electrode pairs in which the row electrodes adjacent to each other are paired; ($Y_1$, $X_1$), ($Y_2$, $X_2$), ($Y_3$, $X_3$), . . . , and ($Y_n$, $X_n$) bear a first display line—an n th display line in the PDP 50, respectively. Pixel cells PCs bearing pixels are formed at the intersection parts between the respective display lines and the column electrodes $D_1$-$D_m$ (regions enclosed with dot-and-dash lines in FIG. 1). More specifically, in the PDP 50, the pixel cells $PC_{1,1}$-$PC_{1,m}$, which belong to the first display line, $PC_{2,1}$-$PC_{2,m}$, which belong to the second display line, . . . , and $PC_{n,1}$-$PC_{n,m}$ which belong to the n-th display line are respectively arrayed in the shape of a matrix.

Figure 2:
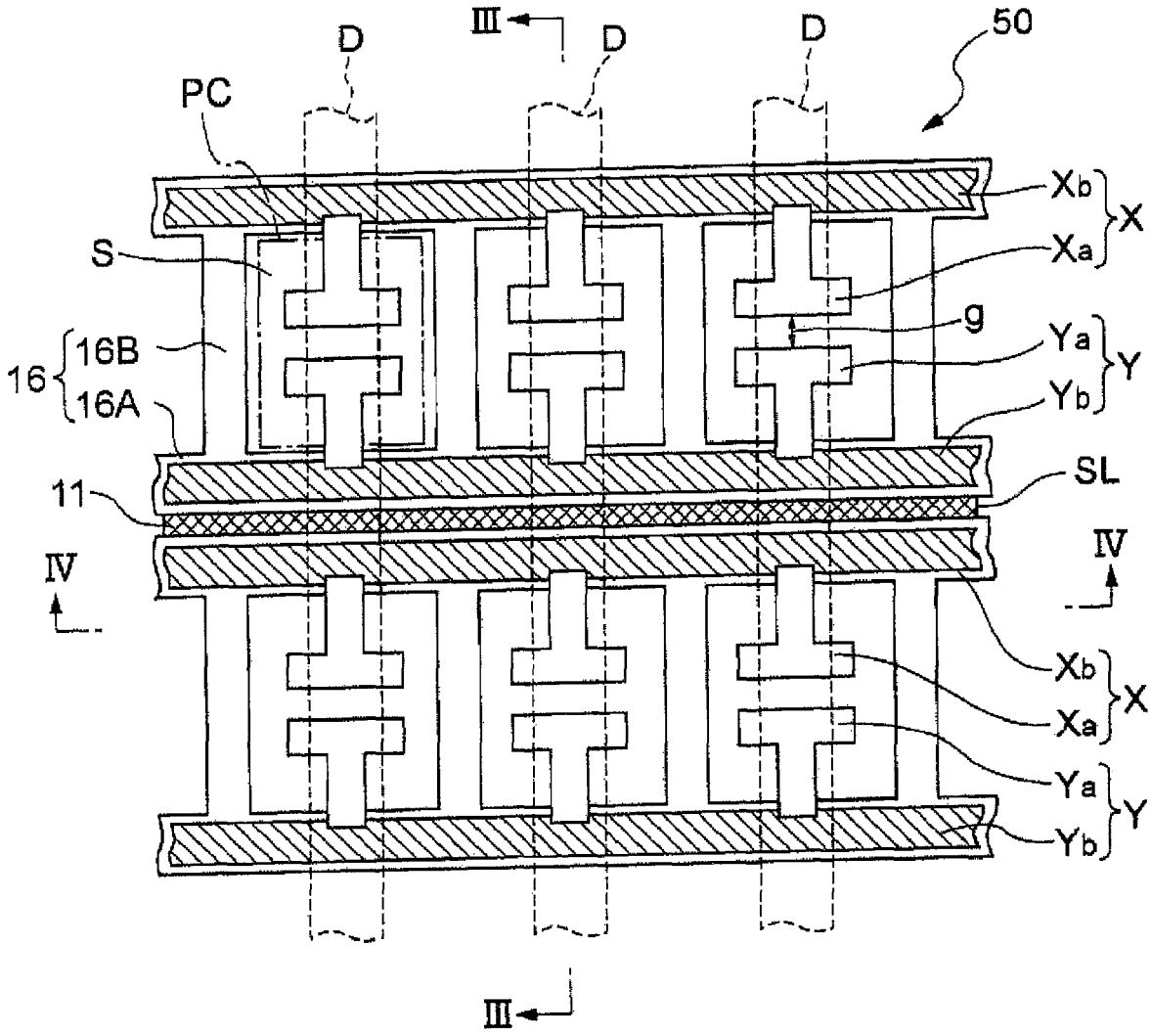
FIG. 2 is a front view schematically showing the internal structure of a PDP 50 as seen from the side of a display surface.
Figure 3:
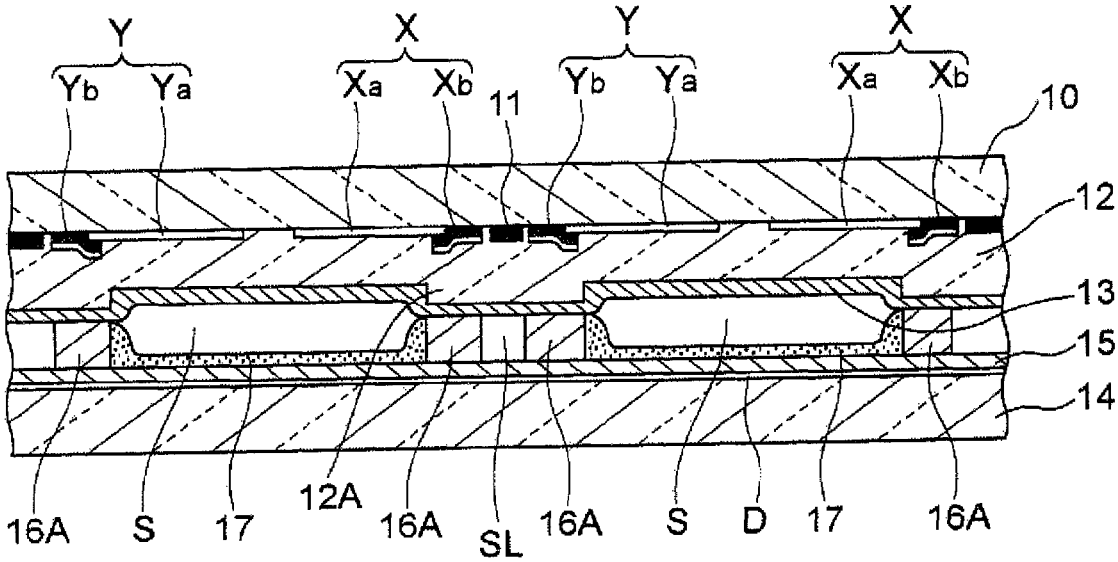
FIG. 3 is a view showing a section taken along line III-III indicated in FIG. 2.
Figure 4:
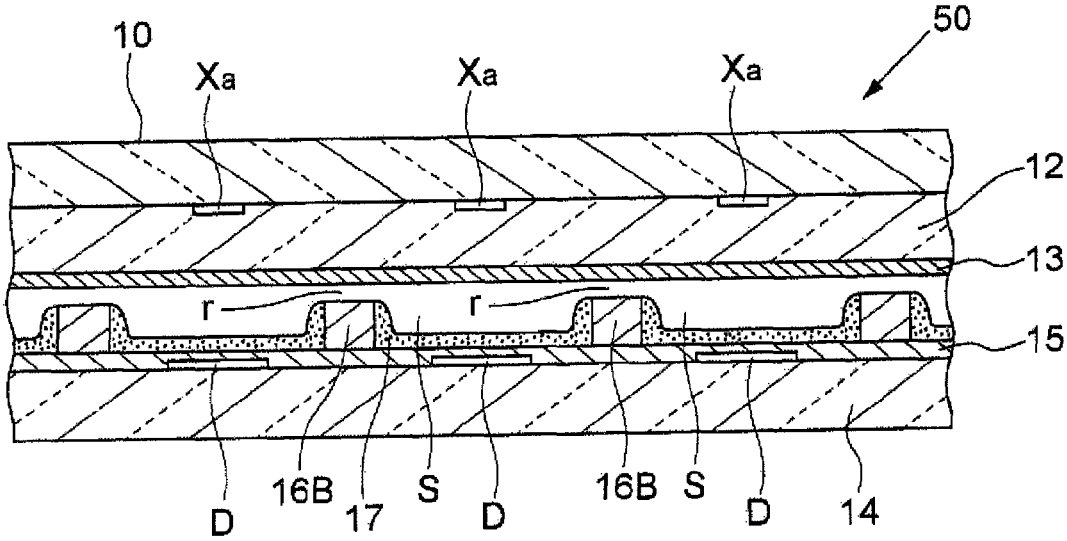
FIG. 4 is a view showing a section taken along line IV-IV indicated in FIG. 2.

FIG. 2 is a front view schematically showing the internal structure of the PDP 50 as seen from the side of a display surface. In FIG. 2, the intersection parts between three of the column electrodes D adjoining one another and two of the display lines adjoining each other are extracted and displayed. Besides, FIG. 3 is a view showing the section of the PDP 50 taken along line III-III in FIG. 2, while FIG. 4 is a view showing the section of the PDP 50 taken along line IV-IV in FIG. 2.

As shown in FIG. 2, each row electrode X is configured of a bus electrode Xb which is extended in the horizontal direction of the two-dimensional display screen, and T-shaped transparent electrodes Xa which are respectively disposed in contact with positions corresponding to the individual pixel cells PC on such a bus electrode Xb. Each row electrode Y is configured of a bus electrode Yb which is extended in the horizontal direction of the two-dimensional display screen, and T-shaped transparent electrodes Ya which are respectively disposed in contact with positions corresponding to the individual pixel cells PC on such a bus electrode Yb. The transparent electrodes Xa and Ya are formed of transparent conductive films of, for example, ITO, and the bus electrodes Xb and Yb are formed of, for example, metal films. As shown in FIG. 3, the row electrodes X each consisting of the transparent electrodes Xa and the bus electrode Xb, and the row electrodes Y each consisting of the transparent electrodes Ya and the bus electrode Yb are formed on the rear surface side of a front transparent substrate 10 whose front surface side serves as the display surface of the PDP 50. The transparent electrodes Xa and Ya in each row electrode pair (X, Y) are extended toward the mating row electrodes to form the pair, and the top sides of the wide portions of the transparent electrodes Xa and Ya oppose to each other through a discharge gap g1 of predetermined width. Besides, on the rear surface side of the front transparent substrate 10, a light absorption layer (light interception layer) 11 in black or a dark color, extending in the horizontal direction of the two-dimensional display screen, is formed between the certain row electrode pair (X, Y) and the row electrode pair (X, Y) adjacent to the certain row electrode pair. Further, on the rear surface side of the front transparent substrate 10, a dielectric layer 12 is formed so as to cover the row electrode pairs (X, Y). As shown in FIG. 3, on the rear surface side of the dielectric layer 12 (on the surface of the dielectric layer 12 opposite to the surface thereof with which the row electrode pairs contact), a raised dielectric layer 12A is formed at a part corresponding to a region where the certain light absorption layer 11 and the bus electrodes Xb and Yb adjacent to the certain light absorption layer 11 are formed.

A magnesium oxide layer 13 is formed on the surface of the dielectric layer 12 including the raised dielectric layers 12A. Incidentally, the magnesium oxide layer 13 contains magnesium oxide crystals being a secondary electron emission material which presents CL (cathode-luminescence) emission having a wavelength peak within 200-300 nm, especially within 230-250 nm, when excited by irradiation with an electron beam (hereinbelow, the crystals shall be termed the "CL emission MgO crystals").

The CL emission MgO crystals are obtained in such a way that magnesium vapor generated by heating magnesium is subjected to vapor-phase oxidation as will be stated later. These CL emission MgO crystals have, for example, a multiple crystal structure in which cubic crystals are fitted into one another, or a cubic single-crystal structure. The mean grain diameter of the CL emission MgO crystals is at least 2000 angstroms (as a measured result based on the BET method).

In a case where the vapor-phase magnesium oxide single crystals of large grain diameters, having the mean grain diameter of at least 2000 angstroms are to be formed, a heating temperature in the case of generating the magnesium vapor needs to be heightened. Therefore, flames in which the magnesium and oxygen react become long, and the difference between the temperatures of the flames and the surroundings becomes large. Thus, as the vapor-phase magnesium oxide single crystals have larger grain diameters, more crystals whose energy levels correspond to the peak wavelength of the CL emission as mentioned above (for example, near 235 nm or within 230-250 nm) are formed.

Besides, the vapor-phase magnesium oxide single crystals which are produced in such a way that the quantity of the magnesium to be vaporized per unit time is increased more than in a general vapor-phase oxidation method so as to more enlarge the reaction region between the magnesium and the oxygen and to react the magnesium with more oxygen, come to have the energy levels which correspond to the peak wavelength of the CL emission as mentioned above. Such CL emission MgO crystals are stuck onto the surface of the dielectric layer 12 by spraying, electrostatic coating, or the like, whereby the magnesium oxide layer 13 is formed. Incidentally, the magnesium oxide layer 13 may well be formed in such a way that a thin-film magnesium oxide layer is formed on the surface of the dielectric layer 12 by evaporation or sputtering, and that the CL emission MgO crystals are stuck thereonto.

On the other hand, on a rear substrate 14 which is arranged in parallel with the front transparent substrate 10, the respective column electrodes D are formed extending in a direction orthogonal to the row electrode pairs (X, Y), at positions which oppose to the transparent electrodes Xa and Ya in the respective row electrode pairs (X, Y). A column electrode protective layer 15 in white as covers the column electrodes D, are further formed on the rear substrate 14. A partition wall 16 is formed on the column electrode protective layer 15. The partition wall 16 is formed in a ladder shape, out of lateral walls 16A which are respectively extended in the lateral direction of the two-dimensional display screen at positions corresponding to the bus electrodes Xb and Yb of the row electrode pairs (X, Y), and vertical walls 16B which are respectively extended in the vertical direction of the two-dimensional display screen at the intermediate positions between the row electrodes D adjacent to each other. Further, the ladder-shaped partition wall 16 as shown in FIG. 2 is formed every display line of the PDP 50. A spacing SL as shown in FIG. 2 exists between the partition walls 16 adjacent to each other. Besides, discharge spaces S which are independent of one another, and the pixel cells PC which include the transparent electrodes Xa and Ya are partitioned by the ladder-shaped partition walls 16. The discharge spaces S are filled with a discharge gas which contains xenon gas. A fluorophor layer 17 is formed on the side surface of the lateral wall 16A, the side surface of the vertical wall 16B and the surface of the column electrode protective layer 15 within each pixel cell PC, so as to cover all the surfaces. Actually, the fluorophor layers 17 consist of three sorts of fluorophors; a fluorophor presenting red fluorescence, a fluorophor presenting green fluorescence, and a fluorophor presenting blue fluorescence.

Here, the interspace between the discharge space S of each pixel cell PC and the spacing SL is closed in such a way that, as shown in FIG. 3, the magnesium oxide layer 13 is held in abutment on the lateral wall 16A. Besides, as shown in FIG. 4, the vertical wall 16B is not held in abutment on the magnesium oxide layer 13, and hence, a clearance r exists therebetween. That is, the discharge spaces S of the respective pixel cells PC adjacent to each other in the lateral direction of the two-dimensional display screen communicate with each other through the clearance r.

In addition, the discharge spaces S between the front glass substrate 10 and the rear glass substrate 14 are partitioned into squares in the respective parts where the transparent electrodes Xa and Ya paired in the row electrode pairs (X, Y), by the ladder-shaped partition wall 16, whereby discharge cells C are respectively formed. The side surfaces of the lateral wall 16A and vertical wall 16B of the partition wall 16 and the surface of the column electrode protective layer 15 as confront the discharge cell C are formed with the fluorophor layer 17 so that all the five surfaces may be covered therewith. The fluorophor layers 17 are arrayed so that the three primary colors of red, green and blue may be successively presented in the row direction for the respective discharge cells C.

Figure 5:
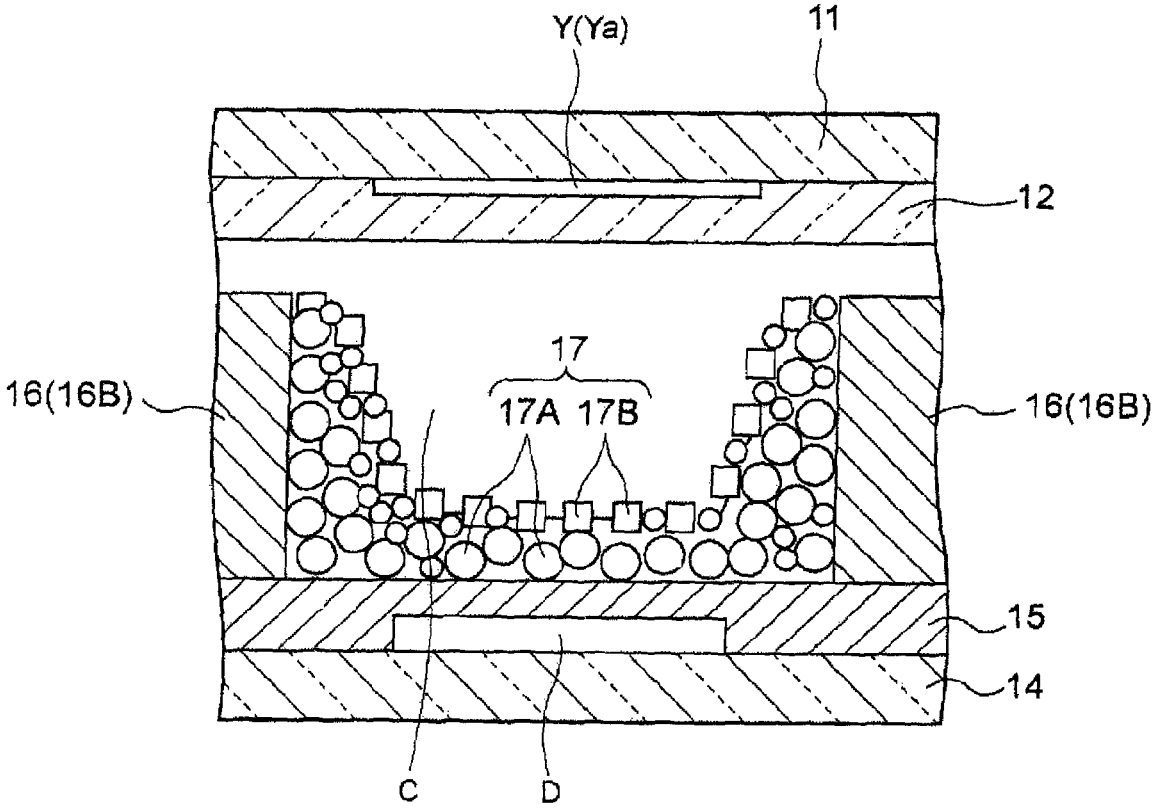
FIG. 5 is a sectional view showing the configuration of a fluorophor layer.

FIG. 5 is a sectional view showing one discharge cell C on enlarged scale in order to illustrate the configuration of the fluorophor layer 17.

Referring to FIG. 5, the fluorophor layer 17 is formed in a state where granular fluorescent materials 17A of red, green and blue, and MgO (magnesium oxide) crystals 17B being a secondary electron emission material are mixed, and where the MgO crystals 17B are arranged at the surface of the fluorophor layer 17, namely, at positions exposed to the discharge space, so as to contact with the discharge gas.

In FIG. 5, the state where the MgO crystals 17B are arranged at only the surface of the fluorophor layer 17 is shown. However, insofar as the MgO crystals 17B are exposed to the discharge space, the MgO crystals 17B may well be mixed in the fluorophor layer 17.

Besides, the MgO crystals 17B may be in any form as long as they have the characteristic of emitting secondary electrons. These MgO crystals 17B, however, should preferably contain CL emission MgO crystals which have the characteristic of presenting CL emission with a peak within a wavelength region of 200-300 nm, when excited by an electron beam, and which are similar to the CL emission MgO crystals forming the magnesium oxide layer 13 stated before.

Figure 6:
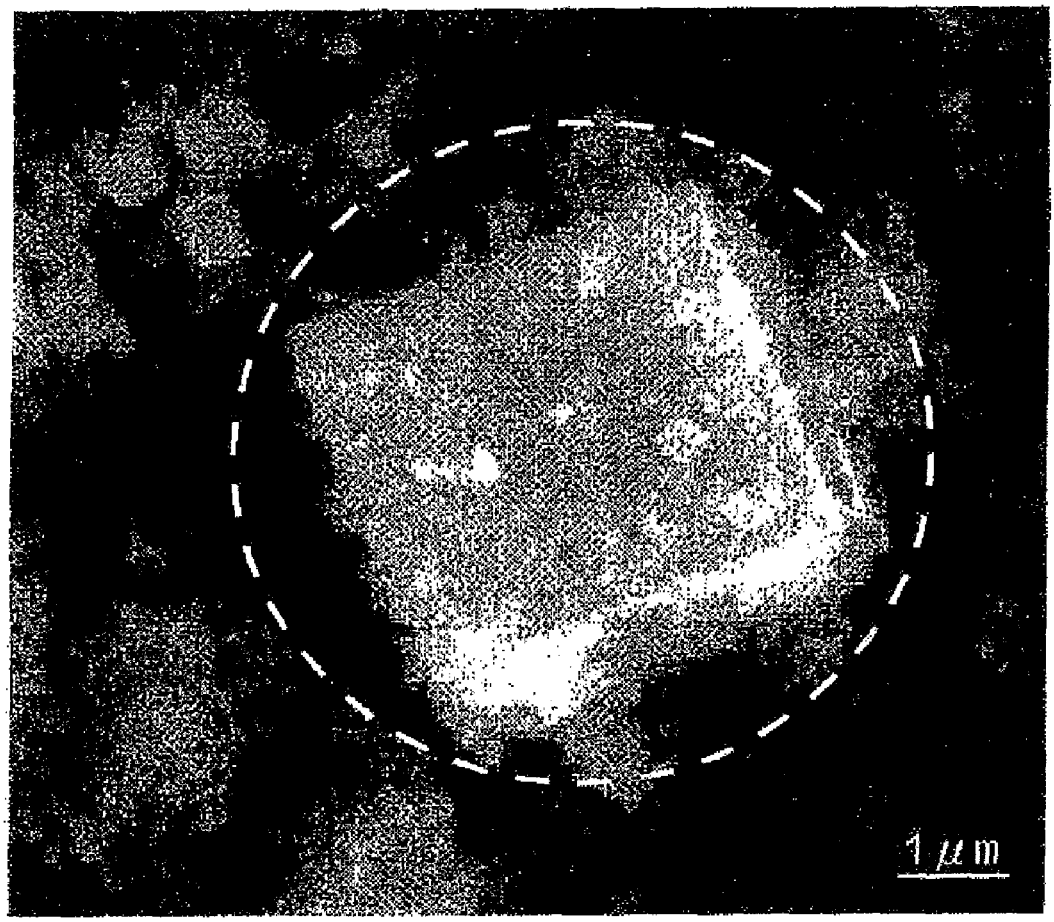
FIG. 6 is a diagram showing a SEM photographic image of magnesium oxide single crystals which have a cubic single-crystal structure.
Figure 7:
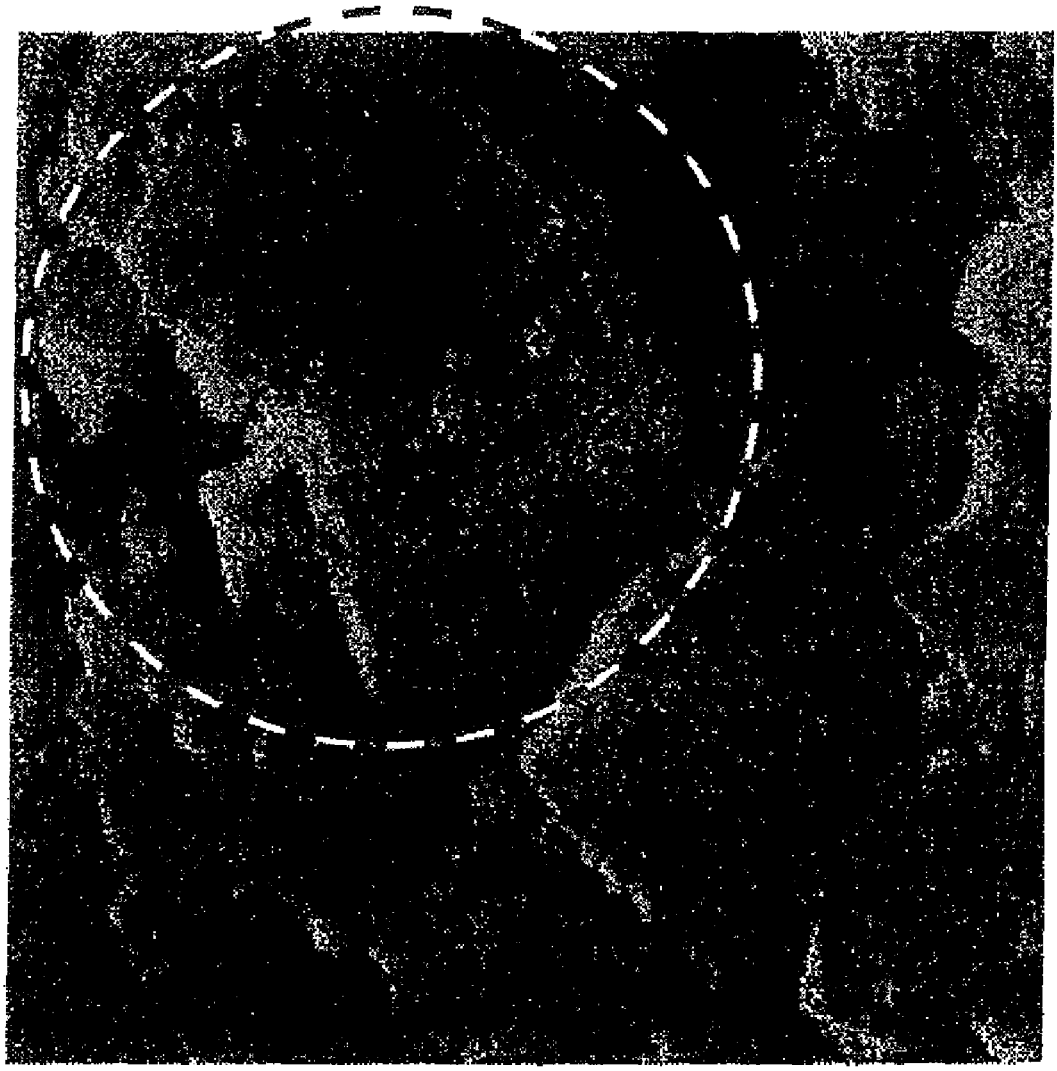
FIG. 7 is a diagram showing a SEM photographic image of magnesium oxide single crystals which have a cubic multiple crystal structure.

The CL emission MgO crystals contain the single crystals of magnesium obtained, for example, in such a way that magnesium vapor generated by heating the magnesium is subjected to vapor-phase oxidation (hereinbelow, the single crystals of the magnesium shall be termed the "vapor-phase magnesium oxide single crystals"). The vapor-phase magnesium oxide single crystals include, for example, magnesium oxide single crystals having a cubic single-crystal structure, as shown by a SEM photographic image in FIG. 6, and magnesium oxide single crystals having a structure in which cubic crystals are fitted into one another (that is, a cubic multiple crystal structure), as shown by a SEM photographic image in FIG. 7.

As will be described later, the vapor-phase magnesium oxide single crystals contribute to the betterments of discharge characteristics, such as the decrease of the discharge delay of the PDP.

In addition, when compared with magnesium oxide produced by another method, the vapor-phase magnesium oxide single crystals have the features that a high purity is attained, that fine grains are obtained, and that the aggregation of the grains is little.

In this embodiment, the vapor-phase magnesium oxide single crystals whose mean grain diameter measured by the BET method is at least 2000 angstroms are employed. The vapor-phase magnesium oxide single crystals of the large grain diameters exhibit characteristics in which, in addition to CL emission having a peak within a wavelength region of 300-400 nm, CL emission having a peak within a wavelength region of 200-300 nm (especially, near 235 nm or within 230-250 nm) is excited.

Figure 10:
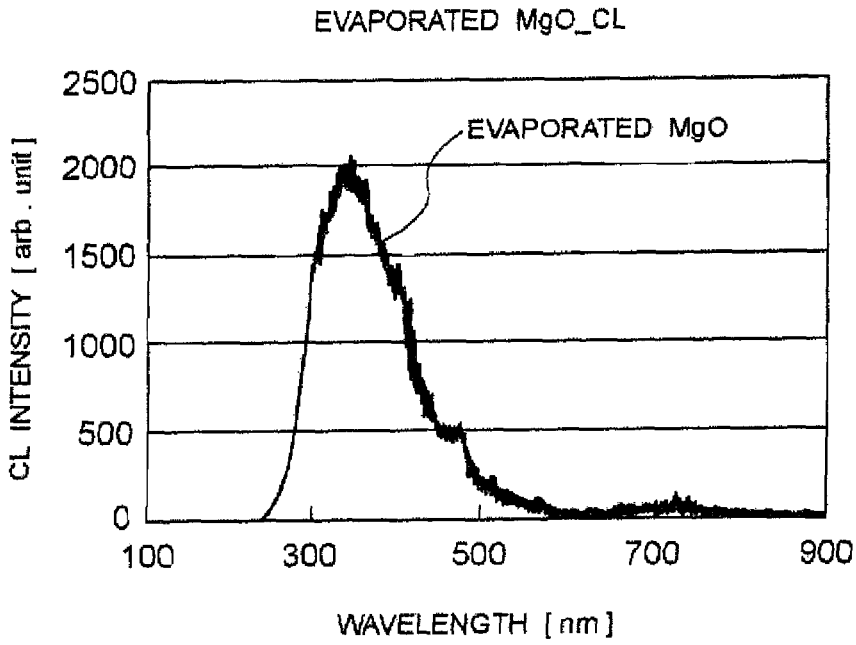
FIG. 10 is a graph showing the state of wavelengths of CL emission from a magnesium oxide layer produced by evaporation.

As shown in FIG. 10, the CL emission having the peak within the wavelength region of 200-300 nm (especially, near 235 nm or within 230-250 nm) is not excited in ordinary evaporated MgO, in which only the CL emission having the peak within 300-400 nm is excited.

Figure 8:
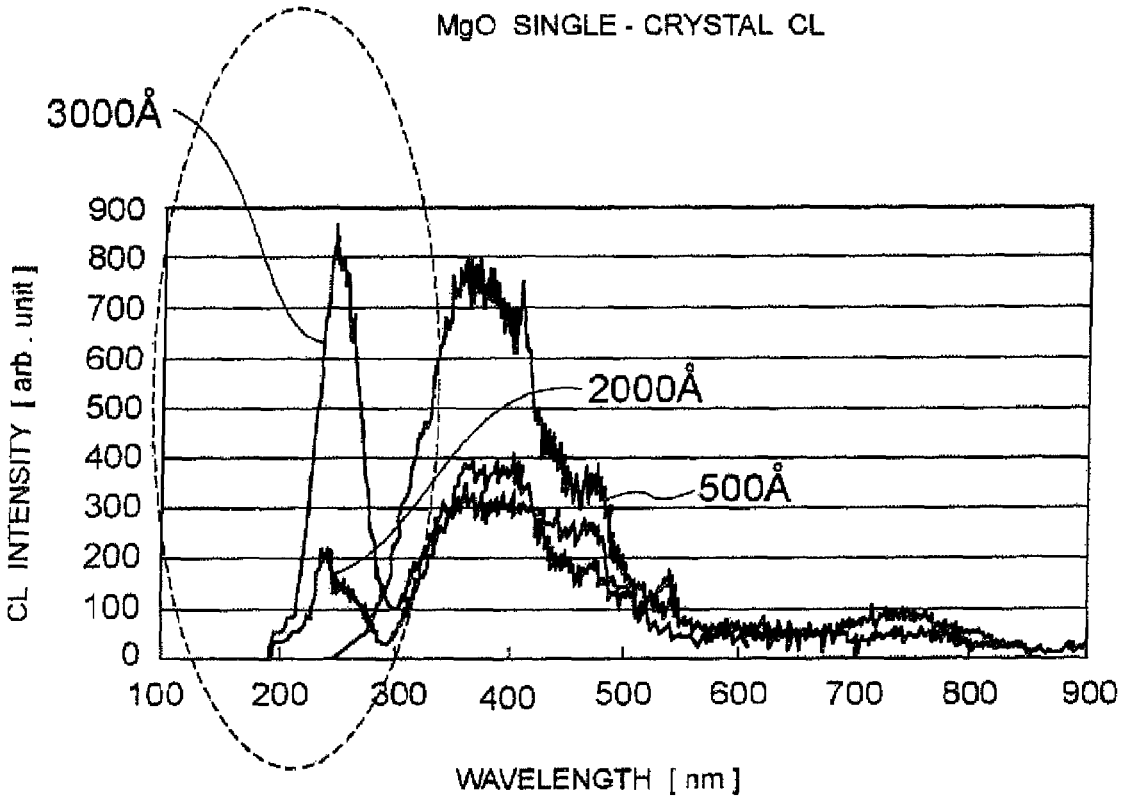
FIG. 8 is a graph showing the relationship between the grain diameter of the magnesium oxide single crystal and the wavelength as well as the intensity of CL emission.
Figure 9:
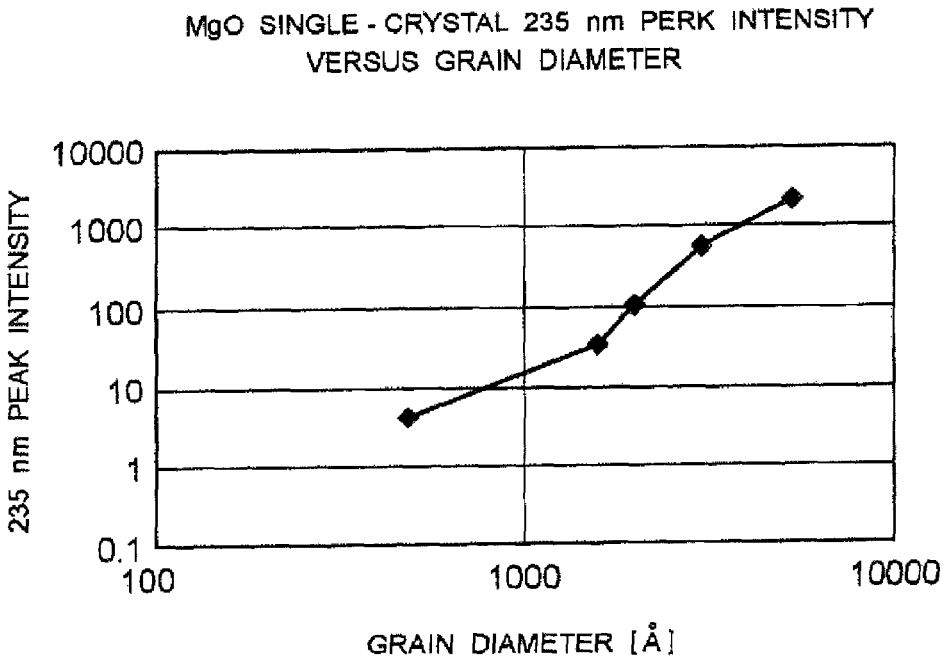
FIG. 9 is a graph showing the relationship between the grain diameter of the magnesium oxide single crystal and the peak intensity of the CL emission at 235 nm.

Besides, as seen in FIGS. 8 and 9, regarding the CL emission having the peak within the wavelength region of 200-300 nm (especially, at 235 nm), the peak intensity thereof enlarges more as the grain diameters of the vapor-phase magnesium oxide single crystals become larger.

Incidentally, the grain diameter ($D_{BET}$) of the vapor-phase magnesium oxide single crystal is calculated in such a way that a BET specific surface area (s) is measured by the nitrogen adsorption method, and that the value of the specific surface area is processed in conformity with the following formula:

$$D_{BET}=A/s\times\rho$$

A: shape coefficient (A=6)

ρ: true density of magnesium

Figure 11:
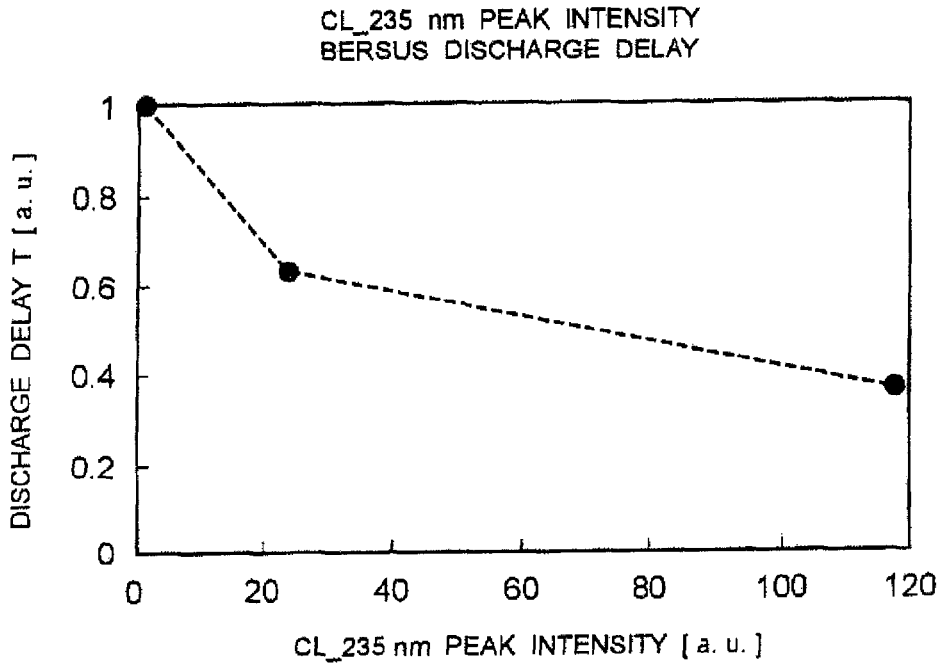
FIG. 11 is a graph showing the relationship between the peak intensity of the CL emission at 235 nm from the magnesium oxide single crystal and a discharge delay.

FIG. 11 is a graph showing the correlation between the CL emission intensity exhibited by the vapor-phase magnesium oxide single crystal and the discharge delay of the PDP.

It is seen from FIG. 11 that, since the vapor-phase magnesium oxide single crystals have the CL emission characteristic at 235 nm, the delay of the discharge generated within the discharge cell is shortened by forming the magnesium oxide layer which contains the vapor-phase magnesium oxide single crystals, within the discharge cell of the PDP, and further, that the discharge delay becomes shorter as the CL emission intensity at 235 nm increases.

It is understood from the foregoing that, when the vapor-phase magnesium oxide single crystals having the mean grain diameter of at least 2000 angstroms as the measured value based on the BET method are used for the part confronting the discharge cell of the PDP, they can contribute to the betterments of the discharge characteristics such as the discharge probability and discharge delay of the PDP (to the decrease of the discharge delay and the enhancement of the discharge probability).

Figure 12:
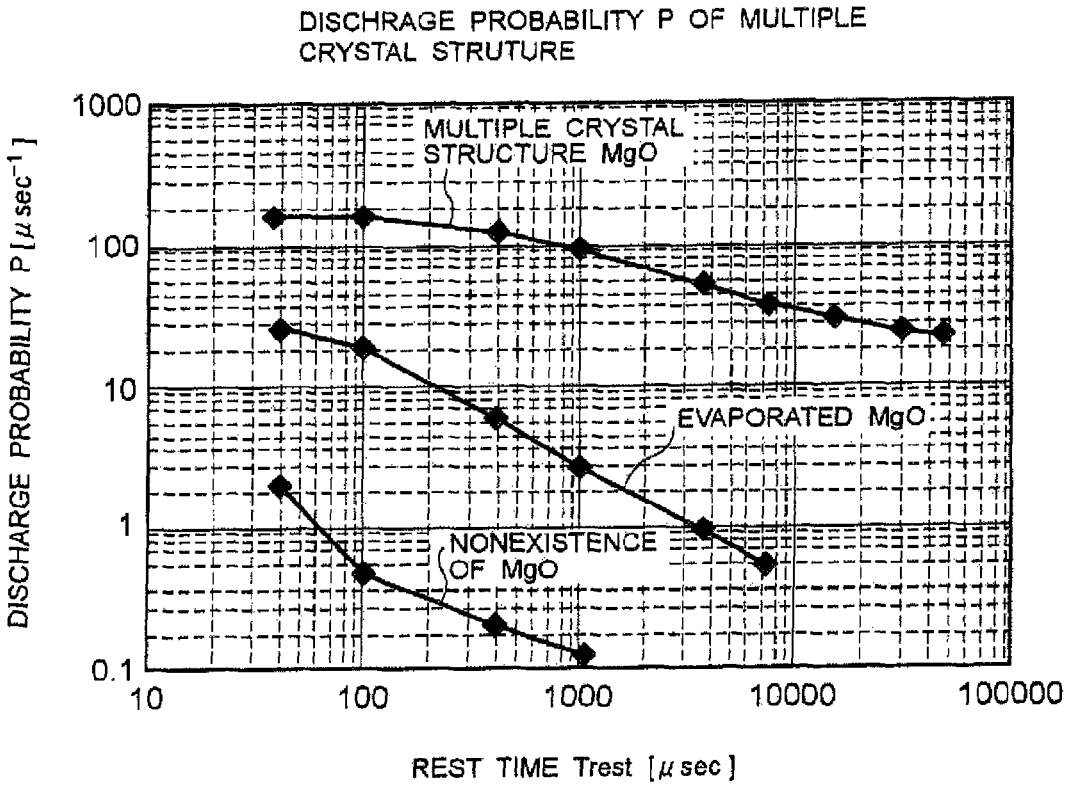
FIG. 12 is a graph showing the relationship between the magnesium oxide single crystals of the multiple crystal structure and a discharge probability.

FIG. 12 is a graph in which the discharge probabilities of discharges (for example, address discharges) that proceed through the magnesium oxide layers are compared. More specifically, the magnesium oxide layers arranged so as to confront the discharge cells of the PDPs were formed by applying a paste which contained the vapor-phase magnesium oxide single crystals of mean grain diameters of 2000-3000 angstroms, and by performing the prior-art evaporation method. Also, a case where such a magnesium oxide layer was not formed is illustrated for the sake of comparison. Besides, FIG. 13 is a table showing the respective discharge probabilities in the cases where the rest times of the discharges are 1000 sec in FIG. 12.

Figures 13, 14:
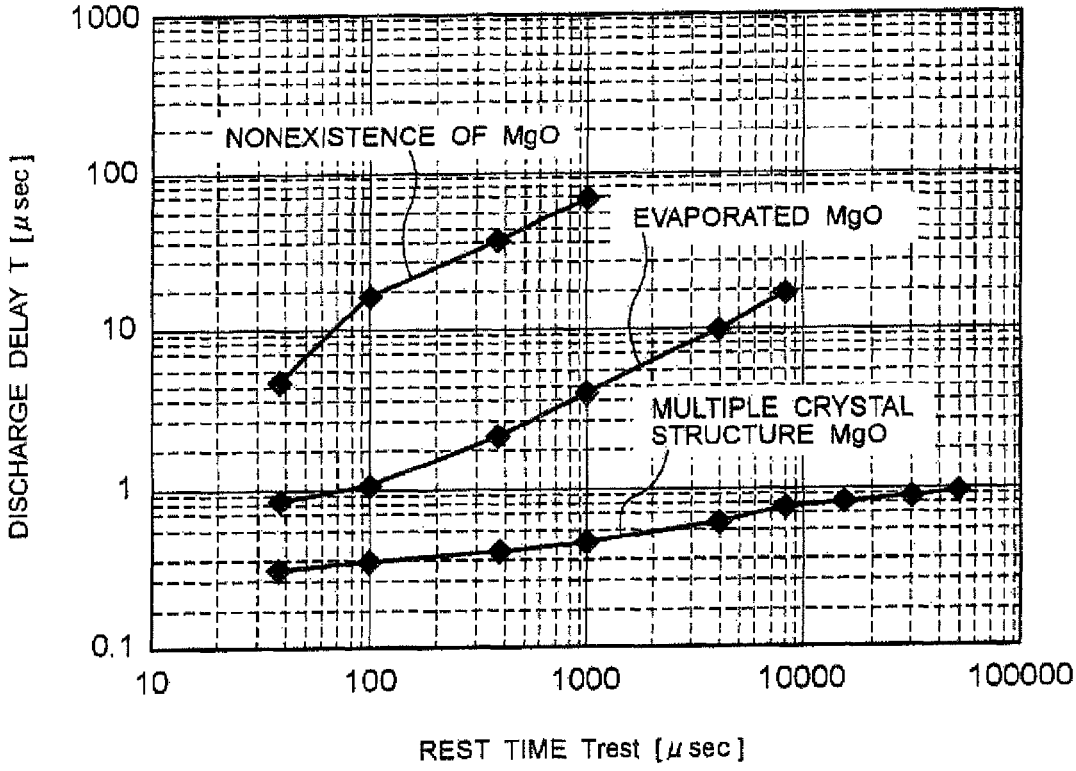
FIG. 13 is a table showing the relationship between the magnesium oxide single crystals of the multiple crystal structure and the discharge probability.
FIG. 14 is a graph showing the relationship between the magnesium oxide single crystals of the multiple crystal structure and a discharge delay.

Further, FIG. 14 is a graph which makes the comparisons of respective discharge delay times in the similar cases where the magnesium oxide layer arranged so as to confront the discharge cell of the PDP was formed by applying the paste that contained the vapor-phase magnesium oxide single crystals of the mean grain diameters of 2000-3000 angstroms, where it was formed by the prior-art evaporation method, and where it was not formed. Besides, FIG. 15 is a table showing the respective discharge delay times in the cases where the rest times of the discharges are 1000 sec in FIG. 14.

Incidentally, FIGS. 12 through 15 illustrate cases where the vapor-phase magnesium oxide single crystals of the multiple crystal structure were contained in the magnesium oxide layers.

It is seen from FIGS. 12 through 15 that the vapor-phase magnesium oxide single crystals arranged at the part confronting the discharge cell of the PDP can greatly contribute to the betterments of the discharge characteristics, such as the betterments of the discharge probability and discharge delay of the PDP and the decrease of the rest-time dependency of the discharge delay. FIG. 16 is a graph showing the relationships between the grain diameters of the vapor-phase magnesium oxide single crystals arranged at the part confronting the discharge cell and the discharge probability, in the PDP.

Figures 15, 16:
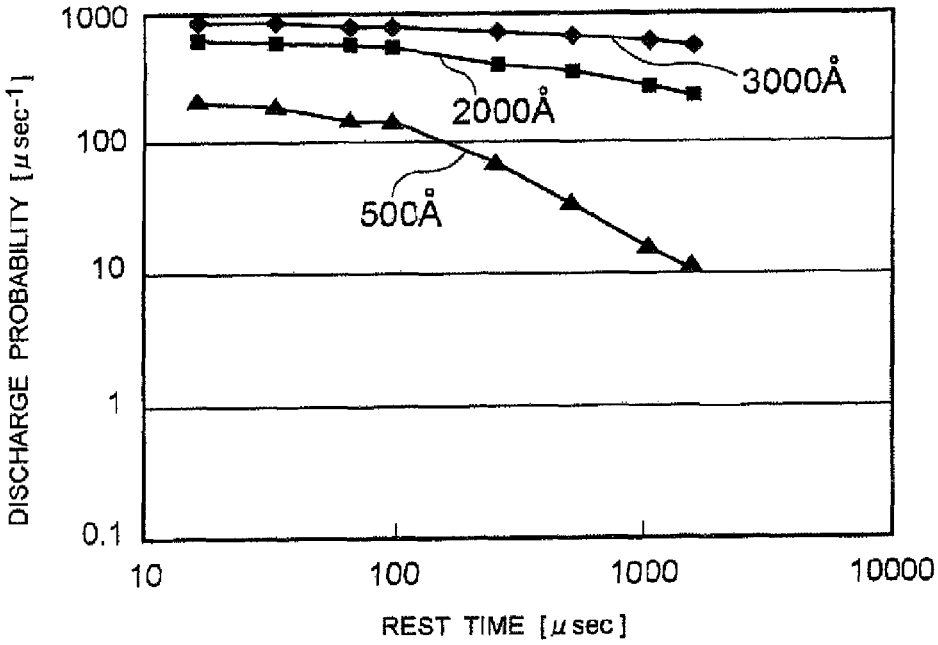
FIG. 15 is a table showing the relationship between the magnesium oxide single crystals of the multiple crystal structure and the discharge delay.
FIG. 16 is a graph showing the relationships between the grain diameter of the magnesium oxide single crystals and the discharge probability.

It is seen from FIG. 16 that the PDP discharge probability is higher as the grain diameter of the vapor-phase magnesium oxide single crystals is larger, and that the discharge probability is sharply enhanced by the vapor-phase magnesium oxide single crystals of the grain diameter at which the CL emission having the peak at 235 nm as stated before is excited (the grain diameters of 2000 angstroms and 3000 angstroms in the illustrated examples).

The reason why, as described above, the vapor-phase magnesium oxide single crystals which present the CL emission having the peak within the wavelength region of 200-300 nm (especially, near 235 nm or within 230-250 nm) contribute to the betterments of the discharge characteristics of the PDP, is conjectured to be the fact that the vapor-phase magnesium oxide single crystals have energy levels corresponding to the peak wavelength, that electrons can be trapped for a long time (several msec or longer) by the energy levels, and that the electrons are taken out by an electric field, whereby initial electrons necessary for discharge initiation are obtained.

In addition, the reason why the betterment effects of the discharge characteristics by the vapor-phase magnesium oxide single crystals becomes greater with the intensity of the CL emission having the peak within the wavelength region of 200-300 nm (especially, near 235 nm or within 230-250 nm), is that the correlation (refer to FIG. 9) exists between the CL emission intensity and the grain diameter of the vapor-phase magnesium oxide single crystals as described before.

More specifically, in the case where the vapor-phase magnesium oxide single crystals of large grain diameters are to be formed, the heating temperature at the step of generating the magnesium vapor needs to be heightened. Therefore, the flames in which the magnesium and the oxygen react become long, and the difference between the temperatures of the flames and the surroundings become large, whereby the energy levels corresponding to the peak wavelength of the CL emission as stated above (for example, near 235 nm or within 230-250 nm) are formed in larger numbers in the vapor-phase magnesium oxide single crystals of larger grain diameters.

Besides, the vapor-phase magnesium oxide single crystals produced by the method in which the vaporization quantity of the Mg per unit time is increased more than in the general vapor-phase oxidation method, thereby to more enlarge the reaction region between the Mg and the $O_2$ and to react the Mg with more $O_2$, are formed with the energy levels corresponding to the peak wavelength of the CL emission as stated before.

Besides, the vapor-phase magnesium oxide single crystals of the cubic multiple crystal structure contain a large number of crystal face defects. The existence of the energy levels of the face defects is conjectured to contribute to the betterment of the discharge probability. Next, a drive method for the PDP shown in FIGS. 1 through 4 will be described.

The PDP is driven by the subfield method. Each of a plurality of subfields into which the display period of one field is divided is configured of a reset discharge period in which a reset discharge for simultaneously discharging all the discharge cells is performed, an address discharge period in which an address discharge for selecting the discharge cell C to emit light is performed, and a sustain discharge period in which a sustain discharge for emitting the light for image formation is performed. Besides, in the PDP, the reset discharge which is performed in the first reset discharge period of each subfield is carried out by opposed discharges between row electrodes Y and column electrodes D.

Figure 17:
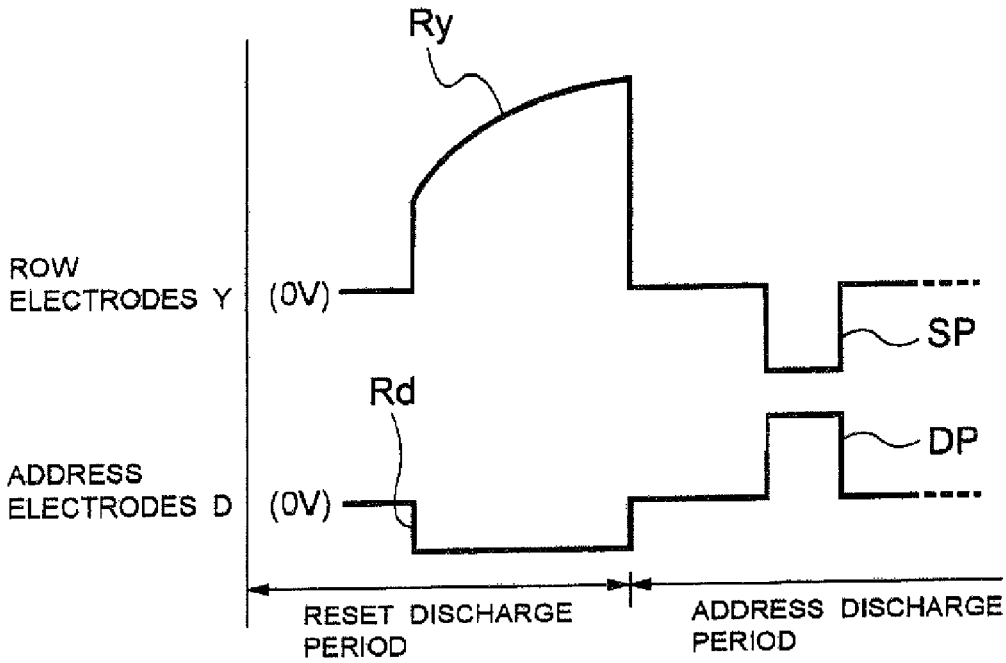
FIG. 17 is a pulse waveform diagram showing the shapes of voltages which are respectively impressed on row electrodes and column electrodes in the embodiment of the plasma display device.

FIG. 17 is a pulse waveform diagram showing voltage pulses which are respectively impressed on the row electrodes Y and the column electrodes D at the time of the reset discharge.

Referring to FIG. 17, a row electrode reset pulse Ry of positive polarity, whose rise is gentle and whose time constant is large, unlike a rectangular pulse, is impressed on the row electrodes Y, and a column electrode reset pulse Rd of negative polarity is impressed on the column electrodes D simultaneously with the impression of the row electrode reset pulse Ry.

Owing to the impressions of the column electrode reset pulse Rd of the negative polarity and the row electrode reset pulse Ry of the positive polarity, discharges in a direction from the row electrodes Y to the address electrodes D (electrons flow in a direction from the column electrodes D to the row electrodes Y) are generated between the column electrodes D serving as cathodes and the row electrodes Y serving as anodes (hereinbelow, the discharges which are generated with the column electrodes D set as the cathodes and the row electrodes Y set as the anodes shall be generally termed the "cathode column electrode discharge"). Incidentally, "SP" in FIG. 17 denotes a scan pulse which is impressed on the row electrodes Y in the address discharge period, and "DP" denotes a data pulse which is selectively impressed on the row electrodes D similarly in the address discharge period. The address discharge is generated between the row electrode Y on which the scan pulse SP has been impressed and the column electrode D on which the data pulse DP has been impressed.

In the PDP, the reset discharge is performed by the cathode column electrode discharge between the row electrodes Y and the column electrodes D which oppose with the discharge cells C interposed therebetween. Thus, cations within the discharge cells C as are produced from the discharge gas by the discharges proceed onto the sides of the column electrodes D being the cathodes, at the time of the reset discharge, and they collide against the MgO crystals 17B being the secondary electron emission material as are mixed within the fluorophor layer 17 located on the sides of the column electrodes D, whereby secondary electrons are emitted from the MgO crystals 17B into the discharge cells C.

In this way, the address discharge which is performed in the address discharge period succeeding to the reset discharge period becomes liable to occur owing to the secondary electrons existent within the discharge cells C, and the discharge initiation voltage of the address discharge can be lowered.

The MgO crystals 17B are exposed on the surface of the fluorophor layer 17, thereby to efficiently collide against the cations and to emit the secondary electrons into the discharge cells C more efficiently, so that the discharge initiation voltage of the succeeding address discharge can be lowered.

Further, in general, in a PDP, also reset discharge incurs light emissions. The light emissions ascribable to the reset discharge have no relation to the gradation display of an image. Therefore, when the light emissions ascribable to the reset discharge are recognized at a panel face in case of displaying an image of intensity "0", or the like, the dark contrast of the image lowers. In contrast, in the PDP of the embodiment, the reset discharge is performed by the opposed discharges between the row electrodes Y and the column electrodes D, and the opposed discharges occur at the central parts of the discharge cells C spaced from the panel face (the surface of the front glass substrate 10). Accordingly, when the PDP of the embodiment is compared with the case where the reset discharge is performed by the surface discharges between row electrodes at positions near the panel face, the light emissions ascribable to the reset discharge as are recognized at the panel face become less, so that the dark contrast of the image to be displayed can be enhanced.

Figure 18:
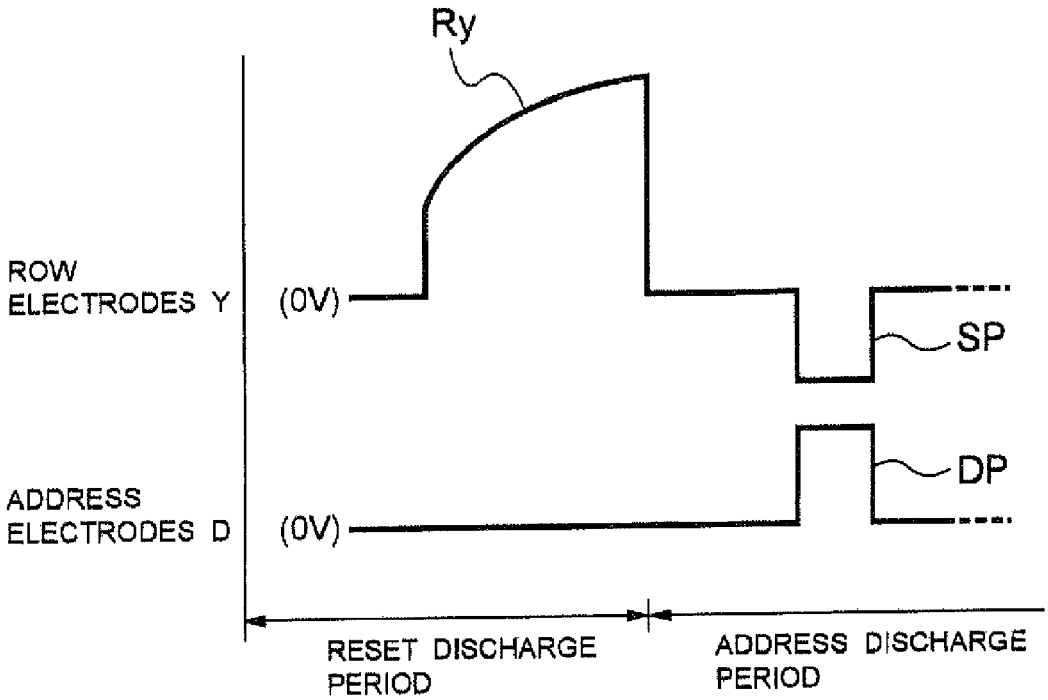
FIG. 18 is a pulse waveform diagram showing the voltage pulses in another example.

In the above, the example (FIG. 17) in which the negative-polarity column electrode reset pulse Rd is impressed on the row electrodes D has been described. However, in order to generate the reset discharge between the row electrodes Y and the column electrodes D, when the positive-polarity row electrode reset pulse Ry is impressed on the row electrodes Y, the column electrodes D may be set as cathode sides relatively to the row electrodes Y serving as the anodes. By way of example, the column electrodes D may well be set at a ground (GND) potential as shown in FIG. 18. Besides, a voltage pulse of positive polarity which is lower in potential than the row electrode reset pulse Ry to be impressed on the row electrodes Y and which generates discharges between the row electrodes Y and the column electrodes D may well be impressed on the column electrodes D.

In the ensuing description, the cathode column electrode discharge shall cover all the cases where the column electrodes D have its potential set as the cathode sides relatively to the row electrodes Y on the occasion of the reset discharge, such as the case where the column electrodes D are set at the ground (GND) potential, and the case where the positive-polarity voltage pulse which is lower in potential than the row electrode reset pulse Ry is impressed on the column electrodes D.

Figure 19:
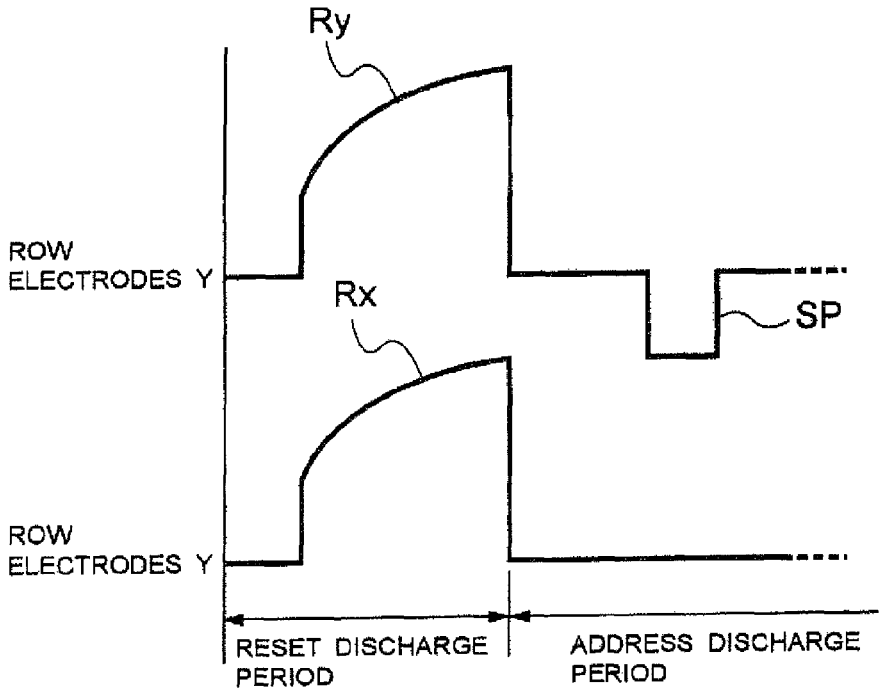
FIG. 19 is a pulse waveform diagram showing the voltage pulses in still another example.

Besides, on the occasion of the reset discharge, the row electrodes X which form the row electrode pairs with the row electrodes Y may well hold the ground (GND) potential during the reset discharge period. As shown in FIG. 19, however, it is also allowed to impress a voltage pulse Rx which is identical in polarity to the row electrode reset pulse Ry to be impressed on the row electrodes Y and which has a potential that does not give rise to a potential difference generating discharges between the row electrodes X and the row electrodes Y.

Thus, while the reset discharge proceeds, the potential difference which generates the discharges between the row electrodes X and Y forming the row electrode pairs is prevented from appearing, and the reset discharge can be reliably performed as only the opposed discharges between the row electrodes Y and the column electrodes D. Accordingly, the dark contrast of the display image can be further enhanced.

In the PDP, in a case where the MgO crystals 17B mixed in the fluorophor layer 17 contain the CL emission MgO crystals of the characteristic which presents the CL emission having the peak within the wavelength region of 200-300 nm, when excited by the electron beam, as stated before, the discharge delay time is shortened more by the characteristics of the CL emission MgO crystals as have been explained in conjunction with FIGS. 8 through 16, than in a case where the fluorophor layer 17 consists only of ordinary MgO crystals which do not have the characteristic presenting the CL emission (hereinbelow, the MgO crystals which do not have the CL emission characteristic shall be termed the "ordinary MgO crystals"). Further, the voltage pulse whose time constant is large and whose rise is gentle is impressed on the row electrodes Y, whereby the discharge strength of the reset discharge forming the cause of the lowering of the dark contrast is decreased, and the dark contrast of the PDP is sharply enhanced.

Further, with the PDP, in the case where the CL emission MgO crystals are contained in the MgO crystals 17B and are mixed in the fluorophor layer 17, initial electrons are emitted from the CL emission MgO crystals within the fluorophor layer 17 into the discharge cells C by the reset discharge, and the discharge delay of the reset discharge is more shortened by the initial electrons. Also, the priming effect is continued for long, so that the address discharge which is generated subsequently to the reset discharge is further quickened.

In addition, with the PDP, as shown in FIG. 5, the CL emission MgO crystals mixed in the fluorophor layer 17 are arranged at the positions of the surface of the fluorophor layer 17 exposed to the interior of the discharge cells C, whereby the initial electrons can be emitted into the discharge cells C efficiently without being hampered by fluorophor grains contained in the fluorophor layer 17. Therefore, the discharge initiation voltage of the address discharge can be lowered more.

Figure 20:
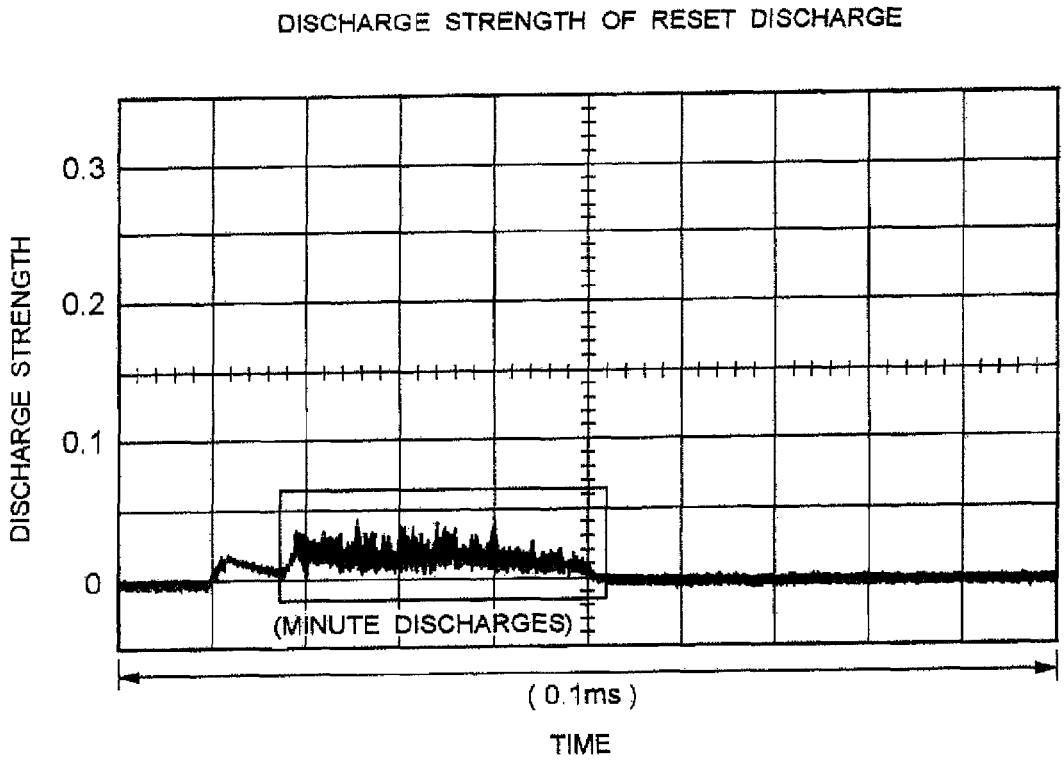
FIG. 20 is an oscilloscope waveform diagram showing a discharge strength in the case where CL emission MgO crystals are contained in a fluorophor layer in the embodiment.

FIG. 20 is an oscilloscope waveform diagram showing a discharge strength in the case where the MgO crystals 17B mixed in the fluorophor layer 17 of the PDP in FIGS. 1 through 4 contain the CL emission MgO crystals and where the voltage pulses in the aspect shown in FIG. 18 are respectively impressed on the row electrodes Y and the column electrodes D, whereby the reset discharge is performed by the cathode electrode discharge. On the other hand, FIG. 21 is an oscilloscope waveform diagram showing a discharge strength in the case where, in a prior-art PDP in which a fluorophor layer is formed of only fluorescent materials, the voltage pulses in the aspect shown in FIG. 18 are respectively impressed on row electrodes and column electrodes, whereby reset discharge is performed.

Figure 21:
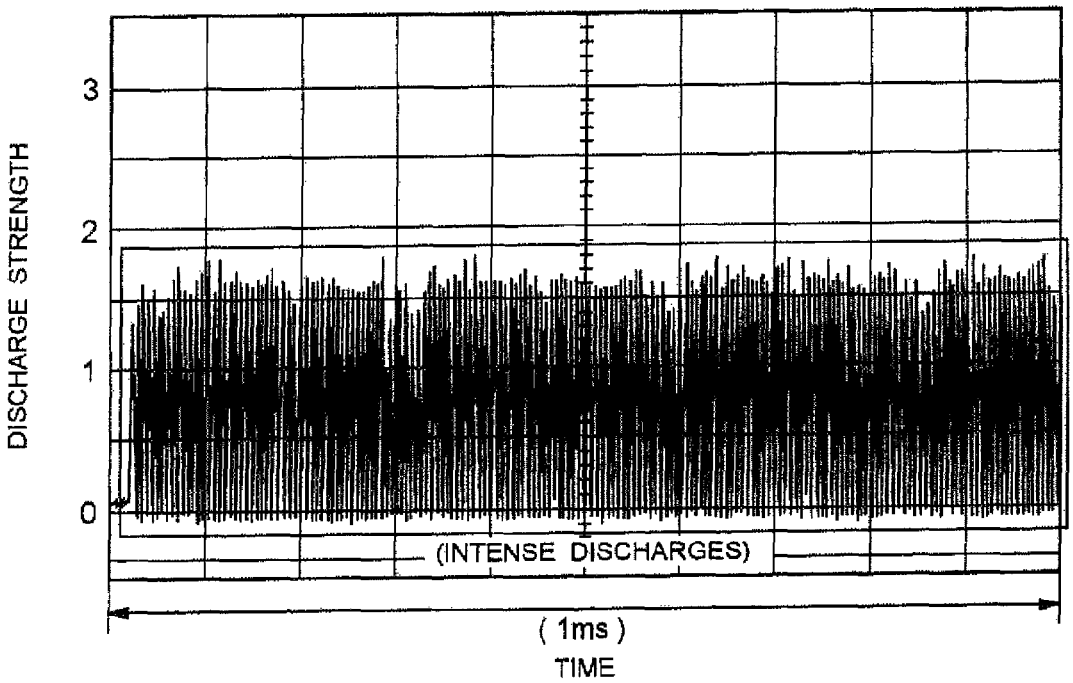
FIG. 21 is an oscilloscope waveform diagram showing a discharge strength in the case where a fluorophor layer is formed of only fluorescent materials.

Incidentally, regarding the axes of abscissas (times) in FIGS. 20 and 21, FIG. 21 indicates 1 ms with ten graduations, whereas FIG. 20 indicates 0.1 ms with ten graduations because of the minute discharge strength of the reset discharge, and it is displayed on a scale being ten times larger than in FIG. 21. Besides, the axis of ordinates (discharge strength) in FIG. 20 is displayed on a scale being ten times larger than in FIG. 21.

When FIGS. 20 and 21 are compared, it is understood that, in FIG. 20, the reset discharge (cathode column electrode discharge) has the discharge strength being much lower than in the case of FIG. 21 (about 1/40-1/50) and a discharge time being within about 0.04 ms, whereas in FIG. 21, the reset discharge has a high discharge strength and a discharge time extending over a long time of at least 1 ms. From these facts, it is understood that the discharge strength and the discharge delay are large in the case of FIG. 21, whereas they are sharply decreased in the case of FIG. 20. That is, in the PDP shown in FIGS. 1 through 4, the CL emission MgO crystals are mixed as the MgO crystals 17B into the fluorophor layer 17, whereby the sharp betterment of the dark contrast is further attained by the lowering of the discharge strength and the shortening of the discharge delay time.

The reason why the discharge strength lowers in FIG. 20, is interpreted as follows: The CL emission MgO crystals have the effect of bettering the discharge delay, as stated before. Owing to the mixing of the CL emission MgO crystals into the fluorophor layer 17, the discharge time of the reset discharge will be sharply shortened to the time being within about 0.04 ms. Besides, in the case where the voltage pulse whose time constant is large and whose rise is gentle as compared with those of the rectangular pulse is impressed on the row electrodes Y as shown in FIG. 17 or 18, the reset discharge will end at a stage at which the rising voltage value of the voltage pulse impressed on the row electrodes Y is small.

Figure 22:
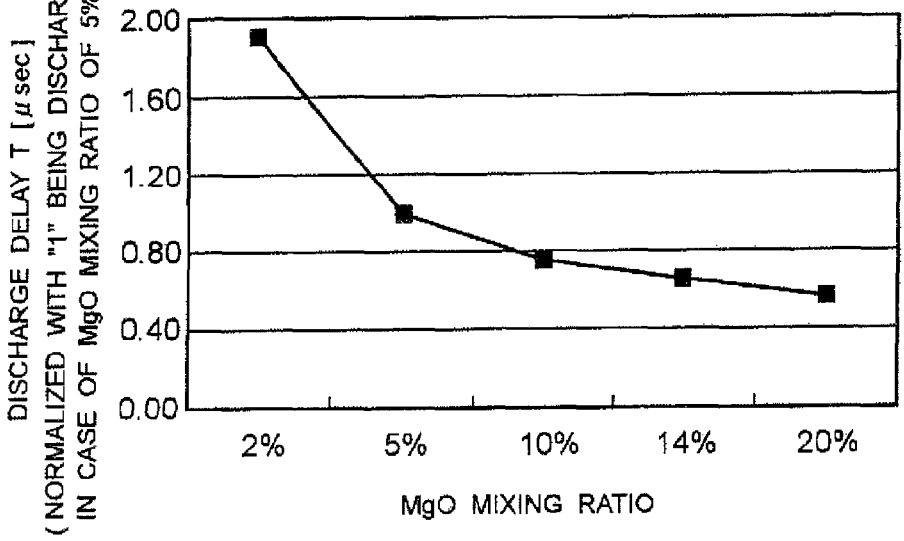
FIG. 22 is a graph showing the relationship between the mixing ratio of the CL emission MgO crystals contained in the fluorophor layer in the embodiment and a discharge delay.

FIG. 22 shows the measured results of a discharge delay time in the case where, in the PDP in which the CL emission MgO crystals are contained as the MgO crystals 17B in the fluorophor layer 17 as shown in FIGS. 1 through 4, the cathode column electrode discharge was generated by impressing the voltage pulse of large time constant and gentle rise on the row electrodes Y.

The axis of abscissas in FIG. 22 represents the mixing proportion (weight percent) of the MgO crystals containing the CL emission MgO crystals, to the fluorescent materials, while the axis of ordinates represents the discharge delay time.

Here, numerical values which indicate the discharge delay on the axis of ordinates in FIG. 22 are normalized values obtained in such a way that the discharge delay in the case where the mixing proportion of the MgO crystals is 5% is set at 1.0.

It is seen from FIG. 22 that, as the mixing ratio of the MgO crystals to the fluorescent materials, namely, the mixing proportion of the CL emission MgO crystals is larger in the fluorophor layer 17, the discharge delay of the cathode column electrode discharge is decreased more, so the effect of shortening the discharge delay time by the CL emission MgO crystals is greater.

As described above, it is understood from FIG. 20 that, in the case where the CL emission MgO crystals are contained in the MgO crystals 17B and mixed in the fluorophor layer 17 of the PDP in FIGS. 1 through 4 and where the voltage pulse of large time constant and gentle rise is impressed on the row electrodes Y, the discharge delay of the reset discharge decreases, with the further decrease of the discharge strength, so the dark contrast of the PDP is sharply bettered.

Incidentally, a similar measurement was performed for a PDP in which only the ordinary MgO crystals not being the CL emission MgO crystals were mixed into a fluorophor layer in the state of FIG. 5. Then, substantially the same result as in FIG. 21 was obtained, and the effect of lowering the discharge initiation voltage and the effect of bettering the dark contrast, based on the secondary electron emission as stated before could be attained, but the effects of bettering the discharge delay and the discharge strength could not be attained.

The reason therefor is conjectured as follows: The ordinary MgO crystals not being the CL emission MgO crystals have the function of emitting secondary electrons, but they do not have the energy levels corresponding to the peak wavelength region of 230 to 250 nm as in the CL emission MgO crystals. Therefore, the ordinary MgO crystals will be incapable of trapping the electrons for a long time, and hence, they will be incapable of obtaining sufficient initial electrons which are taken out into a discharge space at the impression of a voltage pulse.

Since the PDP shown in FIGS. 1 through 4 has the CL emission MgO crystals contained as the MgO crystals 17B and mixed in the fluorophor layer 17, it has the effect of enhancing the intensity of the PDP, in addition to the effect of enhancing the dark contrast as stated above.

More specifically, in the sustain discharge period of each subfield, sustain discharges based on surface discharges are generated between the row electrodes X and Y of the row electrode pairs, within the discharge cells C selected by the address discharges performed by the preceding address discharge period. Vacuum ultraviolet radiations of 146 nm and 172 nm are generated from xenon in the discharge gas by the sustain discharges, and the CL emission MgO crystals in the fluorophor layer 17 are excited by the vacuum ultraviolet radiations, to present the PL emission (photoluminescence emission), whereby the ultraviolet radiation having its peak within 230-250 nm (hereinbelow, termed the "PL ultraviolet radiation") is generated.

In addition, the fluorescent materials 17A in the fluorophor layer 17 are further excited by the PL ultraviolet radiation, so that the intensity of the PDP is enhanced more than in the case where only the ordinary MgO crystals are mixed in the fluorophor layer.

The intensity enhancement effect of the PDP as stated above is demonstrated in the case where the CL emission MgO crystals are contained as the MgO crystals 17B and are mixed in the fluorophor layer 17, for reasons described below.

In general, MgO crystals have the characteristic of absorbing the vacuum ultraviolet radiations generated from the xenon in the discharge gas by the discharge, without transmitting them. Therefore, in the case where, for example, only the ordinary MgO crystals not being the CL emission MgO crystals are mixed in the fluorophor layer, these MgO crystals absorb the vacuum ultraviolet radiations generated from the xenon of the discharge gas, and the quantities of the vacuum ultraviolet radiations to irradiate fluorophor grains around the MgO crystals decrease, so that the intensity of the PDP becomes lower than in a case where the fluorophor layer 17 is formed of only the fluorescent materials.

In contrast, in the case where the CL emission MgO crystals are contained as the MgO crystals 17B and are mixed in the fluorophor layer 17, the CL emission MgO crystals absorb the vacuum ultraviolet radiations generated from the xenon in the discharge gas and thereafter present the PL emission by the vacuum ultraviolet radiations, thereby to radiate the PL ultraviolet radiation having its peak wavelength within the wavelengths of 230-250 nm.

In addition, the PL ultraviolet radiation excites the fluorescent materials 17A in the fluorophor layer 17 so as to fluoresce. Therefore, it is not apprehended that, as stated above, the intensity will be lowered by mixing only the ordinary MgO crystals in the fluorophor layer 17. Besides, the fluorescent materials 17A of the fluorophor layer 17 are excited, not only by the vacuum ultraviolet radiations generated from the xenon of the discharge gas, but also by the PL ultraviolet radiation generated from the CL emission MgO crystals. Therefore, the quantity of visible light generated from the fluorophor layer 17 increases the intensity of the PDP sharply as compared with that in the case where the mixed MgO crystals 17B consist only of the ordinary MgO crystals other than the CL emission MgO crystals.

Further, the CL emission MgO crystals are mixed with the fluorescent materials 17A within the fluorophor layer 17 and are located near by the fluorophor grains. Therefore, the fluorescent materials 17A are efficiently irradiated with the PL ultraviolet radiation generated from the CL emission MgO crystals, and the intensity of the PDP is further increased.

Figure 23:
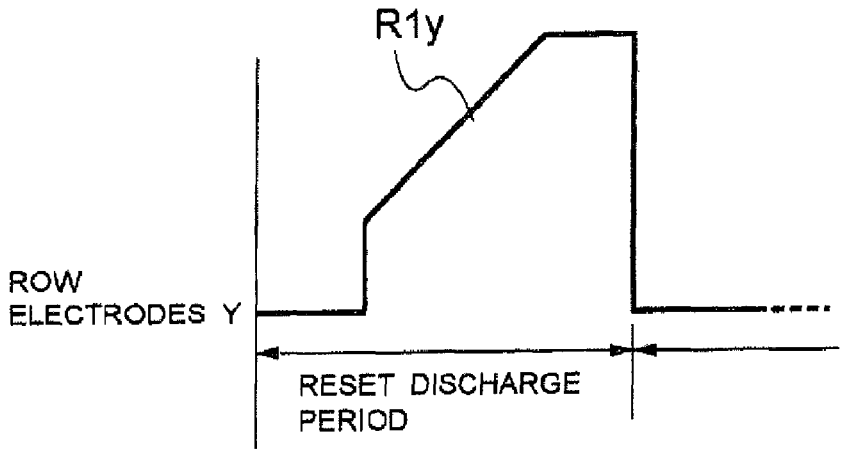
FIG. 23 is a pulse waveform diagram showing another aspect of a voltage pulse which is impressed on the row electrodes, in the embodiment.

In the above, there has been described the example in which the row electrode reset pulse which is impressed on the row electrodes Y at the reset discharge is the voltage pulse in the aspect in which the pulse voltage thereof is smoothly increased while changing the gradient of the rise thereof, as shown in FIG. 17 or 18. Alternatively, the row electrode reset pulse may well be set as a voltage pulse Rly in an aspect in which the pulse voltage thereof is rectilinearly increased with the gradient of the rise thereof held constant, as shown in FIG. 23.

Also in this case, it is possible to attain substantially the same effect of the enhancement of the dark contrast as in the case where the row electrode reset pulse is set as the voltage pulse in the aspect as shown in FIG. 17 or 18.

Figure 24:
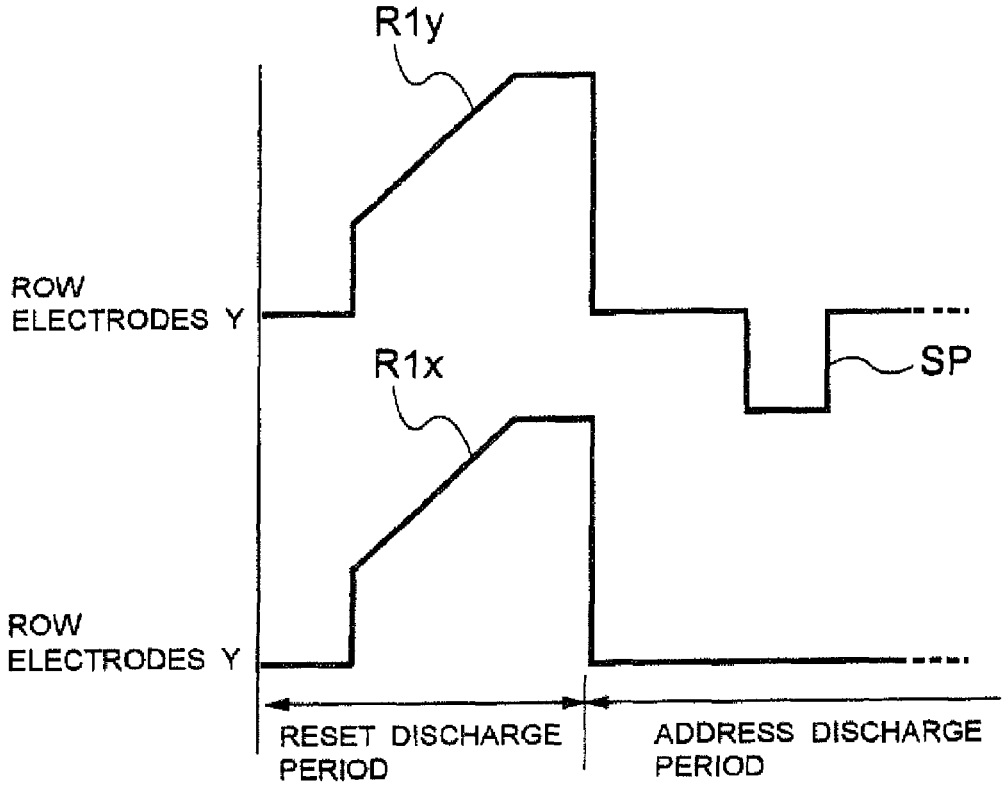
FIG. 24 is a pulse waveform diagram showing another example of voltage pulses.

Besides, in a case where, as in the case of FIG. 19, a voltage pulse is impressed also on the other row electrodes X constituting the row electrode pairs, simultaneously with the impressions of the row electrode reset pulse on the row electrodes Y, it is favorable to impress the voltage pulse R1*x* having the same polarity and the same waveform as those of the row electrode reset pulse R1*y* which is impressed on the row electrodes Y, as shown in FIG. 24.

Thus, the reset discharge can be reliably generated only between the row electrodes Y and the column electrodes D.

In the above, the configuration in which the reset discharge proceeds between the row electrodes Y and the column electrodes D has been described by mentioning the examples. The PDP, however, may well be so configured that a row electrode reset pulse is impressed on the row electrodes X, and that the reset discharge proceeds between the row electrodes X and the column electrodes D.

Figure 25:
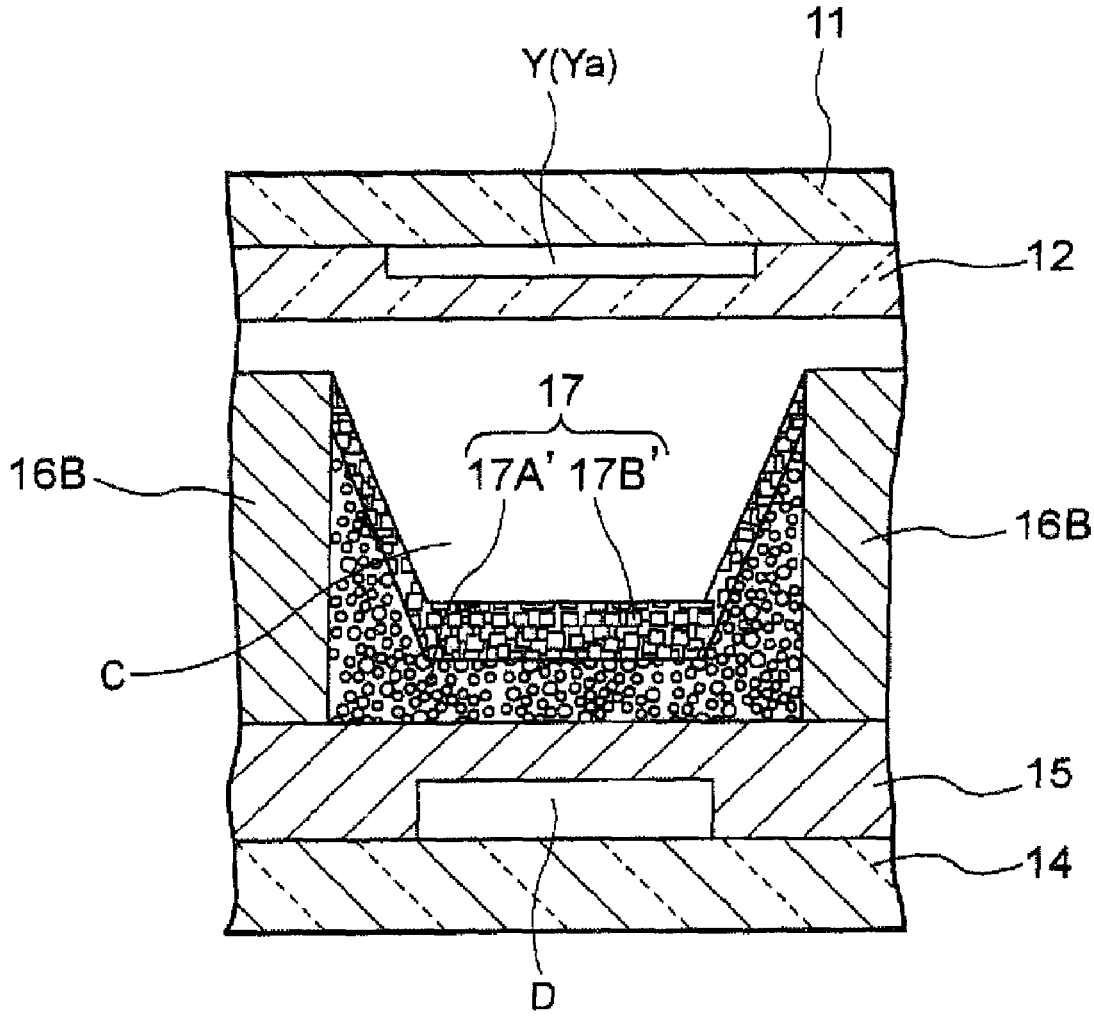
FIG. 25 is a sectional view showing a second embodiment.

FIG. 25 is a sectional view showing the second embodiment of a PDP according to this invention.

The fluorophor layer of the PDP of the first embodiment described before is formed by mixing the fluorescent materials and the MgO crystals which are the secondary electron emission material. In contrast, the PDP in the second embodiment is such that a fluorophor layer 17 has a configuration in which an MgO crystal layer 17B that is formed of MgO crystals being a secondary electron emission material is stacked on a fluorescent material layer 17A that is formed of a fluorescent material, and in which the MgO crystal layer 17B is exposed to a discharge cell C.

The MgO crystal layer 17B may be formed so as to spread the MgO crystals all over the fluorescent material layer 17A. Alternatively, a thin film based on the MgO crystals may well be formed so as to be stacked on the fluorescent material layer 17A.

In a case where CL emission MgO crystals are employed and contained as the secondary electron emission material forming the MgO crystal layer 17B, this MgO crystal layer 17B is formed in such a way that the CL emission MgO crystals are spread all over the fluorescent material layer 17A.

The configurations of the other portions of the PDP are substantially the same as in the case of the first embodiment, and numerals and signs identical to those in the case of the first embodiment are assigned to the same constituent portions.

The PDP is driven by a method similar to that in the case of the first embodiment.

More specifically, a reset discharge proceeds in such a way that the row electrode reset pulse in the aspect as shown in FIG. 17 or 23 is impressed on row electrodes Y, whereby opposed discharges based on a cathode column electrode discharge are generated between the row electrodes Y and column electrodes D.

Thus, as in the case of the first embodiment, the effect of enhancing the dark contrast of the PDP is demonstrated by the opposed discharges of the reset discharge, and the effect of lowering the discharge initiation voltage of an address discharge to succeed to the reset discharge is demonstrated by secondary electrons which are emitted from the MgO crystal layer 17B into the discharge cells C by the reset discharge.

Besides, in the case where the MgO crystal layer 17B is formed containing the CL emission MgO crystals, the dark contrast can be further enhanced by the shortening of a discharge delay and the decrease of a discharge strength as in the case of the first embodiment. Simultaneously, the CL emission MgO crystals present PL emission (photoluminescence emission) by vacuum ultraviolet radiations which are generated from xenon in a discharge gas, thereby to generate PL ultraviolet radiation, and this PL ultraviolet radiation further excites the fluorescent material layer 17A of the fluorophor layer 17 so as to fluoresce, so that the intensity of the PDP can be increased.

The PDP in each of the embodiments has as its high-level concept, a PDP including a pair of substrates which oppose through a discharge space, a plurality of row electrode pairs which are disposed on the side of one of the pair of substrates, a plurality of column electrodes which are disposed on the side of the other substrate so as to extend in a direction intersecting the row electrode pairs and which form unit light emission regions at the parts of the discharge space intersecting the row electrode pairs, respectively, and fluorophor layers which are disposed at positions confronting the unit light emission regions between the column electrodes and the row electrode pairs, wherein a discharge gas is enclosed within the discharge space, a secondary electron emission material is contained in each of the fluorophor layers, and the secondary electron emission material is magnesium oxide which contains magnesium oxide crystals having the characteristic of being excited by an electron beam and presenting cathode-luminescence emission with a peak within a wavelength region of 200-300 nm. The drive method for a PDP in each of the embodiments has as its high-level concept, a drive method for the PDP, in which a drive step includes a step that impresses a voltage pulse on either-side row electrodes constituting the row electrode pairs, and that sets a potential of the column electrodes onto a negative polarity side relatively to the either-side row electrodes impressed with the voltage pulse, whereby opposed discharges are generated with the fluorophor layers interposed between the column electrodes and the either-side row electrodes.

According to the PDP in this embodiment, the fluorophor layer formed at the position confronting the corresponding unit light emission region contains the secondary electron emission material, and the opposed discharge is generated between either row electrode of the pair of row electrodes located with the fluorophor layer interposed therebetween and the corresponding column electrode, whereby cations produced from the discharge gas within the unit light emission region at the generation of the discharge collide against the secondary electron emission material contained in the fluorophor layer, and secondary electrons are emitted from the secondary electron emission material into the unit light emission region.

Thus, a discharge which is performed subsequently to the opposed discharge between the either row electrode and the column electrode becomes liable to occur owing to the secondary electrons existing within the unit light emission region, and the discharge initiation voltage of the subsequent discharge is lowered.

Besides, in a case where the opposed discharges proceeding between the either-side row electrodes and the column electrodes serves as a reset discharge for initializing all the unit light emission regions at the drive of the PDP, these opposed discharges are performed at substantially the central parts of the unit light emission regions spaced from that substrate of the pair of substrates which forms the panel face of the PDP. Therefore, light emissions based on the reset discharge as are recognized at the panel face become less than in a case where the reset discharge is performed by the surface discharges between the row electrodes at positions near the panel face. Accordingly, a dark contrast is prevented from lowering due to the light emissions which are based on the reset discharge and which have no relation to the gradation display of an image, and enhancement in the dark contrast of the PDP can be attained.

In addition, according to the drive method for the PDP in the embodiment, the opposed discharges between the either-side row electrodes and the column electrodes are generated in such a way that the voltage pulse is impressed on the either-side row electrodes, and that the potential of the column electrodes is set on the negative electrode side relatively to the either-side row electrodes impressed with the voltage pulse. Thus, the cations produced from the discharge gas by the opposed discharges advance toward the column electrodes serving as the negative electrode side and collide against the secondary electron emission material contained in the fluorophor layers. Therefore, the secondary electrons are efficiently emitted from the secondary electron emission material into the unit light emission regions.

Other embodiments of this invention will be further described with reference to the drawings. Referring to FIG. 1, the drive control circuit 56 first converts the respective pixels of an input video signal into pixel data of 8 bits representing the intensity levels of all the pixels by 256 gradations, and it subjects the pixel data to a multi-gradation process which consists of an error diffusion process and a dither process. More specifically, first of all, in the error diffusion process, the upper 6 bits of the pixel data are set as display data, and the remaining lower 2 bits as error data. The error data in the pixel data corresponding to respective surrounding pixels are weighted and added, and the resulting sum is reflected upon the display data, thereby to obtain error-diffusion-process pixel data of 6 bits. According to such an error diffusion process, an intensity for the lower 2 bits in the original pixel are represented in pseudo fashion by the surrounding pixels, so that an intensity gradation representation equivalent to that of the pixel data of 8 bits is permitted by the display data of 6 bits smaller in number than 8 bits. Subsequently, the drive control circuit 56 executes the dither process for the error-diffusion-process image data of 6 bits obtained by the error diffusion process. In the dither process, a plurality of pixels adjacent to one another are set as one pixel unit, and the error-diffusion-process pixel data corresponding to the pixels within the pixel unit are respectively assigned dither coefficients formed of coefficient values different from one another and are then added, thereby to obtain dither-addition pixel data. According to such an addition of the dither coefficients, an intensity corresponding to 8 bits can be represented even by the upper 4 bits of the dither-addition pixel data in a case where the original image is viewed in the pixel units as stated above. Therefore, the drive control circuit 56 converts the upper 4 bits of the dither-addition pixel data into multi-gradation pixel data $PD_s$ of 4 bits representing all the intensity levels by 16 gradations as shown in FIG. 26. In addition, the drive control circuit 56 converts the multi-gradation pixel data $PD_s$ into pixel drive data GD of 14 bits in accordance with a data conversion table as shown in FIG. 26. Besides, the drive control circuit 56 causes first—fourteenth bits in such pixel drive data GD to correspond to subfields SF1-SF14 (to be stated later), respectively, and it feeds bit places corresponding to the subfields SF, to the address driver 55 every display line (numbering m bit places) as pixel drive data bits.

Figure 27:
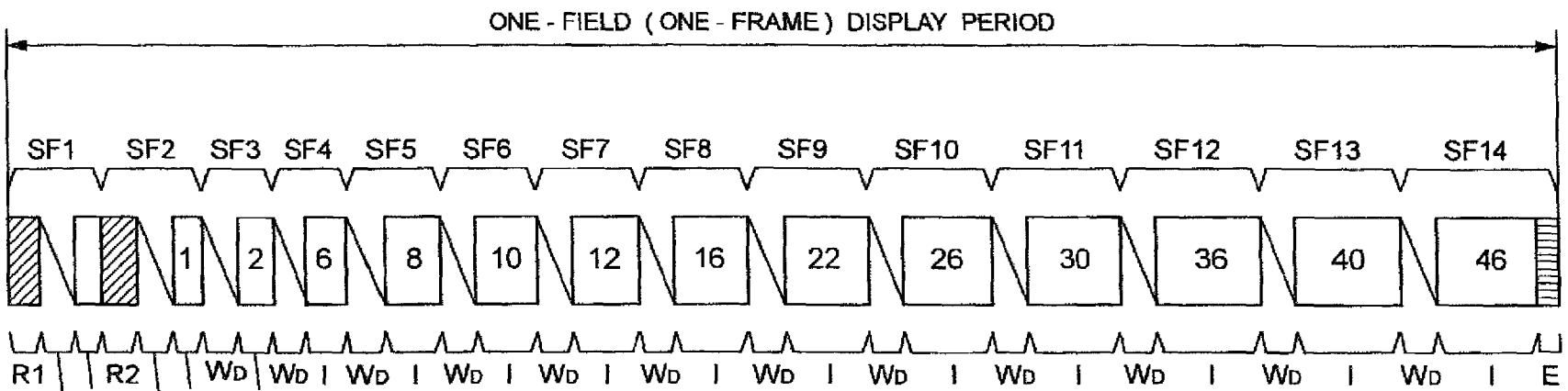
FIG. 27 is a diagram showing an example of a light emission drive sequence which is adopted in the plasma display device shown in FIG. 1.

Further, the drive control circuit 56 feeds various control signals for driving the PDP 50 of the above structure in accordance with a light emission drive sequence as shown in FIG. 27, to a panel driver which consists of the X-electrode driver 51, the Y-electrode driver 53 and the address driver 55. More specifically, in the head subfield SF1 within a one-field (one-frame) display period as shown in FIG. 27, the drive control circuit 56 feeds the panel driver with various control signals for successively performing drives which conform respectively to a first reset step R1, a first selective write address step $W1_W$ and a minute light emission step LL. In the subfield SF2 succeeding to such a subfield SF1, the drive control circuit 56 feeds the panel driver with various control signals for successively performing drives which conform respectively to a second reset step R2, a second selective write address step $W2_W$ and a sustain step I. Besides, in each of the subfields SF3-SF14, the drive control circuit 56 feeds the panel driver with various control signals for successively performing drives which conform respectively to a selective erase address step $W_D$ and a sustain step I. Incidentally, only in the tailmost subfield SF14 within the one-field display period and after the execution of the sustain step I, the drive control circuit 56 feeds the panel driver with various control signals for successively performing drives which conform respectively to an erase step E.

Figure 28:
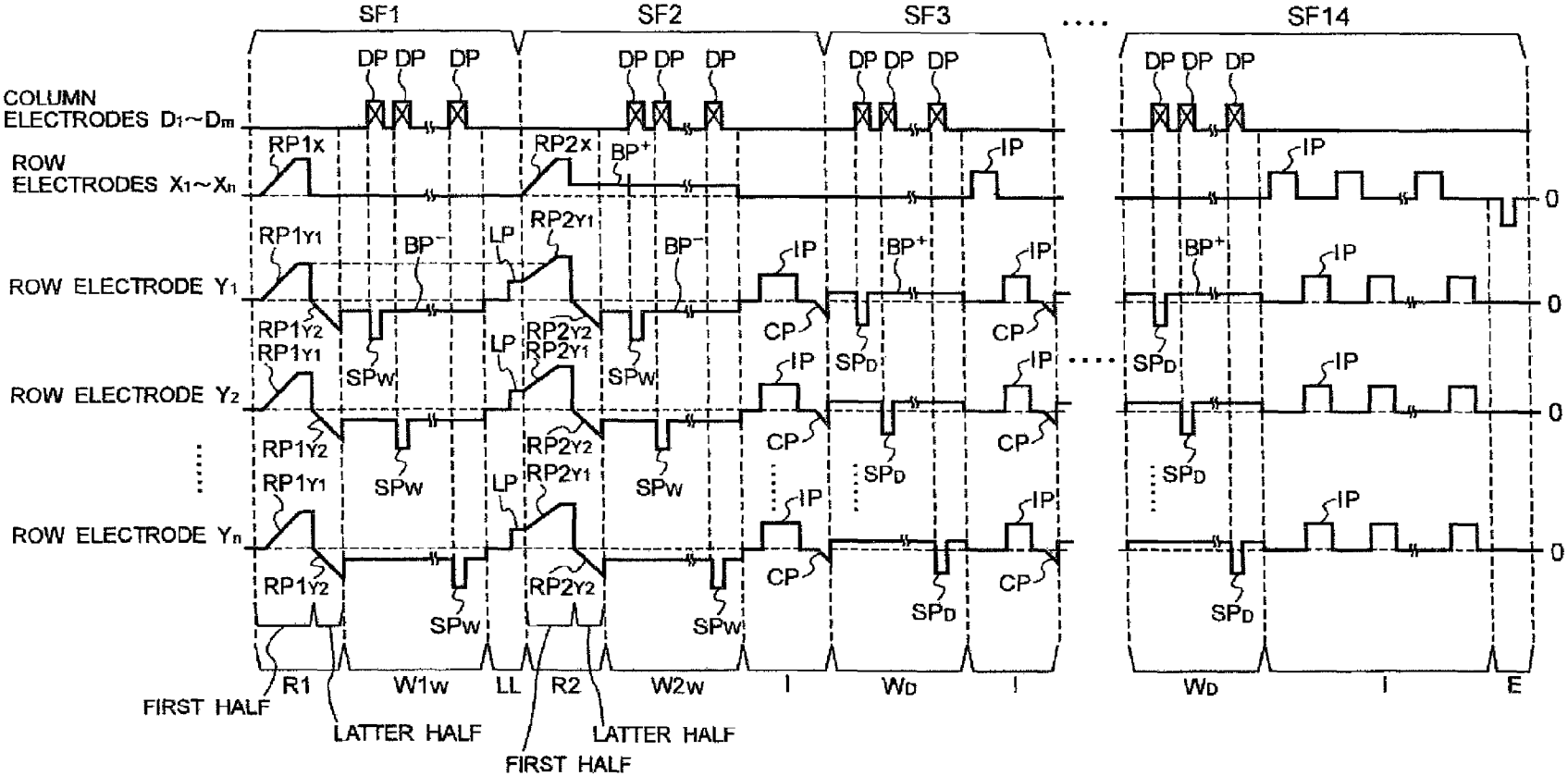
FIG. 28 is a diagram showing various drive pulses which are impressed on the PDP 50 in accordance with the light emission drive sequence shown in FIG. 27.

The panel driver, namely, the X-electrode driver 51, Y-electrode driver 53 and address driver 55 generate(s) various drive pulses as shown in FIG. 28 and feed(s) the drive pulses to the column electrodes D and the row electrodes X and Y of the PDP 50, in accordance with the various control signals fed from the drive control circuit 56.

In FIG. 28, only operations in the subfields SF1-SF3 and the tailmost subfield SF14 among the subfields SF1-SF14 shown in FIG. 27 are extracted and illustrated.

First of all, in the first half part of the first reset step R1 of the subfield SF1, the Y-electrode driver 53 impresses on all the row electrodes $Y_1$-$Y_n$, a reset pulse $RP1_{Y1}$ of positive polarity in a waveform in which a potential transition at a leading edge with the lapse of time is gentler than in a sustain pulse to be stated later. Incidentally, the peak potential of the reset pulse $RP1_{Y1}$ is higher than that of the sustain pulse, and it is lower than that of a reset pulse $RP2_{Y1}$ to be stated later. Besides, meantime, the address driver 55 sets the column electrodes $D_1$-$D_m$ in the state of ground potential (0 volt). Further, meantime, the X-electrode driver 51 impresses on all the row electrodes $X_1$-$X_n$, a reset pulse $RP1_X$ which is identical in polarity to such a reset pulse $RP1_{Y1}$ and whose peak potential capable of preventing surface discharges between the row electrodes X and Y as are induced by the impression of the reset pulse $RP1_{Y1}$. Incidentally, meantime, insofar as the surface discharges are not generated between the row electrodes X and Y, the X-electrode driver 51 may well set all the row electrodes $X_1$-$X_n$ at the ground potential (0 volt), instead of the impression of the reset pulse $RP1_X$. Here, in the first half part of the first reset step R1, first reset discharges being weak are induced between the row electrodes Y and the column electrodes D within all the pixel cells PC, in accordance with the impression of the reset pulse $RP1_{Y1}$ as stated above. That is, in the first half part of the first reset step R1, a voltage is applied between the row electrodes Y and the column electrodes D with the former electrodes Y held as an anode side and the latter electrodes D held as a cathode side, whereby discharges in which currents flow from the row electrodes Y toward the column electrodes D (hereinbelow, the "column side cathode discharges") are induced as the first reset discharges. In accordance with such first reset discharges, wall charges of negative polarity and wall charges of positive polarity are respectively formed in the vicinities of the row electrodes Y and in the vicinities of the column electrodes D within all the pixel cells PC.

Subsequently, in the latter half part of the first reset step R1 of the subfield SF1, the Y-electrode driver 53 generates a reset pulse $RP1_{Y2}$ of negative polarity in which a potential transition at a leading edge with the lapse of time is gentle, and it impresses the reset pulse $RP1_{Y2}$ on all the row electrodes $Y_1$-$Y_n$. Incidentally, a negative peak potential in the reset pulse $RP1_{Y2}$ is set at a potential which is higher than the peak potential of a write scan pulse $SP_W$ of negative polarity to be stated later, that is, at a potential which is near 0 volt. The reason therefor is that, when the peak potential of the reset pulse $RP1_{Y2}$ is made lower than that of the write scan pulse $SP_W$, strong discharges are induced between the row electrodes Y and the column electrodes D, to sharply erase the wall charges having been formed in the vicinities of the column electrodes D, so address discharges in a first selective write address step $W1_W$ become unstable. Meantime, the X-electrode driver 51 sets all the row electrodes $X_1$-$X_n$ at the ground potential (0 volt). Incidentally, the peak potential of the reset pulse $RP1_{Y2}$ is the lowest potential which can reliably induce second reset discharges between the row electrodes X and Y, in consideration of the wall charges which have been formed in the vicinities of the row electrodes X and Y in accordance with the first reset discharges. Here, in the latter half part of the first reset step R1, the second reset discharges are induced between the row electrodes X and Y within all the pixel cells PC, in accordance with the impression of the reset pulse $RP1_{Y2}$ as stated above. Owing to the second reset discharges, the wall charges having been formed in the vicinities of the row electrodes X and Y within the respective pixel cells PC are erased, whereby all the pixel cells PC are initialized into a light-off mode. Further, weak discharges are induced also between the row electrodes Y and the column electrodes D within all the pixel cells PC, in accordance with the impression of the reset pulse $RP1_{Y2}$. Owing to the weak discharges, some of the wall charges of positive polarity having been formed in the vicinities of the column electrodes D are erased, and the wall charges are adjusted into quantities in which selective write address discharges can be properly induced in the first selective write address step $W1_W$ to be stated later.

Subsequently, in the first selective write address step $W1_W$ of the subfield SF1, the Y-electrode driver 53 impresses the write scan pulse $SP_W$ having the peak potential of negative polarity, on the row electrodes $Y_1$-$Y_n$ successively and selectively, while impressing a base pulse $BP^-$ which has a predetermined base potential of negative polarity as shown in FIG. 28, on the row electrodes $Y_1$-$Y_n$ simultaneously. Meantime, the address driver 55 first converts a pixel drive data bit corresponding to the subfield SF1, into a pixel data pulse DP whose pulse voltage corresponds to the logic level of the data bit. By way of example, in a case where the address driver 55 has been fed with the pixel drive data bit of logic level "1" for setting the pixel cell PC into the light-up mode, it converts the data bit into the pixel data pulse DP having a peak potential of positive polarity. On the other hand, the pixel drive data bit of logic level "0" for setting the pixel cell PC into the light-off mode is converted into the pixel data pulse DP of low voltage (0 volt). In addition, the address driver 55 impresses such pixel data pulses DP on the column electrodes $D_1$-$D_m$ in synchronism with the impression timing of each write scan pulse $SP_W$ every display line (numbering m pulses). Simultaneously with the write scan pulse $SP_W$, the selective write address discharge is induced between the column electrode D and the row electrode Y within the pixel cell PC which has been impressed with the pixel data pulse DP of high voltage and which is to be set into the light-up mode. Incidentally, meantime, a voltage corresponding to the write scan pulse $SP_W$ is impressed also between the row electrodes X and Y. At this stage, however, all the pixel cells PC are in the light-off mode, that is, in states where the wall charges have been erased, so that discharges are not induced between the row electrodes X and Y merely by the impression of such a write scan pulse $SP_W$. In the first selective write address step $W1_W$ of the subfield SF1, accordingly, the selective write address discharges are induced only between the column electrodes D and the row electrodes Y within the pixel cells PC, in accordance with the impressions of the write scan pulse $SP_W$ and the pixel data pulses DP of the high voltage. Thus, the pixel cells PC are set into the states of the light-off mode where the wall charges do not exist in the vicinities of the row electrodes X within the pixel cells PC, but where the wall charges of the positive polarity and the wall charges of the negative polarity are respectively formed in the vicinities of the row electrodes Y and in the vicinities of the column electrodes D. On the other hand, the selective write address discharge as stated above is not induced between the column electrode D and the row electrode Y within the pixel cell PC on which the pixel data pulse DP of the low voltage (0 volt) for setting the light-off mode has been impressed simultaneously with the write scan pulse $SP_W$. Consequently, such a pixel cell PC keeps the state of the light-off mode as has been initialized in the first reset step R1, that is, a state where any discharge is induced neither between the row electrode Y and the column electrode D, not between the row electrodes X and Y.

Subsequently, in the minute light emission step LL of the subfield SF1, the Y-electrode driver 53 impresses a minute light emission pulse LP having a predetermined peak potential of positive polarity as shown in FIG. 28, on the row electrodes $Y_1$-$Y_n$ simultaneously. A discharge (hereinbelow, termed the "minute light emission discharge") is induced between the column electrode D and the row electrode Y within the pixel cell PC set in the light-up mode, in accordance with the impression of such a minute light emission pulse LP. That is, in the minute light emission step LL, a potential with which discharges are induced between the row electrodes Y and the column electrodes D within the pixel cells PC, but with which any discharge is not induced between the row electrodes X and Y, is impressed on the row electrodes Y, whereby the minute light emission is induced only between the column electrode D and the row electrode Y within the pixel cell PC set in the light-up mode. In this process, the peak potential of the minute light emission pulse LP is lower than that of a sustain pulse IP which is impressed in the sustain steps I of the subfields SF2, et seq. to be stated later, and by way of example, it is identical to a base potential which is impressed on the row electrodes Y in a selective erase address step $W_D$ to be stated later. Besides, as shown in FIG. 28, a change rate with the lapse of time in the rise section of a potential in the minute light emission pulse LP is made higher than a change rate in the rise section in the reset pulse ($RP\mathbf{1}_{Y1}$ or $RP\mathbf{2}_{Y1}$). That is, a potential transition at the leading edge of the minute light emission pulse LP is made more abrupt than a potential transition at the leading edge of the reset pulse, thereby to induce discharges stronger than the first reset discharges which are induced in the first reset step R1 and the second reset step R2. Here, such discharges are the column side cathode discharges as stated before, and they are discharges induced by the minute light emission pulse LP the pulse voltage of which is lower than that of the sustain pulse IP. Therefore, the light emission intensity generated by the discharges is lower than the light emission intensity by sustain discharges (to be described later) inducted between the row electrodes X and Y. That is, the minute light emission step LL induces as minute light emission discharges, the discharges which accompany light emissions at an intensity level higher than in the first reset discharges, but whose involved intensity level is lower than in the sustain discharges, that is, discharges which accompany light emissions minute enough to be utilized for display. In the first selective write address step $W\mathbf{1}_W$ which is performed immediately before the minute light emission step LL, the selective write address discharges are induced between the column electrodes D and the row electrodes Y within the pixel cells PC. In the subfield SF1, therefore, an intensity corresponding to a gradation which is one intensity level higher than an intensity level "0" is represented by the light emission involved in such a selective write address discharge and the light emission involved in the minute light emission discharge.

Incidentally, after the minute light emission discharges, wall charges of negative polarity and wall charges of positive polarity are respectively formed in the vicinities of the row electrodes Y and in the vicinities of the column electrodes D.

Subsequently, in the first half part of the second reset step R2 of the subfield SF2, the Y-electrode driver 53 impresses on all the row electrodes $Y_1$-$Y_n$, the reset pulse $RP\mathbf{2}_{Y1}$ of positive polarity in a waveform in which a potential transition at a leading edge with the lapse of time is gentler than in the sustain pulse to be stated later. Incidentally, the peak potential of the reset pulse $RP\mathbf{2}_{Y1}$ is higher than that of the reset pulse $RP\mathbf{1}_{Y1}$. Besides, meantime, the address driver 55 sets the column electrodes $D_1$-$D_m$, into states of ground potential (0 volt), and the X-electrode driver 51 impresses on all the row electrodes $X_1$-$X_n$, a reset pulse $RP\mathbf{2}_X$ of positive polarity which has a peak potential capable of preventing surface discharges between the row electrodes X and Y as are generated by the impression of the reset pulse $RP\mathbf{2}_{Y1}$. Incidentally, insofar as the surface discharges are not generated between the row electrodes X and Y, the X-electrode driver 51 may well set all the row electrodes $X_1$-$X_n$ at the ground potential (0 volt), instead of impressing the reset pulse $RP\mathbf{2}_X$. In accordance with the impression of the reset pulse $RP\mathbf{2}_{Y1}$, the first reset discharge weaker than the column side cathode discharge in the minute light emission step LL is induced between the row electrode Y and the column electrode D within each of the pixel cells PC in which the column side cathode discharges have not been induced in such a minute light emission step LL. That is, in the first half part of the second reset step R2, a voltage is applied between the row electrodes Y and the column electrodes D with the former electrodes Y held as an anode side and the latter electrodes D held as a cathode side, whereby column side cathode discharges in which currents flow from the row electrodes Y toward the column electrodes D are induced as the first reset discharges. On the other hand, discharges are not induced in spite of the impression of the reset pulse $RP\mathbf{2}_{Y1}$, within the pixel cells PC in which the minute light emission discharges have already been induced in the minute light emission step LL. Accordingly, immediately after the end of the first half part of the second reset step R2, there is established a state where wall charges of negative polarity and wall charges of positive polarity are respectively formed in the vicinities of the row electrodes Y and in the vicinities of the column electrodes D within all the pixel cells PC. Subsequently, in the latter half part of the second reset step R2 of the subfield SF2, the Y-electrode driver 53 impresses on the row electrodes $Y_1$-$Y_n$, a reset pulse $RP\mathbf{2}_{Y2}$ of negative polarity in which a potential transition at a leading edge with the lapse of time is gentle. Further, in the latter half part of the second reset step R2, the X-electrode driver 51 impresses a base pulse $BP^+$ having a predetermined base potential of positive polarity, on the respective row electrodes $X_1$-$X_n$. In this process, in accordance with the impressions of the reset pulse $RP\mathbf{2}_{Y2}$ of the negative polarity and the base pulse $BP^+$ of the positive polarity, second reset discharges are induced between the row electrodes X and Y within all the pixel cells PC. Incidentally, the peak potential of each of the reset pulse $RP\mathbf{2}_{Y2}$ and the base pulse $BP^+$ is the lowest potential which can reliably induce the second reset discharges between the row electrodes X and Y, in consideration of the wall charges which have been formed in the vicinities of the row electrodes X and Y in accordance with the first reset discharges. Besides, a negative peak potential in the reset pulse $RP\mathbf{2}_{Y2}$ is set at a potential which is higher than the peak potential of the write scan pulse $SP_W$ of negative polarity, that is, at a potential which is near 0 volt. The reason therefor is that, when the peak potential of the reset pulse $RP\mathbf{2}_{Y2}$ is made lower than that of the write scan pulse $SP_W$, strong discharges are induced between the row electrodes Y and the column electrodes D, to sharply erase the wall charges having been formed in the vicinities of the column electrodes D, so address discharges in a second selective write address step $W\mathbf{2}_W$ become unstable. Here, owing to the second reset discharges induced in the latter half part of the second reset step R2, the wall charges having been formed in the vicinities of the row electrodes X and Y within the respective pixel cells PC are erased, whereby all the pixel cells PC are initialized into the light-off mode.

Further, weak discharges are induced also between the row electrodes Y and the column electrodes D within all the pixel cells PC, in accordance with the impression of the reset pulse $RP2_{Y2}$. Owing to such discharges, some of the wall charges of positive polarity having been formed in the vicinities of the column electrodes D are erased, and the wall charges are adjusted into quantities in which selective write address discharges can be properly induced in the second selective write address step $W2_W$.

Subsequently, in the second selective write address step $W2_W$ of the subfield SF2, the Y-electrode driver 53 impresses the write scan pulse $SP_W$ having the peak potential of negative polarity, on the row electrodes $Y_1$-$Y_n$ successively and selectively, while impressing the base pulse $BP^-$ which has the predetermined base potential of negative polarity as shown in FIG. 28, on the row electrodes $Y_1$-$Y_n$ simultaneously. The X-electrode driver 51 impresses the base pulse $BP^+$ impressed on the row electrodes $X_1$-$X_n$ in the latter half part of the second reset step R2, on the respective row electrodes $X_1$-$X_n$ continuously in the second selective write address step $W2_W$. Incidentally, the potential of each of the base pulses $BP^-$ and $BP^+$ is set at a potential with which the voltage between the row electrodes X and Y during the non-impression period of the write scan pulse $SP_W$ becomes lower than the discharge initiation voltage of the pixel cells PC. Further, in the second selective address step $W2_W$, the address driver 55 first converts a pixel drive data bit corresponding to the subfield SF2, into a pixel data pulse DP whose pulse voltage corresponds to the logic level of the data bit. By way of example, in a case where the address driver 55 has been fed with the pixel drive data bit of logic level "1" for setting the pixel cell PC into the light-up mode, it converts the data bit into the pixel data pulse DP having a peak potential of positive polarity. On the other hand, the pixel drive data bit of logic level "0" for setting the pixel cell PC into the light-off mode is converted into the pixel data pulse DP of low voltage (0 volt). In addition, the address driver 55 impresses such pixel data pulses DP on the column electrodes $D_1$-$D_m$ m in synchronism with the impression timing of each write scan pulse $SP_W$ every display line (numbering m pulses). Simultaneously with the write scan pulse $SP_W$, the selective write address discharge is induced between the column electrode D and the row electrode Y within the pixel cell PC which has been impressed with the pixel data pulse DP of high voltage and which is to be set into the light-up mode. Further, immediately after such a selective write address discharge, a weak discharge is induced also between the row electrodes X and Y within the pixel cell PC. More specifically, after the write scan pulse $SP_W$ has been impressed, voltages corresponding to the base pulses $BP^-$ and $BP^+$ are applied between the row electrodes X and Y. Since, however, the voltages are set to be lower than the discharge initiation voltage of each pixel cell PC, any discharge is not generated within the pixel cell PC merely by the applications of such voltages. In contrast, when the selective write address discharge is generated, a discharge is generated between the row electrodes X and Y merely by the voltage applications based on the base pulses $BP^-$ and $BP^+$, by being induced by the selective write address discharge. Such a discharge is not generated in the first selective write address step $W1_W$ in which the base pulse $BP^+$ is not impressed on the row electrode X. Owing to such a discharge and the selective write address discharge, the pixel cell PC is set into a state where wall charges of positive polarity, wall charges of negative polarity and wall charges of negative polarity are respectively formed in the vicinity of the row electrode Y, in the vicinity of the row electrode X and in the vicinity of the column electrode D, that is, into the light-up mode. On the other hand, the selective write address discharge as stated above is not generated between the column electrode D and the row electrode Y within the pixel cell PC on which the pixel data pulse DP of low voltage (0 volt) for setting the light-off mode has been impressed simultaneously with the write scan pulse $SP_W$. Therefore, any discharge is not generated even between the row electrodes X and Y. Consequently, the pixel cell PC keeps its state immediately before, that is, the state of the light-off mode into which the pixel cell PC has been initialized in the second reset step R2.

Subsequently, in the sustain step I of the subfield SF2, the Y-electrode driver 53 generates one pulse of the sustain pulse IP having a peak potential of positive polarity, and it impresses the pulse on the row electrodes $Y_1$-$Y_n$ simultaneously. Meantime, the X-electrode driver 51 sets the row electrodes $X_1$-$X_n$ into states of ground potential (0 volt), and the address driver 55 sets the column electrodes $D_1$-$D_m$ into states of the ground potential (0 volt). In accordance with the impression of the sustain pulse IP, a sustain discharge is generated between the row electrodes X and Y within the pixel cell PC set in the light-up mode as stated above. Light radiated from the fluorophor layer 17 simultaneously with such a sustain discharge is radiated outside the display panel device through the front transparent substrate 10, whereby one time of display light emission corresponding to the intensity weight of the subfield SF1 is done. Besides, in accordance with the impression of such a sustain pulse IP, a discharge is generated also between the row electrode Y and the column electrode D within the pixel cell PC set in the light-up mode. Owing to such a discharge and the sustain discharge, wall charges of negative polarity are formed in the vicinity of the row electrode Y within the pixel cell PC, and wall charges of positive polarity are respectively formed in the vicinities of the row electrode X and the column electrode D. In addition, after the impression of such a sustain pulse IP, the Y-electrode driver 53 impresses on the row electrodes $Y_1$-$Y_n$, a wall-charge adjustment pulse CP which has a peak potential of negative polarity and in which a potential transition at a leading edge with the lapse of time is gentle as shown in FIG. 28. In accordance with the impression of such a wall-charge adjustment pulse CP, a weak erase discharge is induced within the pixel cell PC in which the sustain discharge as stated above has been generated, and some of the wall charges having been formed therein are erased. Thus, the quantity of the wall charges within the pixel cell PC is adjusted into a quantity capable of properly inducing a selective erase address discharge in the next selective erase address step $W_D$. Subsequently, in the selective erase address step $W_O$ of each of the subfields SF3-SF14, the Y-electrode driver 53 impresses an erase scan pulse $SP_D$ having a peak potential of negative polarity as shown in FIG. 28, on the row electrodes $Y_1$-$Y_n$ successively and selectively, while impressing the base pulse $BP^+$ having the predetermined base potential of positive polarity, on the respective row electrodes $Y_1$-$Y_n$. Incidentally, the peak potential of the base pulse $BP^+$ is set at a potential capable of preventing erroneous discharges between the row electrodes X and Y, throughout the execution period of the selective erase address step $W_O$. Besides, the X-electrode driver 51 sets the respective row electrodes $X_1$-$X_n$ at the ground potential (0 volt) throughout the execution period of the selective erase address step $W_O$. Further, in the selective erase address step $W_D$, the address driver 55 first converts a pixel drive data bit corresponding to the subfield SF, into a pixel data pulse DP whose pulse voltage corresponds to the logic level of the data bit. By way of example, in a case where the address driver 55 has been fed with the pixel drive data bit of logic level "1" for shifting the pixel cell PC from the light-up mode into the light-off mode, it converts the data bit into the pixel data pulse DP having a peak potential of positive polarity. On the other hand, in a case where the address driver 55 has been fed with the pixel drive data bit of logic level "0" for keeping the current state of the pixel cell PC, it converts the data bit into the pixel data pulse DP of low voltage (0 volt). In addition, the address driver 55 impresses such pixel data pulses DP on the column electrodes $D_1$-$D_m$ in synchronism with the impression timing of each erase scan pulse $SP_D$ every display line (numbering m pulses). Simultaneously with the erase scan pulse $SP_D$, a selective erase address discharge is induced between the column electrode D and the row electrode Y within the pixel cell PC which has been impressed with the pixel data pulse DP of high voltage. Owing to such a selective erase address discharge, the pixel cell PC is set into a state where wall charges of positive polarity and wall charges of negative polarity are respectively formed in the vicinities of the row electrodes Y and X and in the vicinity of the column electrode D, that is, into the light-off mode. On the other hand, the selective erase address discharge as stated above is not induced between the column electrode D and the row electrode Y within the pixel cell PC on which the pixel data pulse DP of the low voltage (0 volt) has been impressed simultaneously with the erase scan pulse $SP_D$. Consequently, the pixel cell PC keeps its state immediately before (light-up mode or light-off mode).

Subsequently, in the sustain step I of each of the subfields SF3-SF14, the X-electrode driver 51 and the Y-electrode driver 53 impress a sustain pulse IP having a peak potential of positive polarity, on the row electrodes $X_1$-$X_n$ and $Y_1$-$Y_n$, alternately on the row electrodes X and Y and repeatedly the number of times (even number of times) corresponding to the intensity weight of the pertinent subfield, as shown in FIG. 28. Each time such a sustain pulse IP is impressed, a sustain discharge is induced between the row electrodes X and Y within the pixel cell PC set in the light-up mode. Light radiated from the fluorophor layer 17 simultaneously with such a sustain discharge is radiated outside the display panel device through the front transparent substrate 10, whereby display light emissions in the number of times corresponding to the intensity weight of the subfield SF are done. Wall charges of negative polarity and wall charges of positive polarity are respectively formed in the vicinity of the row electrode Y and in the vicinities of the row electrode X and column electrode D within the pixel cell PC in which the sustain discharge has been induced in accordance with the sustain pulse IP finally impressed in the sustain step I of each of the subfields SF2-SF14. In addition, after the impression of such a final sustain pulse IP, the Y-electrode driver 53 impresses on the row electrodes $Y_1$-$Y_n$, a wall-charge adjustment pulse CP which has a peak potential of negative polarity and in which a potential transition at a leading edge with the lapse of time is gentle as shown in FIG. 28. In accordance with the impression of such a wall-charge adjustment pulse CP, a weak erase discharge is induced within the pixel cell PC in which the sustain discharge as stated above has been induced, and some of the wall charges having been formed therein are erased. Thus, the quantity of the wall charges within the pixel cell PC is adjusted into a quantity capable of properly inducing a selective erase address discharge in the next selective erase address step $W_D$.

In addition, after the end of the sustain step I of the final subfield SF14, the Y-electrode driver 53 impresses an erase pulse EP having a peak potential of negative polarity, on all the row electrodes $Y_1$-$Y_n$. In accordance with the impression of such an erase pulse EP, an erase discharge is induced only in the pixel cell PC being in the light-up mode state. Owing to such an erase discharge, the pixel cell PC having been in the light-up mode state is shifted into the state of the light-off mode.

The drive as described above is executed on the basis of the sixteen sorts of pixel drive data GD as shown in FIG. 26.

First of all, at a second gradation which represents an intensity that is one intensity level higher than a first gradation representing a black display (intensity level 0), the selective write address discharge for setting the pixel cell PC into the light-up mode is induced only in the subfield SF1 among the subfields SF1-SF14 as shown in FIG. 26, and the pixel cell PC set in the light-up mode is caused to generate the minute light emission discharge (indicated by a square). An intensity level at light emissions generated by the selective write address discharge and the minute light emission discharge is lower than an intensity level at a light emission generated by one time of sustain discharge. Therefore, in a case where the intensity level which is visually recognized by the sustain discharge is set at "1", the intensity corresponding to the intensity level "α" lower than the intensity level "1" is represented at the second gradation.

Subsequently, at a third gradation which represents an intensity that is one intensity level higher than such a second gradation, the selective write address discharge for setting the pixel cell PC into the light-up mode is induced only in the subfield SF2 among the subfields SF1-SF14 (indicated by a double circle), and the selective erase address discharge for shifting the pixel cell PC into the light-off mode is induced in the next subfield SF3 (indicated by a black circle). At the third gradation, therefore, a light emission generated by one time of sustain discharge is done only in the sustain step I of the subfield SF2 among the subfields SF1-SF14, and the intensity corresponding to the intensity level "1" is represented.

Subsequently, at a fourth gradation which represents an intensity that is one intensity level higher than such a third gradation, in the first subfield SF1, the selective write address discharge for setting the pixel cell PC into the light-up mode is induced, and the pixel cell PC set in the light-up mode is caused to generate the minute light emission discharge (indicated by the square). Further, at such a fourth gradation, the selective write address discharge for setting the pixel cell PC into the light-up mode is induced in only the subfield SF2 among the subfields SF1-SF14 (indicated by the double circle), and the selective erase address discharge for shifting the pixel cell PC into the light-off mode is induced in the next subfield SF3 (indicated by the black circle). At the fourth gradation, therefore, a light emission at the intensity level "α" is done in the subfield SF1, and the sustain discharge involving a light emission at the intensity level "1" is performed one time in the subfield SF2, so that the intensity corresponding to the intensity levels "α" and "1" is represented.

Besides, at each of the fifth gradation—sixteenth gradation, in the subfield SF1, the selective write address discharge for setting the pixel cell PC into the light-up mode is induced, and the pixel cell PC set in the light-up mode is caused to generate the minute light emission discharge (indicated by the square). In addition, the selective erase address discharge for shifting the pixel cell PC into the light-off mode is induced in only one subfield corresponding to the pertinent gradation (indicated by the black circle). At each of the fifth gradation—sixteenth gradation, therefore, the minute light emission discharge is induced in the subfield SF1, and one time of sustain discharge is induced in the subfield SF2, whereupon the sustain discharges in the number of times allotted to the subfields are induced in the subfields (indicated by white circles) continuous in the number of times corresponding to the pertinent gradation. Thus, an intensity which corresponds to the intensity level "α"+"the total number of the sustain discharges induced within the one-field (or one-frame) display period" is visually recognized in each of the fifth gradation—sixteenth gradation.

After all, according to the drive as shown in FIG. 26, the intensity range of the intensity level "0"-"255+α" can be represented by the sixteen levels as shown in FIG. 26.

According to such a drive, regions where light emission patterns (light-up state and extinction state) are inverted from each other within the one-field display period do not coexist within one screen, so that a pseudo contour appearing in such states is prevented.

Here, according to the drive shown in FIG. 28, in each of the first reset step R1 of the subfield SF1 and the second reset step R2 of the subfield SF2, the voltage with the column electrode D set as the cathode side and the row electrode Y set as the anode side is applied between both the electrodes, whereby the column side cathode discharge in which the current flows from the row electrode Y toward the column electrode D is induced as the first reset discharge. At such a first reset discharge, therefore, when the cations within the discharge gas migrate toward the column electrode D, they collide against the MgO crystals being the secondary electron emission material, which are contained in the fluorophor layer 17 as shown in FIG. 5, and they cause the MgO crystals to emit the secondary electrons therefrom. Especially, in the PDP 50 of the plasma display device shown in FIG. 1, the MgO crystals are exposed to the discharge space as shown in FIG. 5, whereby the probability of collisions with the cations is heightened so as to efficiently emit the secondary electrons into the discharge space. Then, the discharge initiation voltage of the pixel cell PC becomes low owing to the priming action based on such secondary electrons, and hence, a comparatively weak reset discharge can be induced. Consequently, owing to the weak reset discharge, a light emission intensity involved in the discharge lowers, so that a display in which a contrast in the case of displaying a dark image, namely, the so-called "dark contrast" is enhanced can be presented.

Further, according to the drive shown in FIG. 28, the first reset discharge is induced between the row electrode Y formed on the side of the front transparent substrate 10 and the column electrode D formed on the side of the rear substrate 14, as shown in FIG. 3. Therefore, the discharge light which is externally emitted from the side of the front transparent substrate 10 becomes less than in a case where the reset discharge is induced between the row electrodes X and Y both of which are formed on the side of the front transparent substrate 10, so that further enhancement in the dark contrast can be attained.

Besides, in the drive shown in FIGS. 26 to 28, in the head subfield SF1, the reset discharge for initializing all the pixel cells PC into the light-off mode states is induced, and thereafter, the selective write address discharge for shifting the pixel cells PC being in the light-off mode states, into the light-up mode states is induced. Besides, in one subfield among the subfields SF3-SF14 succeeding to the subfield SF2, the selective erase address method which induces the selective erase address discharge for shifting the pixel cell PC being in the light-up mode state, into the light-off mode state is adopted. Therefore, when the black display (intensity level "0") is presented by the drive conforming to the first gradation as shown in FIG. 26, the discharge induced throughout the one-field display period is only the reset discharge in the head subfield SF1. Accordingly, the number of times of discharges induced throughout the one-field display period becomes smaller than in case of adopting a drive in which, after the reset discharge for initializing all the pixel cells PC into the light-up mode states has been induced in the subfield SF1, the selective erase address discharge for shifting the pixel cells PC into the light-off mode states is induced, so that the dark contrast can be enhanced.

Besides, in the drive shown in FIGS. 26 to 28, in the subfield SF1 of the smallest intensity weight, the minute light emission discharge, not the sustain discharge, is induced as the discharge contributing to a display image. The minute light emission discharge is the discharge induced between the column electrode D and the row electrode Y, and hence, an intensity level at the light emission generated by the minute light emission discharge is lower than in the case of the sustain discharge induced between the row electrodes X and Y. Therefore, in a case where the intensity (second gradation) which is one intensity level higher than the black display (intensity level "0") is represented by such a minute light emission discharge, an intensity difference from the intensity level "0" becomes smaller than in a case where the second gradation is represented by the sustain discharge. Accordingly, a gradation representation capability in the case of representing a low intensity image is heightened. Besides, at the second gradation, the reset discharge is not induced in the second reset step R2 of the subfield SF2 succeeding to the subfield SF1, so that the lowering of the dark contrast as is incurred by the reset discharge is suppressed.

Besides, in the drive shown in FIG. 28, the peak potential of the reset pulse $RP1_{Y1}$ which is impressed on the row electrodes Y in order to induce the first reset discharges, in the first reset step R1 of the subfield SF1, is made lower than the peak potential of the reset pulse $RP2_{Y1}$ which is impressed on the row electrodes Y in order to induce the first reset discharges, in the second reset step R2 of the subfield SF2. Thus, in the first reset step R1 of the subfield SF1, light emissions in the case of simultaneously reset-discharging all the pixel cells PC are weakened, thereby to suppress the lowering of the dark contrast.

Besides, in the drive shown in FIGS. 26 to 28, in the sustain step I of the subfield SF2 whose intensity weight is the second smallest, the sustain discharges are induced only once, thereby to heighten the gradation representation capability in the case of representing a low intensity image. In the sustain step I of the subfield SF2, the sustain pulse IP for inducing the sustain discharges is impressed only once, so that the wall charges of negative polarity and the wall charges of positive polarity are respectively formed in the vicinities of the row electrodes Y and in the vicinities of the column electrodes D after the end of the sustain discharges induced in accordance with the sustain pulse IP impressed once. Thus, in the selective erase address step $W_D$ of the next subfield SF3, discharges with the column electrodes D as an anode side (hereinbelow, termed the "column side anode discharges") can be induced between the column electrodes D and the row electrodes Y as the selective erase address discharges. On the other hand, in the sustain step I of each of the succeeding subfields SF3-SF14, the number of times of the impressions of the sustain pulse IP is set at an even number. Therefore, immediately after the end of each sustain step I, the wall charges of negative polarity and the wall charges of positive polarity are respectively formed in the vicinities of the row electrodes Y and in the vicinities of the column electrodes D, so that the column side anode discharges are permitted in the selective erase address step $W_D$ which is performed subsequently to each sustain step I. Accordingly, the column electrodes D are merely impressed with the pulse of positive polarity, and increase in the cost of the address driver 55 is suppressed. Besides, in the PDP 50 shown in FIG. 1, the CL emission MgO crystals being the secondary electron emission material are contained, not only in the magnesium oxide layer 13 which is formed on the side of the front transparent substrate 10 within each pixel cell PC, but also in the fluorophor layer 17 which is formed on the side of the rear substrate 14.

Now, functional effects based on the adoption of such a configuration will be described with reference to FIGS. 29 and 30.

Figure 29:
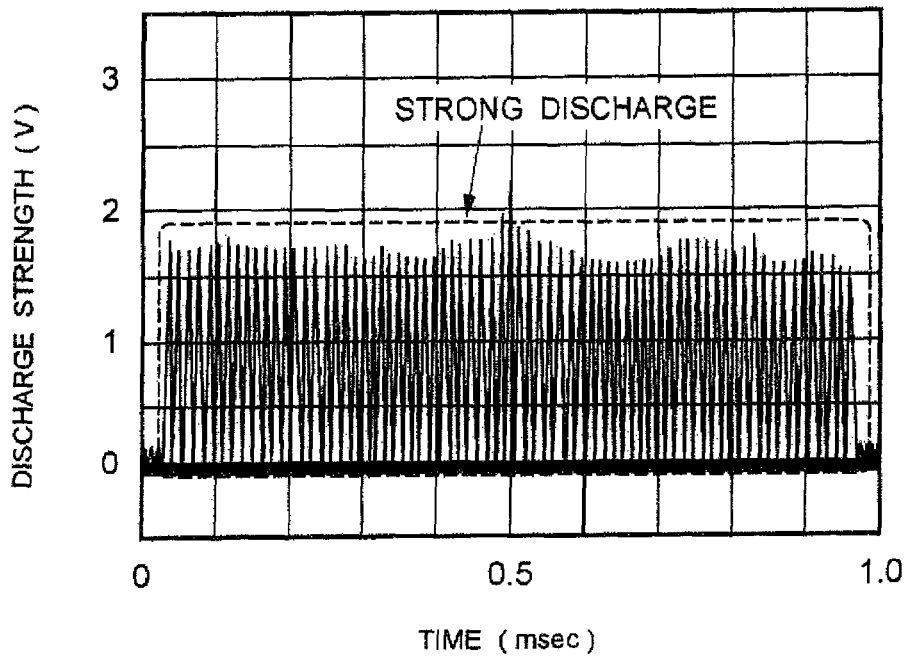
FIG. 29 is a graph showing the transition of a discharge strength in a column side cathode discharge which was induced in the case where a reset pulse $RP_{Y1}$ was impressed on a prior-art PDP wherein the CL emission MgO crystals were contained in only the magnesium oxide layer 13.

Incidentally, FIG. 29 is a graph showing the transition of a discharge strength in the column side cathode discharge which was induced in the case where the reset pulse $RP1_{Y1}$ or $RP2_{Y1}$ as shown in FIG. 28 was impressed on the so-called "prior-art PDP" wherein the CL emission MgO crystals were contained in only the magnesium oxide layer 13 in the magnesium oxide layer 13 and the fluorophor layer 17 as stated above.

Figure 30:
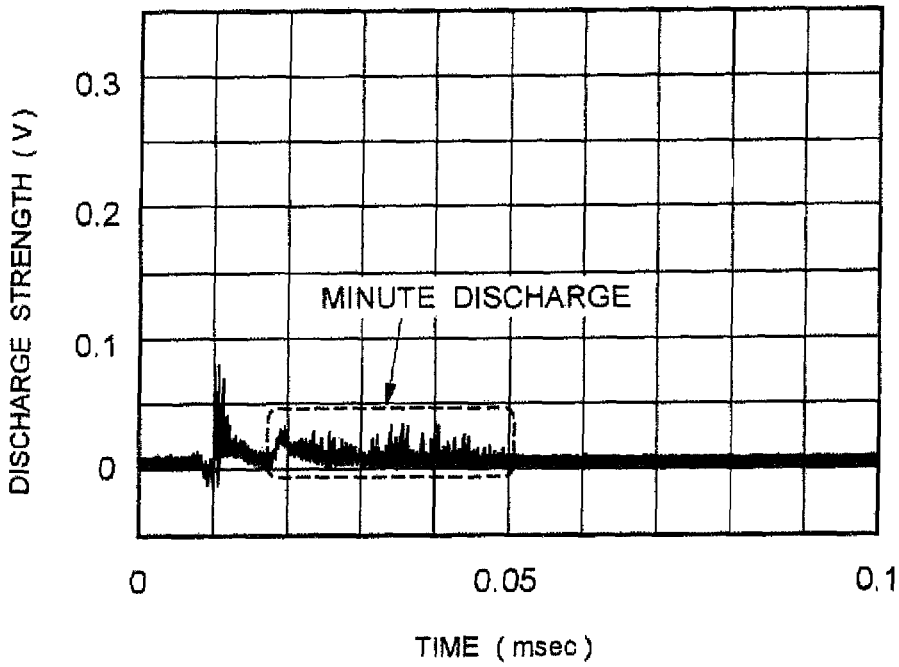
FIG. 30 is a graph showing the transition of a discharge strength in the column side cathode discharge which was induced in the case where the reset pulse $RP_{Y1}$, was impressed on the PDP 50 wherein the CL emission MgO crystals were contained in both the magnesium oxide layer 13 and the fluorophor layer 17.

On the other hand, FIG. 30 is a graph showing the transition of a discharge strength in the column side cathode discharge which was induced in the case where the reset pulse $RP1_{Y1}$ or $RP2_{Y1}$ was impressed on the PDP 50 according to the invention wherein the CL emission MgO crystals were contained in both the magnesium oxide layer 13 and the fluorophor layer 17.

As shown in FIG. 29, according to the prior-art PDP, the column side cathode discharge of comparatively high strengths continues over 1 [ms] in accordance with the impression of the reset pulse $RP1_{Y1}$ or $RP2_{Y1}$. In contrast, according to the PDP 50 of the invention, the column side cathode discharge ends within about 0.04 [ms] as shown in FIG. 30. That is, as compared with the prior-art PDP, the PDP 50 of the invention can sharply shorten a discharge delay time in the column side cathode discharge.

Accordingly, when the column side cathode discharge is induced by impressing the row electrode Y of the PDP 50 with the reset pulse $RP1_{Y1}$ or $RP2_{Y1}$ in the waveform in which the potential transition in the rise section is gentle as shown in FIG. 28, the discharge ends before the potential of the row electrode Y arrives at the peak potential of the pulse. Accordingly, the column side cathode discharge ends at a stage at which the voltage applied between the row electrode and the column electrode is low. As shown in FIG. 30, therefore, the discharge strength becomes much lower than in the case of FIG. 29.

That is, the reset pulse $RP1_{Y1}$ or $RP2_{Y1}$ as shown in FIG. 28, having the waveform in which the potential transition at the rise is gentle is impressed on the PDP 50 in which the CL emission MgO crystals are contained in both the magnesium oxide layer 13 and the fluorophor layer 17, thereby to induce the column side cathode discharge of low discharge strengths. Accordingly, the column side cathode discharge whose discharge strengths are very low in this manner can be induced as the reset discharge, so that the contrast of an image, especially the dark contrast in the case of displaying a dark image can be heightened.

Figure 31:
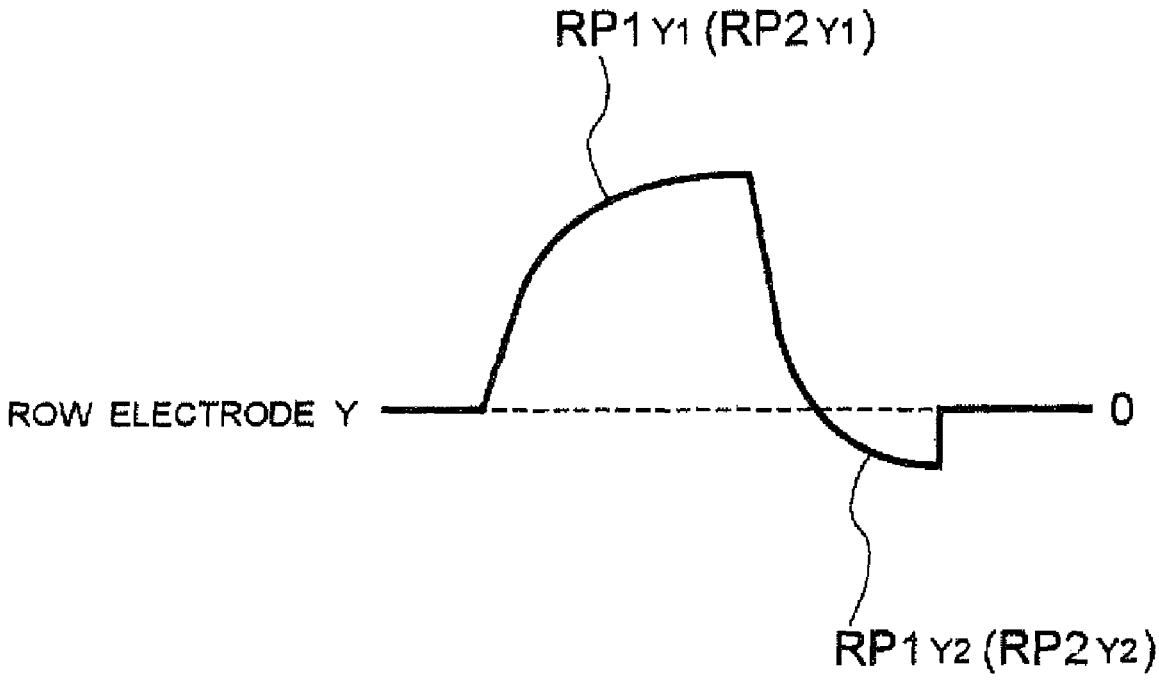
FIG. 31 is a diagram showing another waveform of the reset pulse $RP_{Y1}$ (or $RP_{Y2}$)

Incidentally, the waveform at the rise in the reset pulse $RP1_{Y1}$ or $RP2_{Y1}$ is not restricted to one of constant gradient as shown in FIG. 28, but it may well be, for example, one whose gradient gradually changes with the lapse of time as shown in FIG. 31.

Figure 32:
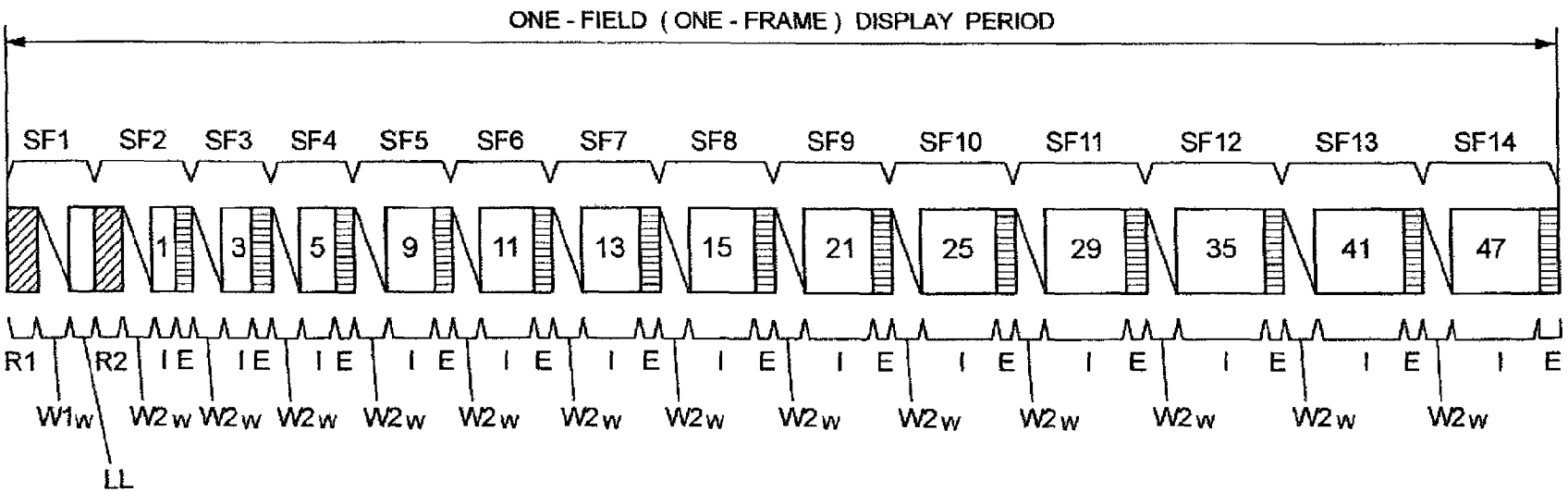
FIG. 32 is a diagram showing another example of a light emission drive sequence which is adopted in a plasma display device shown in FIG. 1.

Besides, in the embodiment, the PDP 50 is driven in accordance with the light emission drive sequence adopting the selective erase address method as shown in FIG. 27, but it may well be driven in accordance with a light emission drive sequence adopting a selective write address method as shown in FIG. 32.

More specifically, the drive control circuit 56 feeds the panel driver with various control signals for successively performing drives which conform to a first reset step R1, a first selective write address step $W1_W$ and a minute light emission step LL, respectively, in the head subfield SF1 of a one-field (-frame) display period as shown in FIG. 32. Besides, the drive control circuit 56 feeds the panel driver with various control signals for successively performing drives which conform to a second selective write address step $W2_W$, a sustain step I and an erase step E, respectively, in each of the subfields SF2-SF14 of the one-field display period. Further, the drive control circuit 56 feeds the panel driver with various control signals for successively performing drives conforming to a second reset step R2, in advance of the second selective write address step $W2_W$, in the subfield SF2.

Figure 33:
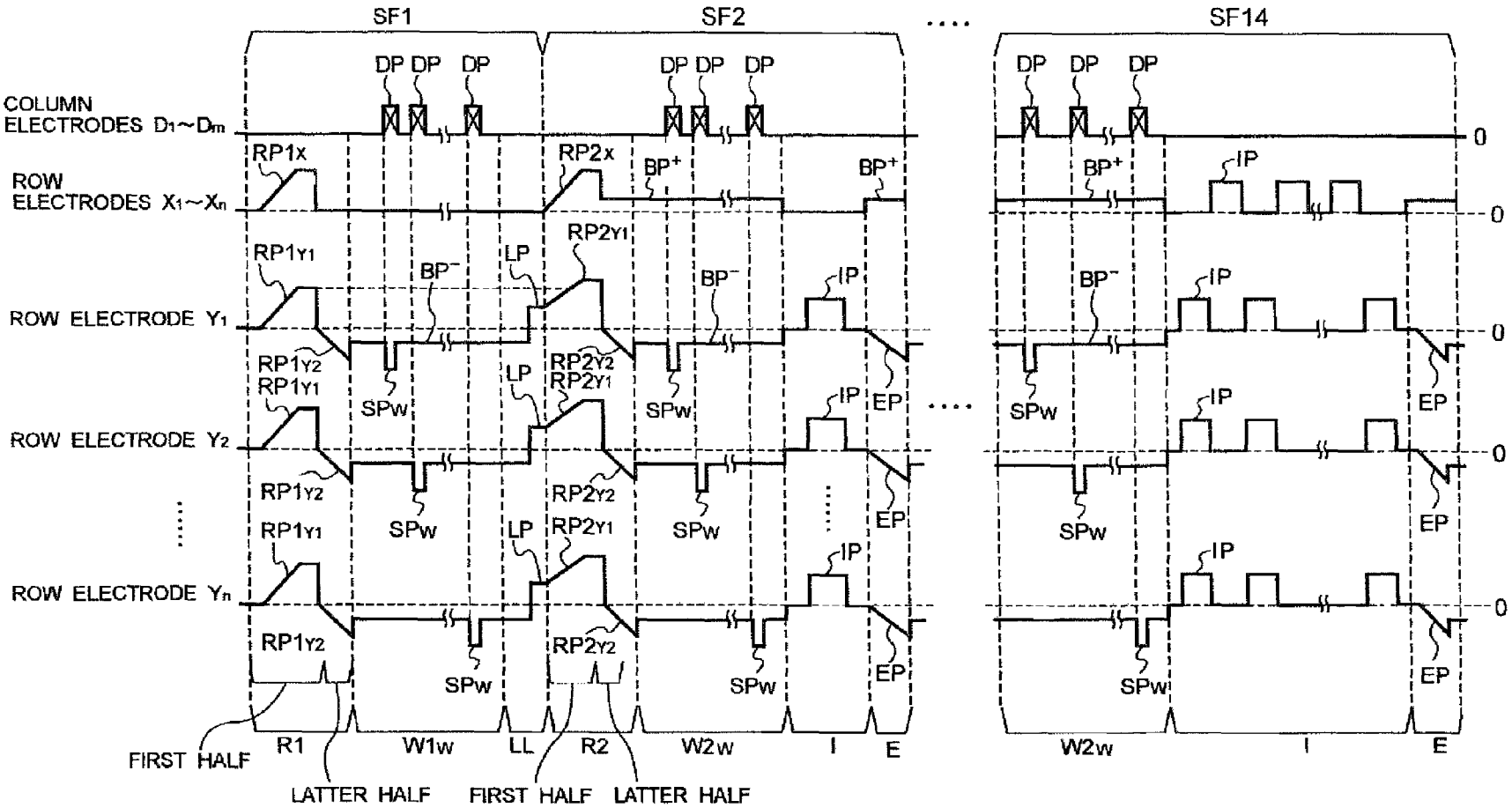
FIG. 33 is a diagram showing various drive pulses which are impressed on the PDP 50 in accordance with the light emission drive sequence shown in FIG. 32.

The panel driver, namely, the X-electrode driver 51, Y-electrode driver 53 and address driver 55 generate(s) various drive pulses as shown in FIG. 33, in accordance with the various control signals fed from the drive control circuit 56, so as to feed the generated pulses to the column electrodes D and row electrodes X and Y of the PDP 50.

In FIG. 33, only operations in the head subfield SF1, the succeeding subfield SF2 and the tailmost subfield SF14 among the subfields SF1-SF14 shown in FIG. 32 are extracted and illustrated. Besides, in FIG. 33, operations in the first reset step R1, first selective write address step $W1_W$ and minute light emission step LL of the subfield SF1 and an operation in the second reset step R2 of the subfield SF2 are respectively the same as shown in FIG. 28, and they shall therefore be omitted from description.

First of all, in the second selective write address step $W2_W$ of each of the subfields SF2-SF14, the Y-electrode driver 53 impresses a write scan pulse $SP_W$ having a peak potential of negative polarity, on the row electrodes $Y_1$-$Y_n$ successively and selectively, while impressing a base pulse $BP^-$ which has a predetermined base potential of negative polarity, on the row electrodes $Y_1$-$Y_n$ simultaneously. Meantime, the X-electrode driver 51 impresses a base pulse $BP^+$ which has a predetermined base potential of positive polarity, on the respective row electrodes $X_1$-$X_n$. Incidentally, the potential of each of the base pulses $BP^-$ and $BP^+$ is set at a potential with which the voltage between the row electrodes X and Y during the non-impression period of the write scan pulse $SP_W$ becomes lower than the discharge initiation voltage of the pixel cells PC. Further, in the second selective address step $W2_W$, the address driver 55 first converts a pixel drive data bit corresponding to each of the subfields (SF2-SF14), into a pixel data pulse DP whose pulse voltage corresponds to the logic level of the data bit. By way of example, in a case where the address driver 55 has been fed with the pixel drive data bit of logic level "1" for setting the pixel cell PC into the light-up mode, it converts the data bit into the pixel data pulse DP having a peak potential of positive polarity. On the other hand, the pixel drive data bit of logic level "0" for setting the pixel cell PC into the light-off mode is converted into the pixel data pulse DP of low voltage (0 volt). In addition, the address driver 55 impresses such pixel data pulses DP on the column electrodes $D_1$-$D_m$ in synchronism with the impression timing of each write scan pulse $SP_W$ every display line (numbering m pulses). Simultaneously with the write scan pulse $SP_W$, a selective write address discharge is induced between the column electrode D and the row electrode Y within the pixel cell PC which has been impressed with the pixel data pulse DP of high voltage and which is to be set into the light-up mode. Further, immediately after such a selective write address discharge, a weak discharge is induced also between the row electrodes X and Y within the pixel cell PC. More specifically, after the write scan pulse $SP_W$ has been impressed, voltages corresponding to the base pulses $BP^-$ and $BP^+$ are applied between the row electrodes X and Y. Since, however, the voltages are set to be lower than the discharge initiation voltage of each pixel cell PC, any discharge is not generated within the pixel cell PC merely by the applications of such voltages. In contrast, when the selective write address discharge is generated, a discharge is generated between the row electrodes X and Y merely by the voltage applications based on the base pulses $BP^-$ and $BP^+$, by being induced by the selective write address discharge. Such a discharge is not generated in the first selective write address step $W1_W$ in which the base pulse $BP^+$ is not impressed on the row electrode X. Owing to such a discharge and the selective write address discharge, the pixel cell PC is set into a state where wall charges of positive polarity, wall charges of negative polarity and wall charges of negative polarity are respectively formed in the vicinity of the row electrode Y, in the vicinity of the row electrode X and in the vicinity of the column electrode D, that is, into the light-up mode. On the other hand, the selective write address discharge as stated above is not generated between the column electrode D and the row electrode Y within the pixel cell PC on which the pixel data pulse DP of low voltage (0 volt) for setting the light-off mode has been impressed simultaneously with the write scan pulse $SP_W$. Therefore, any discharge is not generated even between the row electrodes X and Y. Consequently, the pixel cell PC keeps its state immediately before (light-off mode or light-up mode).

Subsequently, in the sustain step I of the subfield SF2, the Y-electrode driver 53 generates one pulse of the sustain pulse IP having a peak potential of positive polarity, and it impresses the pulse on the row electrodes $Y_1$-$Y_n$ simultaneously. Meantime, the X-electrode driver 51 sets the row electrodes $X_1$-$X_n$ into states of ground potential (0 volt), and the address driver 55 sets the column electrodes $D_1$-$D_m$ into states of the ground potential (0 volt). In accordance with the impression of the sustain pulse IP, a sustain discharge is generated between the row electrodes X and Y within the pixel cell PC set in the light-up mode. Light radiated from the fluorophor layer 17 simultaneously with such a sustain discharge is radiated outside the display panel device through the front transparent substrate 10, whereby one time of display light emission corresponding to the intensity weight of the subfield SF2 is done. Besides, in accordance with the impression of such a sustain pulse IP, a discharge is generated also between the row electrode Y and the column electrode D within the pixel cell PC set in the light-up mode. Owing to such a discharge and the sustain discharge, wall charges of negative polarity are formed in the vicinity of the row electrode Y within the pixel cell PC, and wall charges of positive polarity are respectively formed in the vicinities of the row electrode X and the column electrode D.

Subsequently, in the erase step E of each of the subfields SF2-SF14, the Y-electrode driver 53 impresses on the row electrodes $Y_1$-$Y_n$, an erase pulse EP of negative polarity which has the same waveform as that of a reset pulse $RP2_{Y2}$ impressed in the latter half part of the first reset step R1 or the second reset step R2. Meantime, the X-electrode driver 51 impresses the base pulse $BP^+$ having the predetermined base potential of the positive polarity, on all the row electrodes $X_1$-$X_n$ in the same manner as in the latter half part of the second reset step R2. In accordance with the erase pulse EP and the base pulse $BP^+$ as stated above, a weak erase discharge is generated within the pixel cell PC in which the sustain discharge as stated above has been induced. Owing to such an erase discharge, some of the wall charges having been formed within the pixel cell PC are erased, and the pixel cell PC is shifted into a light-off mode state. Further, in accordance with the impression of the erase pulse EP, a weak discharge is generated also between the column electrode D and the row electrode Y within the pixel cell PC. Owing to such a discharge, some of the wall charges of positive polarity having been formed in the vicinity of the column electrode D are erased, and the wall charges are adjusted into a quantity in which a selective write address discharge can be properly induced in the second selective write address step $W2_W$. In each of the subfields SF3-SF14, the second selective write address step $W2_W$ is performed instead of the selective erase address step $W_D$.

Subsequently, in the sustain step I of each of the subfields SF3-SF14, the X-electrode driver 51 and the Y-electrode driver 53 impress a sustain pulse IP having a peak potential of positive polarity, on the row electrodes $Y_1$-$Y_n$ and $X_1$-$X_n$, alternately on the row electrodes Y and X and repeatedly the number of times (even number of times) corresponding to the intensity weight of the pertinent subfield, as shown in FIG. 33. Each time such a sustain pulse IP is impressed, a sustain discharge is induced between the row electrodes X and Y within the pixel cell PC set in the light-up mode. Light radiated from the fluorophor layer 17 simultaneously with such a sustain discharge is radiated outside the display panel device through the front transparent substrate 10, whereby display light emissions in the number of times corresponding to the intensity weight of the pertinent subfield SF are done. Incidentally, the total number of the sustain pulses IP which are impressed in each sustain step I is odd. More specifically, in each sustain step I, both the head sustain pulse IP and the final sustain pulse IP are impressed on the row electrodes Y. Therefore, immediately after the end of each sustain step I, wall charges of negative polarity and wall charges of positive polarity are respectively formed in the vicinities of the row electrodes Y and in the vicinities of the row electrodes X and column electrodes D within the pixel cells PC in which the sustain discharges have been induced. Thus, wall charge formation states within the respective pixel cells PC become the same as those immediately after the end of the first reset discharges in the first reset step R1 or the second reset step R2. Accordingly, the erase pulse EP which has the same waveform as that of a reset pulse $RP1_{Y2}$ or the reset pulse $RP2_{Y2}$ impressed in the latter half part of the first reset step R1 or the second reset step R2 is impressed on the row electrodes Y in the erase step E which succeeds immediately, whereby the states of all the pixel cells PC can be shifted into the states of the light-off mode.

Here, on the basis of the drive shown in FIGS. 32 and 33, at a second gradation which represents an intensity that is one intensity level higher than a first gradation representing a black display (intensity level 0), the selective write address discharge is induced only in the subfield SF1 among the subfields SF1-SF14. Thus, a minute light emission discharge is induced as a discharge pertinent to a display image, only in the subfield SF1 among the subfields SF1-SF14. Besides, at a third gradation which represents an intensity that is one intensity level higher than such a second gradation, the selective write address discharge is induced only in the subfield SF2 among the subfields SF1-SF14. Thus, one time of sustain discharge is induced as a discharge pertinent to the display image, only in the subfield SF2 among the subfields SF1-SF14. In addition, at each of a fourth gradation, et seq., selective write addresses are generated in the respective subfields SF1 and SF2, and further, selective write addresses are generated in the respective subfields which are continuous in a number corresponding to the pertinent gradation. Thus, as discharges pertinent to the display image, the minute light emission discharge is first induced in the subfield SF1, and the sustain discharges are thereafter induced in the respective subfields which are continuous in the number corresponding to the pertinent gradation.

According to such a drive, intermediate intensity displays for (N+1) gradations (N: the number of subfields within the one-field display period) are permitted in the same manner as in FIG. 26.

On the other hand, intermediate intensities for $2_N$ gradations (N: the number of subfields within the one-field display period) can also be represented on the basis of the drive shown in FIGS. 32 and 33, and depending upon how to combine the subfields for inducing the selective write address discharges within the one-field display period. That is, according to the fourteen subfields SF1-SF14, the combinational patterns of the subfields for inducing the selective write address discharges exist in the number of $2^{14}$, and hence, intermediate intensity displays for 16384 gradations are permitted.

According to the drive shown in FIG. 33, the reset pulse $RP1_{Y2}$ or $RP2_{Y2}$ which is impressed on the row electrodes Y in the first reset step R1 or the second reset step R2, and the erase pulse EP which is impressed on the row electrodes Y in the erase step E have the same waveform, so that both the pulses can be generated by a common circuit. Further, only the selective write address steps ($W1_W$ and $W2_W$) are adopted as methods for setting the states (light-up mode and light-off mode) of the pixel cells PC in the respective subfields SF1-SF14, so that one system suffices for a circuit which generates scan pulses. In such a selective write address step, a general column-side anode discharge in which a column electrode side is set as an anode is induced.

Therefore, in the case where the drive as shown in FIGS. 32 and 33 has been adopted in driving the PDP 50, the panel driver for generating the various drive pulses can be built less expensively than in the case where the drive as shown in FIGS. 27 and 28 has been adopted.

Figure 34:
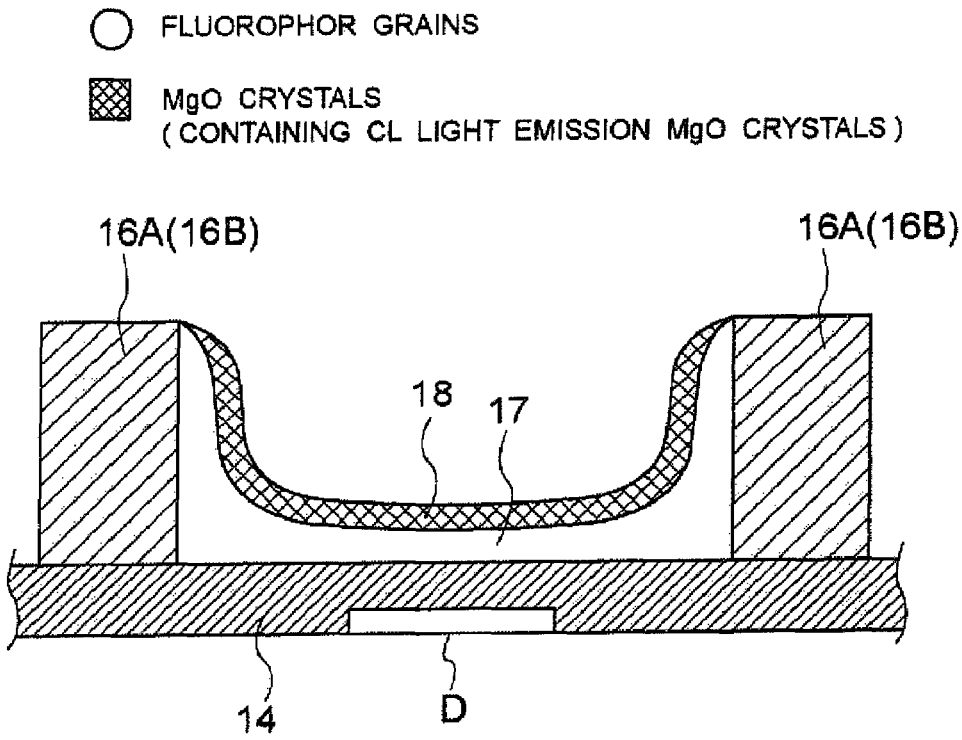
FIG. 34 is a view schematically showing an aspect in the case where a secondary electron emission layer 18 is stacked and built on the surface of the fluorophor layer 17.

In the embodiment shown in FIG. 5, the MgO crystals are contained in the fluorophor layer 17 which is disposed on the side of the rear substrate 14 of the PDP 50. As shown in FIG. 34, however, a secondary electron emission layer 18 made of a secondary electron emission material may well be disposed so as to cover the surface of the fluorophor layer 17. The secondary electron emission layer 18 may well be formed in such a way that crystals made of the secondary electron emission material (for example, MgO crystals containing CL emission MgO crystals) are spread all over the surface of the fluorophor layer 17, or that the secondary electron emission material is formed into a thin film.

Figure 35:
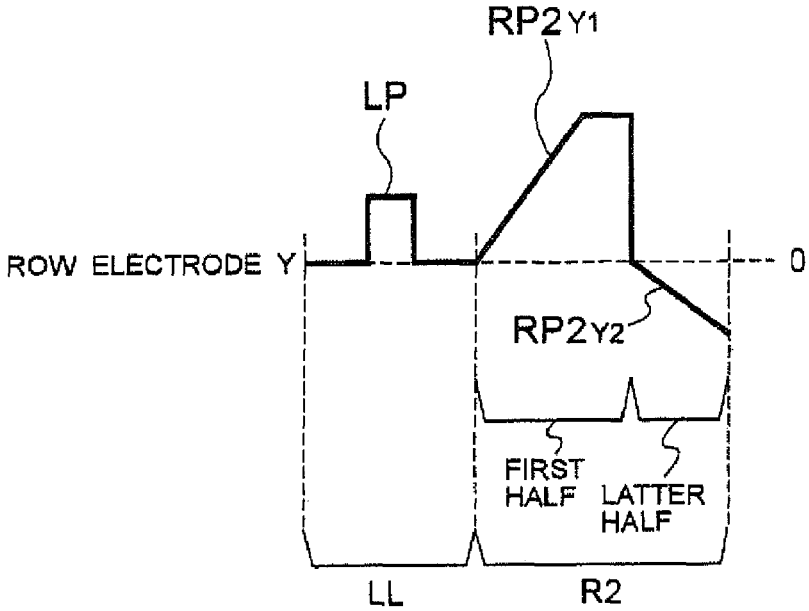
FIG. 35 is a diagram showing another example of the impression timings of a minute light emission pulse LP and the reset pulse $RP_{Y2}$.

Besides, in the embodiments shown in FIG. 28 and FIG. 33, the minute light emission pulse LP and the reset pulse $RP2_{Y1}$ are impressed on the row electrodes Y in joined fashion, but both the pulses may well be successively impressed on the row electrodes Y in temporally spaced fashion, as shown in FIG. 35.

Besides, in the foregoing embodiments, the reset steps (R1 and R2) and the selective write address steps ($W1_W$ and $W2_W$) are successively executed in only the head subfield SF1 and the second subfield SF2, but these series of operations may well be similarly executed in the third subfield, et seq.

Besides, in the foregoing embodiments, only in the head subfield SF1, the minute light emission step LL is performed instead of the sustain step I, as the step for generating the light emission pertinent to the display image. However, the minute light emission step(s) LL may well be executed instead of the sustain step I, in any subfield other than the head subfield, or in a plurality of subfields including the head subfield.

Besides, in the reset step R shown in FIG. 28 or FIG. 33, the reset discharges are induced simultaneously for all the pixel cells, but reset discharges may well be performed in temporally spaced fashion, for respective pixel cell blocks each consisting of a plurality of pixel cells.

In another embodiment, a drive control circuit 56 converts the upper 4 bits of dither addition pixel data, into multi-gradation pixel data PDs of 4 bits as represent any intensity level by 15 gradations as shown in FIG. 36. Besides, the drive control circuit 56 converts the multi-gradation pixel data PDs into pixel drive data GD of 14 bits in accordance with a data conversion table as shown in FIG. 36. The drive control circuit 56 causes first—fourteenth bits in such pixel drive data GD to correspond to subfields SF1-SF14 (to be stated later), respectively, and it feeds bit places corresponding to the subfields SF, to an address driver 55 every display line (numbering m bit places) as pixel drive data bits.

Figure 37:
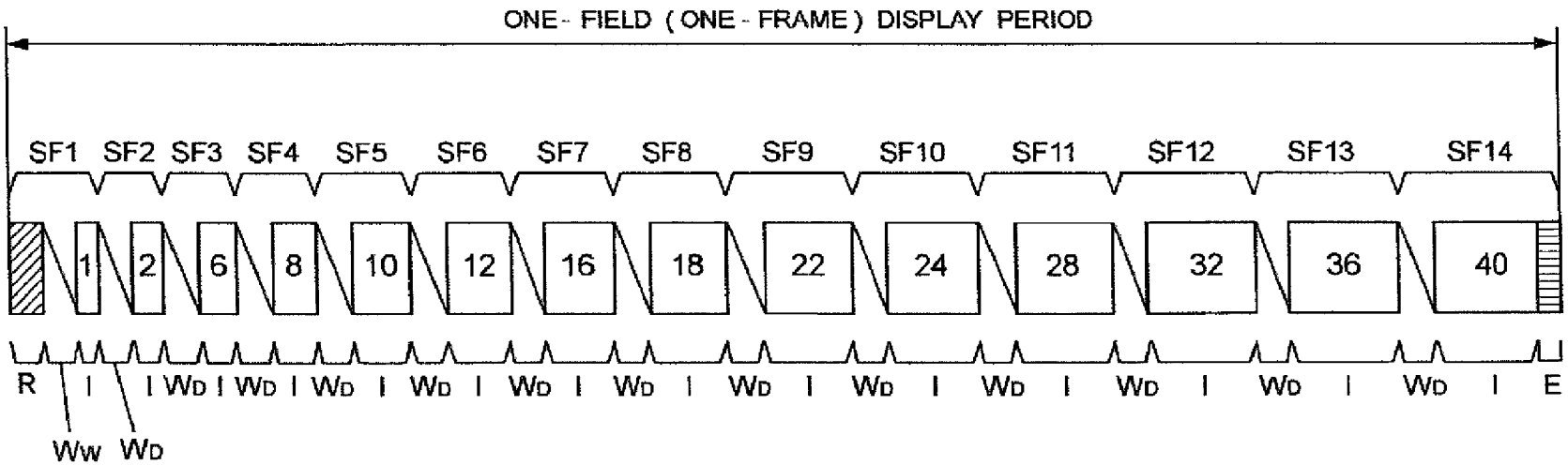
FIG. 37 is a diagram showing another example of a light emission drive sequence which is adopted in the plasma display device shown in FIG. 1.

Further, the drive control circuit 56 feeds various control signals for driving the PDP 50 of the above structure in accordance with a light emission drive sequence as shown in FIG. 37, to a panel driver which consists of an X-electrode driver 51, a Y-electrode driver 53 and the address driver 55. More specifically, in the head subfield SF1 within a one-field (one-frame) display period as shown in FIG. 37, the drive control circuit 56 feeds the panel driver with various control signals for successively performing drives which conform respectively to a reset step R, a selective write address step $W_W$ and a sustain step I. Besides, in each of the subfields SF2-SF14, the drive control circuit 56 feeds the panel driver with various control signals for successively performing drives which conform respectively to a selective erase address step $W_D$ and the sustain step I. Incidentally, only in the tailmost subfield SF14 within the one-field display period and after the execution of the sustain step I, the drive control circuit 56 feeds the panel driver with various control signals for successively performing drives which conform respectively to an erase step E. That is, this embodiment has a configuration which does not include the minute light emission discharge of the embodiment shown in FIG. 26.

Figure 38:
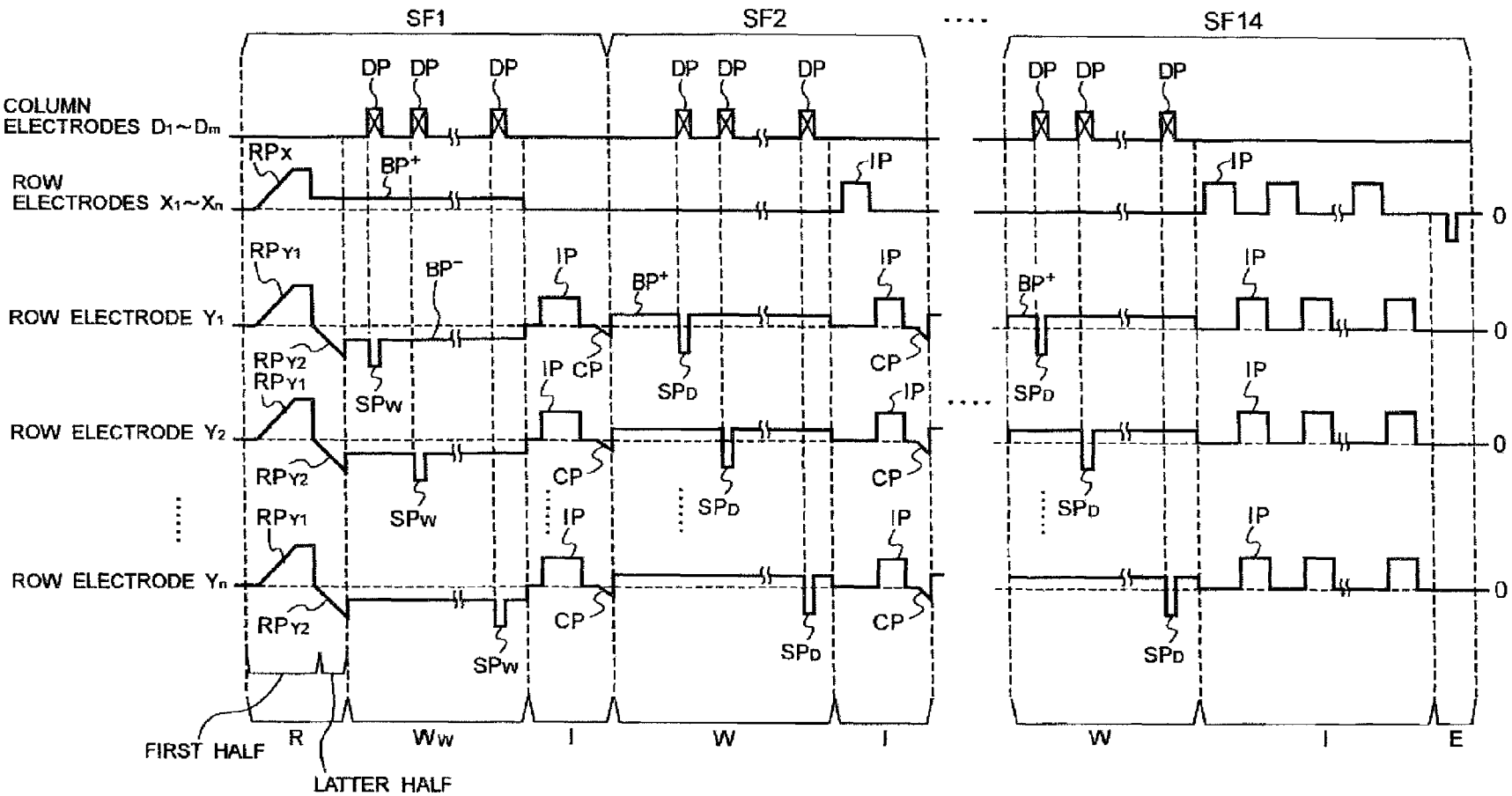
FIG. 38 is a diagram showing various drive pulses which are impressed on the PDP 50 in accordance with the light emission drive sequence shown in FIG. 37.

The panel driver, namely, the X-electrode driver 51, Y-electrode driver 53 and address driver 55 generate(s) various drive pulses as shown in FIG. 38 and feed(s) the drive pulses to the column electrodes D and the row electrodes X and Y of a PDP 50, in accordance with the various control signals fed from the drive control circuit 56.

In FIG. 38, only operations in the head subfield SF1, the subfield SF2 succeeding thereto, and the tailmost subfield SF14 among the subfields SF1-SF14 shown in FIG. 37 are extracted and illustrated.

First of all, in the first half part of the reset step R of the subfield SF1, the Y-electrode driver 53 impresses on all the row electrodes $Y_1$-$Y_n$, a reset pulse $RP_{Y1}$ of positive polarity in a waveform in which a potential transition at a leading edge with the lapse of time is gentler than in a sustain pulse to be stated later. Incidentally, the peak potential of the reset pulse $RP_{Y1}$ is higher than that of the sustain pulse. Besides, meantime, the address driver 55 sets the column electrodes $D_1$-$D_m$ in the state of ground potential (0 volt). First reset discharges are induced between the row electrodes Y and the column electrodes D within all the pixel cells PC, in accordance with the impression of the reset pulse $RP_{Y1}$. That is, in the first half part of the reset step R, a voltage is applied between the row electrodes Y and the column electrodes D with the former electrodes Y held as an anode side and the latter electrodes D held as a cathode side, whereby discharges in which currents flow from the row electrodes Y toward the column electrodes D (hereinbelow, termed the "column side cathode discharges") are induced as the first reset discharges. In accordance with such first reset discharges, wall charges of negative polarity and wall charges of positive polarity are respectively formed in the vicinities of the row electrodes Y and in the vicinities of the column electrodes D within all the pixel cells PC.

Besides, in the first half part of the reset step R, the X-electrode driver 51 impresses on all the row electrodes $X_1$-$X_n$, a reset pulse $RP_X$ which is identical in polarity to such a reset pulse $RP_{Y1}$ and which has a peak potential capable of preventing surface charges between the row electrodes X and Y attendant upon the impression of the impression of the reset pulse $RP_{Y1}$.

Subsequently, in the latter half part of the reset step R of the subfield SF1, the Y-electrode driver 53 generates a reset pulse $RP_{Y2}$ of negative polarity in which a potential transition at a leading edge with the lapse of time is gentle, and it impresses the reset pulse $RP_{Y2}$ on all the row electrodes $Y_1$-$Y_n$. Further, in the latter half part of the reset step R, the X-electrode driver 51 impresses a base pulse $BP^+$ which has a predetermined base potential of positive polarity, on all the row electrodes $X_1$-$X_n$. In accordance with the impressions of the reset pulse $RP_{Y2}$ of the negative polarity and the base pulse $BP^+$ of the positive polarity, second reset discharges are induced between the row electrodes X and Y within all the pixel cells PC. Incidentally, the peak potential of each of the reset pulse $RP_{Y2}$ and the base pulse $BP^+$ is the lowest potential which can reliably induce the second reset discharges between the row electrodes X and Y, in consideration of the wall charges which have been formed in the vicinities of the respective row electrodes X and Y in accordance with the first reset discharges. Besides, a negative peak potential in the reset pulse $RP_{Y2}$ is set at a potential which is higher than the peak potential of a write scan pulse $SP_W$ of negative polarity to be stated later, that is, at a potential which is near 0 volt. The reason therefor is that, when the peak potential of the reset pulse $RP_{Y2}$ is made lower than that of the write scan pulse $SP_W$, strong discharges are induced between the row electrodes Y and the column electrodes D, to sharply erase the wall charges having been formed in the vicinities of the column electrodes D, so address discharges in a selective write address step $W_W$ become unstable. Owing to the second reset discharges induced in the latter half part of the reset step R, the wall charges having been formed in the vicinities of the row electrodes X and Y within the respective pixel cells PC are erased, whereby all the pixel cells PC are initialized into a light-off mode. Further, weak discharges are induced also between the row electrodes Y and the column electrodes D within all the pixel cells PC, in accordance with the impression of the reset pulse $RP_{Y2}$. Owing to such discharges, some of the wall charges of positive polarity having been formed in the vicinities of the column electrodes D are erased, and the wall charges are adjusted into quantities in which selective write address discharges can be properly induced in the selective write address step $W_W$ to be stated later.

Subsequently, in the selective write address step $W_W$ of the subfield SF1, the Y-electrode driver 53 impresses the write scan pulse $SP_W$ having the peak potential of negative polarity, on the row electrodes $Y_1$-$Y_n$ successively and selectively, while impressing a base pulse $BP^-$ which has a predetermined base potential of negative polarity as shown in FIG. 38, on the row electrodes $Y_1$-$Y_n$ simultaneously. The X-electrode driver 51 impresses the base pulse $BP^+$ having been impressed on the row electrodes $X_1$-$X_n$ in the latter half part of the reset step R, on the respective row electrodes $X_1$-$X_n$ continuously also in the selective write address step $W_W$. Incidentally, the potential of each of the base pulses $BP^-$ and $BP^+$ is set at a potential with which the voltage between the row electrodes X and Y during the non-impression period of the write scan pulse $SP_W$ becomes lower than the discharge initiation voltage of the pixel cells PC.

Further, in the selective write address step $W_W$, the address driver 55 first converts a pixel drive data bit corresponding to the subfield SF1, into a pixel data pulse DP whose pulse voltage corresponds to the logic level of the data bit. By way of example, in a case where the address driver 55 has been fed with the pixel drive data bit of logic level "1" for setting the pixel cell PC into the light-up mode, it converts the data bit into the pixel data pulse DP having a peak potential of positive polarity. On the other hand, the pixel drive data bit of logic level "0" for setting the pixel cell PC into the light-off mode is converted into the pixel data pulse DP of low voltage (0 volt). In addition, the address driver 55 impresses such pixel data pulses DP on the column electrodes $D_1$-$D_m$ in synchronism with the impression timing of each write scan pulse $SP_W$ every display line (numbering m pulses). Simultaneously with the write scan pulse $SP_W$, a selective write address discharge is induced between the column electrode D and the row electrode Y within the pixel cell PC which has been impressed with the pixel data pulse DP of high voltage and which is to be set into the light-up mode. Further, immediately after such a selective write address discharge, a weak discharge is induced also between the row electrodes X and Y within the pixel cell PC. More specifically, after the write scan pulse $SP_W$ has been impressed, voltages corresponding to the base pulses $BP^-$ and $BP^+$ are applied between the row electrodes X and Y. Since, however, the voltages are set to be lower than the discharge initiation voltage of each pixel cell PC, any discharge is not generated within the pixel cell PC merely by the applications of such voltages. In contrast, when the selective write address discharge is generated, a discharge is generated between the row electrodes X and Y merely by the voltage applications based on the base pulses $BP^-$ and $BP^+$, by being induced by the selective write address discharge. Owing to such a discharge and the selective write address discharge, the pixel cell PC is set into a state where wall charges of positive polarity, wall charges of negative polarity and wall charges of negative polarity are respectively formed in the vicinity of the row electrode Y, in the vicinity of the row electrode X and in the vicinity of the column electrode D, that is, into the light-up mode. On the other hand, the selective write address discharge as stated above is not generated between the column electrode D and the row electrode Y within the pixel cell PC on which the pixel data pulse DP of low voltage (0 volt) for setting the light-off mode has been impressed simultaneously with the write scan pulse $SP_W$. Therefore, any discharge is not generated even between the row electrodes X and Y. Consequently, the pixel cell PC keeps its state immediately before, namely, the state of the light-off mode into which it has been initialized in the reset step R.

Subsequently, in the sustain step I of the subfield SF1, the Y-electrode driver 53 generates one pulse of the sustain pulse IP having a peak potential of positive polarity, and it impresses the pulse on the row electrodes $Y_1$-$Y_n$ simultaneously. Meantime, the X-electrode driver 51 sets the row electrodes $X_1$-$X_n$ into states of ground potential (0 volt), and the address driver 55 sets the column electrodes $D_1$-$D_m$ into states of the ground potential (0 volt). In accordance with the impression of the sustain pulse IP, a sustain discharge is generated between the row electrodes X and Y within the pixel cell PC set in the light-up mode as stated above. Light radiated from a fluorophor layer 17 simultaneously with such a sustain discharge is radiated outside the display panel device through a front transparent substrate 10, whereby one time of display light emission corresponding to the intensity weight of the subfield SF1 is done. Besides, in accordance with the impression of such a sustain pulse IP, a discharge is generated also between the row electrode Y and the column electrode D within the pixel cell PC set in the light-up mode. Owing to such a discharge and the sustain discharge, wall charges of negative polarity are formed in the vicinity of the row electrode Y within the pixel cell PC, and wall charges of positive polarity are respectively formed in the vicinities of the row electrode X and the column electrode D. In addition, after the impression of such a sustain pulse IP, the Y-electrode driver 53 impresses on the row electrodes $Y_1$-$Y_n$, a wall-charge adjustment pulse CP which has a peak potential of negative polarity and in which a potential transition at a leading edge with the lapse of time is gentle as shown in FIG. 38. In accordance with the impression of such a wall-charge adjustment pulse CP, a weak erase discharge is induced within the pixel cell PC in which the sustain discharge as stated above has been generated, and some of the wall charges having been formed therein are erased. Thus, the quantity of the wall charges within the pixel cell PC is adjusted into a quantity capable of properly inducing a selective erase address discharge in the next selective erase address step $W_D$.

Subsequently, in the selective erase address step $W_O$ of each of the subfields SF2-SF14, the Y-electrode driver 53 impresses an erase scan pulse $SP_D$ having a peak potential of negative polarity as shown in FIG. 38, on the row electrodes $Y_1$-$Y_n$ successively and selectively, while impressing the base pulse $BP^+$ having the predetermined base potential of positive polarity, on the respective row electrodes $Y_1$-$Y_n$. Incidentally, the peak potential of the base pulse $BP^+$ is set at a potential capable of preventing erroneous discharges between the row electrodes X and Y, throughout the execution period of the selective erase address step $W_O$. Besides, the X-electrode driver 51 sets the respective row electrodes $X_1$-$X_n$ at the ground potential (0 volt) throughout the execution period of the selective erase address step $W_O$. Further, in the selective erase address step $W_D$, the address driver 55 first converts a pixel drive data bit corresponding to the pertinent subfield SF, into a pixel data pulse DP whose pulse voltage corresponds to the logic level of the data bit. By way of example, in a case where the address driver 55 has been fed with the pixel drive data bit of logic level "1" for shifting the pixel cell PC from the light-up mode into the light-off mode, it converts the data bit into the pixel data pulse DP having a peak potential of positive polarity. On the other hand, in a case where the address driver 55 has been fed with the pixel drive data bit of logic level "0" for keeping the current state of the pixel cell PC, it converts the data bit into the pixel data pulse DP of low voltage (0 volt). In addition, the address driver 55 impresses such pixel data pulses DP on the column electrodes $D_1$-$D_m$ in synchronism with the impression timing of each erase scan pulse $SP_D$ every display line (numbering m pulses). Simultaneously with the erase scan pulse $SP_D$, a selective erase address discharge is induced between the column electrode D and the row electrode Y within the pixel cell PC which has been impressed with the pixel data pulse DP of high voltage. Owing to such a selective erase address discharge, the pixel cell PC is set into a state where wall charges of positive polarity and wall charges of negative polarity are respectively formed in the vicinities of the row electrodes Y and X and in the vicinity of the column electrode D, that is, into the light-off mode. On the other hand, the selective erase address discharge as stated above is not induced between the column electrode D and the row electrode Y within the pixel cell PC on which the pixel data pulse DP of the low voltage (0 volt) has been impressed simultaneously with the erase scan pulse $SP_D$. Consequently, the pixel cell PC keeps its state immediately before (light-up mode or light-off mode).

Subsequently, in the sustain step I of each of the subfields SF2-SF14, the X-electrode driver 51 and the Y-electrode driver 53 impress a sustain pulse IP having a peak potential of positive polarity, on the row electrodes $X_1$-$X_n$ and $Y_1$-$Y_n$, alternately on the row electrodes X and Y and repeatedly the number of times (even number of times) corresponding to the intensity weight of the pertinent subfield, as shown in FIG. 38. Each time such a sustain pulse IP is impressed, a sustain discharge is induced between the row electrodes X and Y within the pixel cell PC set in the light-up mode. Light radiated from the fluorophor layer 17 simultaneously with such a sustain discharge is radiated outside the display panel device through the front transparent substrate 10, whereby display light emissions in the number of times corresponding to the intensity weight of the pertinent subfield SF are done. Wall charges of negative polarity and wall charges of positive polarity are respectively formed in the vicinity of the row electrode Y and in the vicinities of the row electrode X and column electrode D within the pixel cell PC in which the sustain discharge has been induced in accordance with the sustain pulse IP finally impressed in the sustain step I of each of the subfields SF2-SF14. In addition, after the impression of such a final sustain pulse IP, the Y-electrode driver 53 impresses on the row electrodes $Y_1$-$Y_n$, a wall-charge adjustment pulse CP which has a peak potential of negative polarity and in which a potential transition at a leading edge with the lapse of time is gentle as shown in FIG. 38. In accordance with the impression of such a wall-charge adjustment pulse CP, a weak erase discharge is induced within the pixel cell PC in which the sustain discharge as stated above has been induced, and some of the wall charges having been formed therein are erased. Thus, the quantity of the wall charges within the pixel cell PC is adjusted into a quantity capable of properly inducing a selective erase address discharge in the next selective erase address step $W_D$. In addition, at the end of the final subfield SF14, the Y-electrode driver 53 impresses an erase pulse EP having a peak potential of negative polarity, on all the row electrodes $Y_1$-$Y_n$. In accordance with the impression of such an erase pulse EP, an erase discharge is induced only in the pixel cell PC being in the light-up mode state. Owing to such an erase discharge, the pixel cell PC having been in the light-up mode state is shifted into the state of the light-off mode.

The drive as described above is executed on the basis of the fifteen sorts of pixel drive data GD as shown in FIG. 36. According to such a drive, as shown in FIG. 36, except in the case of representing an intensity level "0" (a first gradation), the write address discharge is first induced within each pixel cell PC in the head subfield SF1 (indicated by a double circle), and the pixel cell PC is set into the light-up mode. Thereafter, the selective erase address discharge is induced in only the selective erase address step $W_O$ of one subfield among the subfields SF2-SF14 (indicated by a black circle), whereupon the pixel cell PC is set into the light-off mode. That is, each pixel cell PC is set into the light-up mode in the respective subfields which are continuous in correspondence with an intermediate intensity to-be-represented, and light emissions induced by the sustain discharges are repeatedly generated in the numbers of times allotted to the respective subfields (indicated by white circles). In this process, an intensity which corresponds to the total number of the sustain discharges induced within the one-field (or one-frame) display period is visually recognized. Therefore, according to the fifteen sorts of light emission patterns based on the first—fifteenth gradation drives as shown in FIG. 36, intermediate intensities for the fifteen gradations which correspond to the total number of times of the sustain discharges induced in the respective subfields indicated by the white circles are represented.

According to such a drive, regions where light emission patterns (light-up state and extinction state) are inverted from each other within the one-field display period do not coexist within one screen, so that a pseudo contour appearing in such states is prevented.

Here, according to the drive shown in FIG. 38, in the reset step R of the head subfield SF1, a voltage is applied between the column electrodes D and the row electrodes Y with the former electrodes D held as a cathode side and the latter electrodes Y held as an anode side, whereby column side cathode discharges in which currents flow from the row electrodes Y toward the column electrodes D are induced as the first reset discharges. At such a first reset discharge, therefore, when the cations within the discharge gas migrate toward the column electrode D, they collide against the MgO crystals being the secondary electron emission material, which are contained in the fluorophor layer 17 as shown in FIG. 5, and they cause the MgO crystals to emit the secondary electrons therefrom. Especially, in the PDP 50 of the plasma display device shown in FIG. 1, the MgO crystals are exposed to the discharge space as shown in FIG. 5, whereby the probability of collisions with the cations is heightened so as to efficiently emit the secondary electrons into the discharge space. Then, the discharge initiation voltage of the pixel cell PC becomes low owing to the priming action based on such secondary electrons, and hence, a comparatively weak reset discharge can be induced. Consequently, owing to the weak reset discharge, a light emission intensity involved in the discharge lowers, so that a display in which a dark contrast is enhanced is permitted.

Further, according to the drive shown in FIG. 38, the first reset discharge is induced between the row electrode Y formed on the side of the front transparent substrate 10 and the column electrode D formed on the side of the rear substrate 14, as shown in FIG. 3. Therefore, the discharge light which is externally emitted from the side of the front transparent substrate 10 becomes less than in a case where the reset discharge is induced between the row electrodes X and Y both of which are formed on the side of the front transparent substrate 10, so that further enhancement in the dark contrast can be attained.

Besides, in the drive shown in FIGS. 37 and 38, in the head subfield SF1, the reset discharge for initializing all the pixel cells PC into the light-off mode states is induced, and thereafter, the selective write address discharge for shifting the pixel cells PC being in the light-off mode states, into the light-up mode states is induced. Besides, in one subfield among the subfields SF2-SF14 succeeding to the subfield SF1, the selective erase address method which induces the selective erase address discharge for shifting the pixel cell PC being in the light-up mode state, into the light-off mode state is adopted. Therefore, when the black display (intensity level "0") is presented by such a drive, the discharge induced throughout the one-field display period is only the reset discharge in the head subfield SF1. That is, the number of times of discharges induced throughout the one-field display period becomes smaller than in case of performing a drive in which, after the reset discharge for initializing all the pixel cells PC into the light-up mode states has been induced in the subfield SF1, the selective erase address discharge for shifting the pixel cells PC into the light-off mode states is induced. Consequently, according to the drive shown in FIGS. 37 and 38, the contrast in the case of displaying a dark image, namely, the so-called "dark contrast" can be enhanced.

Besides, in the drive shown in FIG. 38, in the sustain step I of the subfield SF1 of the smallest intensity weight, the sustain discharge is induced only once, thereby to heighten a display reproducibility at a low gradation for representing a low intensity. Further, in the sustain step I of the subfield SF1, the sustain pulse IP for inducing the sustain discharges is impressed only once. Therefore, after the end of the sustain discharges induced in accordance with the sustain pulse IP impressed once, the wall charges of negative polarity and the wall charges of positive polarity are respectively formed in the vicinities of the row electrodes Y and in the vicinities of the column electrodes D. Thus, in the selective erase address step $W_D$ of the next subfield SF2, discharges with the column electrodes D as an anode side (hereinbelow, termed the "column side anode discharges") can be induced between the column electrodes D and the row electrodes Y as the selective erase address discharges. On the other hand, in the sustain step I of each of the succeeding subfields SF2-SF14, the number of times of the impressions of the sustain pulse IP is set at an even number. Therefore, immediately after the end of each sustain step I, the wall charges of negative polarity and the wall charges of positive polarity are respectively formed in the vicinities of the row electrodes Y and in the vicinities of the column electrodes D, so that the column side anode discharges are permitted in the selective erase address step $W_D$ which is performed subsequently to each sustain step I. Accordingly, the column electrodes D are merely impressed with the pulse of positive polarity, and increase in the cost of the address driver 55 is suppressed.

Besides, in the PDP 50 shown in FIG. 1, the CL emission MgO crystals being the secondary electron emission material are contained, not only in the magnesium oxide layer 13 which is formed on the side of the front transparent substrate 10 within each pixel cell PC, but also in the fluorophor layer 17 which is formed on the side of the rear substrate 14.

Now, functional effects based on the adoption of such a configuration will be described with reference to FIGS. 29 and 30.

Incidentally, the transition of a discharge strength in the column side cathode discharge which was induced in the case where the reset pulse $RP_{Y1}$ as shown in FIG. 38 was impressed on the so-called "prior-art PDP" wherein the CL emission MgO crystals were contained in only the magnesium oxide layer 13 in the magnesium oxide layer 13 and the fluorophor layer 17 as stated above, is shown in FIG. 29 referred to before.

On the other hand, the transition of a discharge strength in the column side cathode discharge which was induced in the case where the reset pulse $RP_{Y1}$ was impressed on the PDP 50 according to the invention wherein the CL emission MgO crystals were contained in both the magnesium oxide layer 13 and the fluorophor layer 17, is shown in FIG. 30 referred to before.

As shown in FIG. 29, according to the prior-art PDP, the column side cathode discharge of comparatively high strengths continues over 1 [ms] in accordance with the impression of the reset pulse $RP_{Y1}$. In contrast, according to the PDP 50 of the invention, the column side cathode discharge ends within about 0.04 [ms] as shown in FIG. 30. That is, as compared with the prior-art PDP, the PDP 50 of the invention can sharply shorten a discharge delay time in the column side cathode discharge.

Accordingly, when the column side cathode discharge is induced by impressing the row electrode Y of the PDP 50 with the reset pulse $RP_{Y1}$ in the waveform in which the potential transition in the rise section is gentle as shown in FIG. 38, the discharge ends before the potential of the reset pulse $RP_{Y1}$ arrives at its peak potential. Accordingly, the column side cathode discharge ends at a stage at which the voltage applied between the row electrode and the column electrode is low. As shown in FIG. 30, therefore, the discharge strength becomes much lower than in the case of FIG. 29.

That is, in the invention, the reset pulse $RP_{Y1}$ as shown in FIG. 38 by way of example, having the waveform in which the potential transition at the rise is gentle is impressed on the PDP 50 in which the CL emission MgO crystals are contained, not only in the magnesium oxide layer 13, but also in the fluorophor layer 17, thereby to induce the column side cathode discharge of low discharge strengths. In accordance with the invention, accordingly, the column side cathode discharge whose discharge strengths are very low in this manner can be induced as the reset discharge, so that the contrast of an image, especially the dark contrast in the case of displaying a dark image can be heightened.

Figure 39:
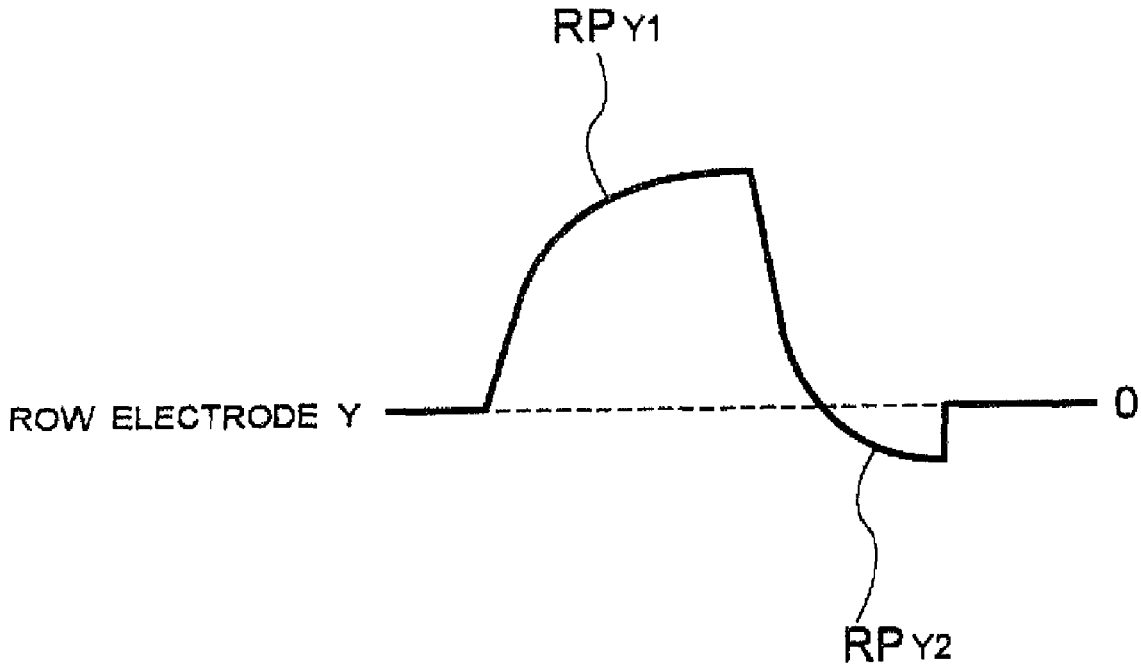
FIG. 39 is a diagram showing another waveform of the reset pulse $RP_{Y1}$.

Incidentally, the waveform at the rise in the reset pulse $RP_{Y1}$ which is impressed on the row electrodes Y in order to induce the reset discharge as the column side cathode discharge is not restricted to one of constant gradient as shown in FIG. 38, but it may well be, for example, one whose gradient gradually changes with the lapse of time as shown in FIG. 39.

Figure 40:
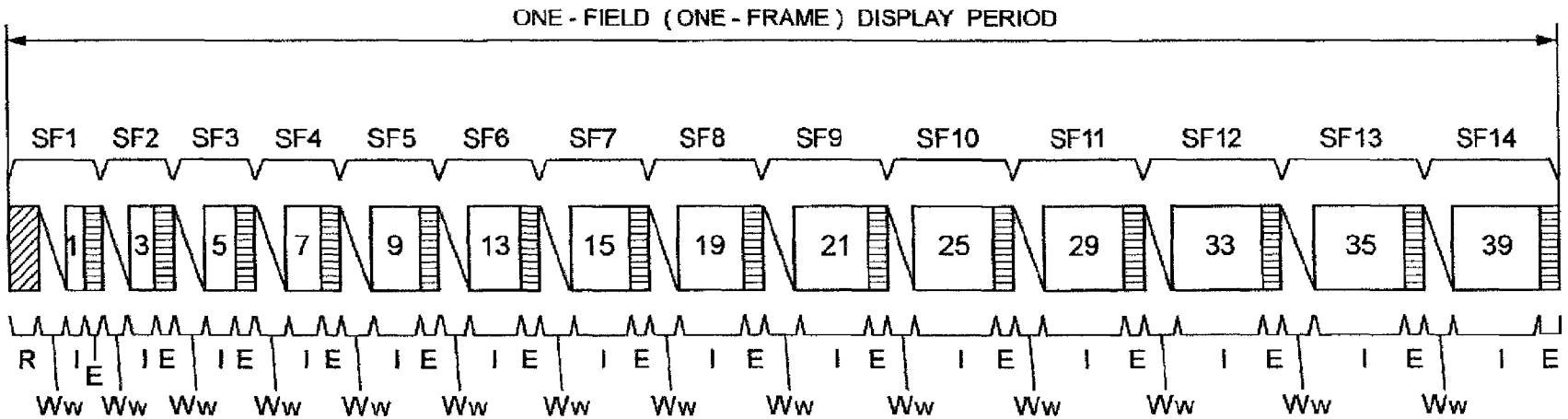
FIG. 40 is a diagram showing another example of a light emission drive sequence which is adopted in the plasma display device shown in FIG. 1.

Besides, in the embodiment, the PDP 50 is driven in accordance with the light emission drive sequence adopting the selective erase address method as shown in FIG. 37, but it may well be driven in accordance with a light emission drive sequence adopting a selective write address method as shown in FIG. 40.

More specifically, the drive control circuit 56 feeds the panel driver with various control signals for successively performing drives which conform to a selective write address step $W_W$, a sustain step I and an erase step E, respectively, in each of subfields SF1-SF14 as shown in FIG. 40. Incidentally, only in the head subfield SF1, the drive control circuit 56 feeds the panel driver with various control signals for successively performing drives which conform to a reset step R, in advance of the selective write address step $W_W$.

Figure 41:
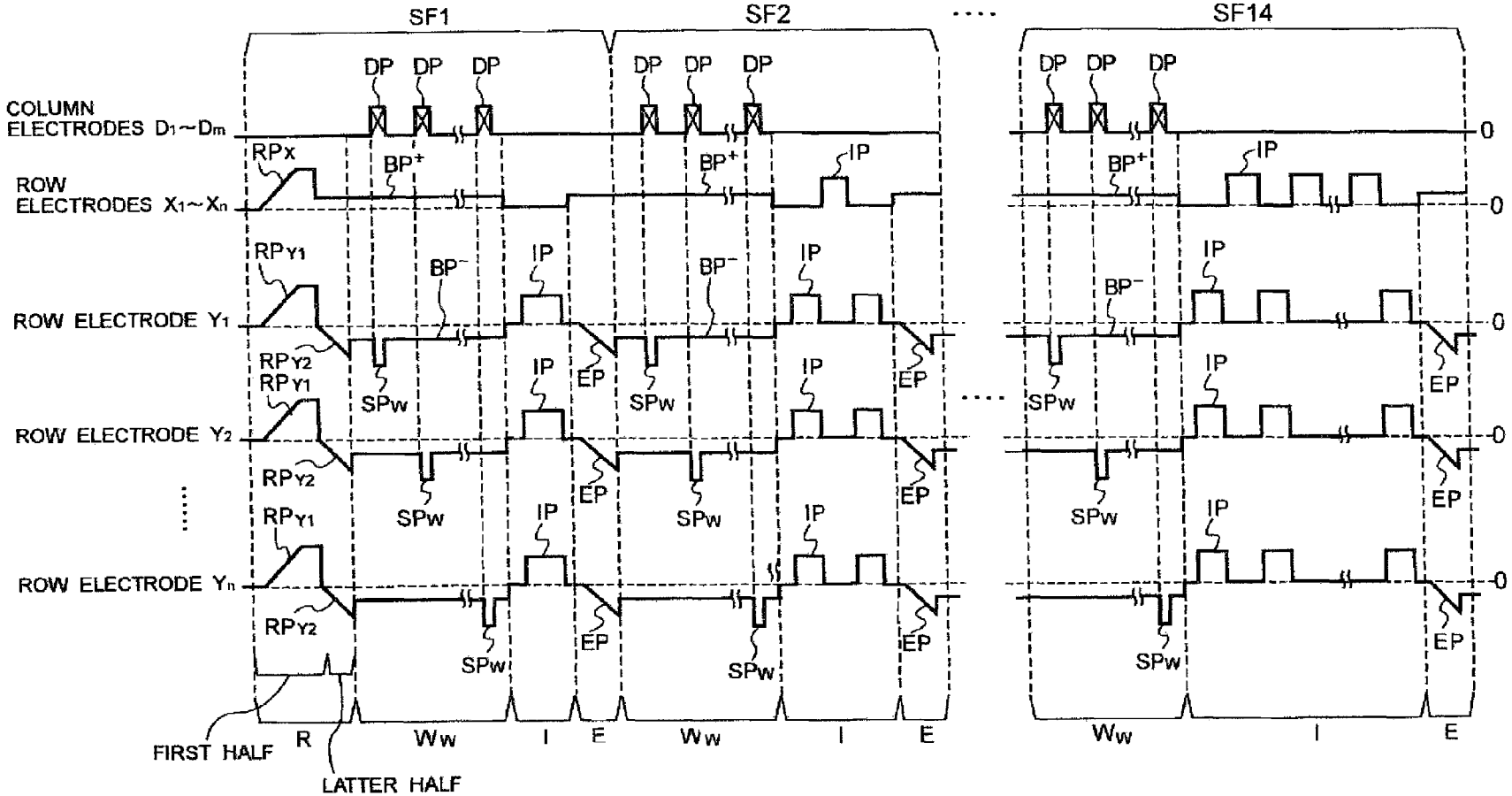
FIG. 41 is a diagram showing various drive pulses which are impressed on the PDP 50 in accordance with the light emission drive sequence shown in FIG. 40.

The panel driver, namely, the X-electrode driver 51, Y-electrode driver 53 and address driver 55 generate(s) various drive pulses as shown in FIG. 41 and feed(s) the drive pulses to the column electrodes D and the row electrodes X and Y of the PDP 50, in accordance with the various control signals fed from the drive control circuit 56.

In FIG. 41, only operations in the head subfield SF1, the subfield SF2 succeeding thereto, and the tailmost subfield SF14 among the subfields SF1-SF14 shown in FIG. 40 are extracted and illustrated. Besides, in FIG. 41, operations in the reset step R and selective write address step $W_W$ of the subfield SF1 are the same as shown in FIG. 38, and hence, they shall be omitted from description.

First of all, in the sustain step I of the head subfield SF1, the Y-electrode driver 53 generates one pulse of a sustain pulse IP having a peak potential of positive polarity, and it impresses the pulse on the row electrodes $Y_1$-$Y_n$ simultaneously. Meantime, the X-electrode driver 51 sets the row electrodes $X_1$-$X_n$ into states of ground potential (0 volt), and the address driver 55 sets the column electrodes $D_1$-$D_m$ into states of the ground potential (0 volt). In accordance with the impression of the sustain pulse IP, a sustain discharge is generated between the row electrodes X and Y within the pixel cell PC set in the light-up mode. Light radiated from the fluorophor layer 17 simultaneously with such a sustain discharge is radiated outside the display panel device through the front transparent substrate 10, whereby one time of display light emission corresponding to the intensity weight of the subfield SF1 is done. Besides, in accordance with the impression of such a sustain pulse IP, a discharge is generated also between the row electrode Y and the column electrode D within the pixel cell PC set in the light-up mode. Owing to such a discharge and the sustain discharge, wall charges of negative polarity are formed in the vicinity of the row electrode Y within the pixel cell PC, and wall charges of positive polarity are respectively formed in the vicinities of the row electrode X and the column electrode D.

Subsequently, in the erase step E of each of the subfields SF1-SF14, the Y-electrode driver 53 impresses on the row electrodes $Y_1$-$Y_n$, an erase pulse EP of negative polarity which has the same waveform as that of a reset pulse $RP_{Y2}$ impressed in the latter half part of the reset step R1. Meantime, the X-electrode driver 51 impresses a base pulse $BP^+$ having a predetermined base potential of the positive polarity, on all the row electrodes $X_1$-$X_n$ in the same manner as in the latter half part of the reset step R. In accordance with the erase pulse EP and the base pulse $BP^+$ as stated above, a weak erase discharge is generated within the pixel cell PC in which the sustain discharge as stated above has been induced. Owing to such an erase discharge, some of the wall charges having been formed within the pixel cell PC are erased, and the pixel cell PC is shifted into a light-off mode state. Further, in accordance with the impression of the erase pulse EP, a weak discharge is generated also between the column electrode D and the row electrode Y within the pixel cell PC. Owing to such a discharge, the wall charges of positive polarity having been formed in the vicinity of the column electrode D are adjusted into a quantity in which a selective write address discharge can be properly induced in the next selective write address step $W_W$.

Subsequently, in the sustain step I of each of the subfields SF2-SF14, the X-electrode driver 51 and the Y-electrode driver 53 impress a sustain pulse IP having a peak potential of positive polarity, on the row electrodes $Y_1$-$Y_n$ and $X_1$-$X_n$, alternately on the row electrodes Y and X and repeatedly the number of times corresponding to the intensity weight of the pertinent subfield, as shown in FIG. 41. Each time such a sustain pulse IP is impressed, a sustain discharge is induced between the row electrodes X and Y within the pixel cell PC set in the light-up mode. Light radiated from the fluorophor layer 17 simultaneously with such a sustain discharge is radiated outside the display panel device through the front transparent substrate 10, whereby display light emissions in the number of times corresponding to the intensity weight of the pertinent subfield SF are done. Incidentally, the total number of the sustain pulses IP which are impressed in each sustain step I is odd. More specifically, in each sustain step I, both the head sustain pulse IP and the final sustain pulse IP are impressed on the row electrodes Y. Therefore, immediately after the end of each sustain step I, wall charges of negative polarity and wall charges of positive polarity are respectively formed in the vicinities of the row electrodes Y and in the vicinities of the row electrodes X and column electrodes D within the pixel cells PC in which the sustain discharges have been induced. Thus, wall charge formation states within the respective pixel cells PC become the same as those immediately after the end of the first reset discharges in the reset step R. Accordingly, the erase pulse EP which has the same waveform as that of a reset pulse $RP_{Y2}$ impressed in the latter half part of the reset step R is impressed on the row electrodes Y in the erase step E which succeeds immediately, whereby the states of all the pixel cells PC can be shifted into the states of the light-off mode.

Here, in performing the drive shown in FIGS. 40 and 41, when the selective write address discharges are induced in the selective write address steps $W_W$ of the respective subfields continuous from the head subfield, intermediate intensity displays for (N+1) gradations (N: the number of subfields within the one-field display period) are permitted. That is, according to the fourteen subfields SF1-SF14, the sustain discharges are performed in the respective subfields which are continuous from the head subfield SF1 in a number corresponding to the gradations to-be-represented, in the same manner as in FIG. 36, so that intermediate intensity displays for fifteen gradations are permitted with a false contour prevented. Besides, in performing the drive shown in FIGS. 40 and 41, intermediate intensities for $2^N$ gradations (N: the number of subfields within the one-field display period) can also be represented, depending upon how to combine the subfields for inducing the selective write address discharges in all the subfields within the one-field display period. That is, in the fourteen subfields SF1-SF14, the combinational patterns of the subfields for inducing the selective write address discharges exist in the number of $2^{14}$, and hence, intermediate intensity displays for 16384 gradations are permitted.

According to the drive shown in FIGS. 40 and 41, the reset pulse $RP_{Y2}$ which is impressed on the row electrodes Y in the reset step R, and the erase pulse EP which is impressed on the row electrodes Y in the erase step E have the same waveform, as shown in FIG. 41, so that both the pulses can be generated by a common circuit. Further, the selective write address steps $W_W$ are consistently performed in the respective subfields SF1-SF14, so that one system suffices for a circuit which generates scan pulses, and in each selective write address step $W_W$, a general column-side anode discharge in which a column electrode side is set as an anode may be induced.

Therefore, in the case where the drive based on the selective write address method as shown in FIGS. 40 and 41 has been adopted in driving the PDP 50, the panel driver for generating the various drive pulses can be built less expensively than in the case where the drive based on the selective erase address method as shown in FIGS. 37 and 38 has been adopted.

In the embodiment shown in FIG. 5, the MgO crystals are contained in the fluorophor layer 17 which is disposed on the side of the rear substrate 14 of the PDP 50. As shown in FIG. 34, however, a secondary electron emission layer 18 made of a secondary electron emission material may well be disposed so as to cover the surface of the fluorophor layer 17. In such a case, the secondary electron emission layer 18 may well be formed in a way that crystals made of the secondary electron emission material (for example, MgO crystals containing CL emission MgO crystals) are spread all over the surface of the fluorophor layer 17, or that the secondary electron emission material is formed into a thin film.

Besides, in the reset step R shown in FIG. 38 or FIG. 41, the reset discharges are induced simultaneously for all the pixel cells, but reset discharges may well be performed in temporally spaced fashion, for respective pixel cell blocks each consisting of a plurality of pixel cells.

This application is based on Japanese Patent Applications Nos. 2006-243912, 2006-246686 and 2006-246687 which are hereby incorporated by reference.

What is claimed is:

1. A plasma display panel including a pair of substrates which oppose to each other through a discharge space, a plurality of row electrode pairs which are disposed on one of the pair of substrates, a plurality of column electrodes which are disposed on the other substrate so as to extend in a direction intersecting the row electrode pairs and which form unit light emission regions in the discharge space at their respective parts intersecting the row electrode pairs, and fluorophor layers which are disposed at positions confronting the unit light emission regions between the column electrodes and the row electrode pairs, with a discharge gas enclosed in the discharge space, wherein: a secondary electron emission material is contained in said fluorophor layers; and said secondary electron emission material is magnesium oxide which contains magnesium oxide crystals that have a characteristic of presenting a cathode luminescence light emission having a peak within a wavelength region of 200-300 nm, when excited by an electron beam.

2. A plasma display panel as defined in claim 1, wherein said secondary electron emission material is located at those parts in said fluorophor layers which confront the unit light emission regions.

3. A plasma display panel as defined in claim 1, wherein said secondary electron emission material is mixed with fluorescent materials which constitute said fluorophor layers.

4. A plasma display panel as defined in claim 1, wherein said secondary electron emission materials form layers, and they are stacked on layers formed of fluorescent materials constituting said fluorophor layers.

5. A plasma display panel as defined in claim 1, wherein the magnesium oxide crystals have a characteristic of presenting the cathode luminescence light emission having a peak within 230 nm-250 nm.

6. A plasma display panel as defined in claim 1, wherein the magnesium oxide crystals are magnesium oxide single crystals which are produced by vapor phase oxidation.

* * * * *